US010415455B2

(12) United States Patent
Hasegawa et al.

(10) Patent No.: US 10,415,455 B2
(45) Date of Patent: Sep. 17, 2019

(54) COOLING APPARATUS OF INTERNAL COMBUSTION ENGINE

(71) Applicant: TOYOTA JIDOSHA KABUSHIKI KAISHA, Toyota-shi, Aichi-ken (JP)

(72) Inventors: Yoshio Hasegawa, Toyota (JP); Yuji Miyoshi, Susono (JP); Tomohiro Shinagawa, Sunto-gun (JP); Yoshiharu Hirata, Sunto-gun (JP); Ryo Michikawauchi, Numazu (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/936,051

(22) Filed: Mar. 26, 2018

(65) Prior Publication Data

US 2018/0283259 A1 Oct. 4, 2018

(30) Foreign Application Priority Data

Mar. 28, 2017 (JP) ..... 2017-063304

(51) Int. Cl.

| | |
|---|---|
| ***F01P 7/16*** | (2006.01) |
| ***F01P 3/00*** | (2006.01) |
| ***F01P 3/02*** | (2006.01) |
| ***F01P 5/10*** | (2006.01) |
| *F02F 1/36* | (2006.01) |
| *F02F 1/10* | (2006.01) |
| *F01P 7/14* | (2006.01) |

(52) U.S. Cl.

CPC ..... *F01P 7/165* (2013.01); *F01P 3/02* (2013.01); *F01P 5/10* (2013.01); *F01P 7/162* (2013.01); *F01P 2003/027* (2013.01); *F01P 2003/028* (2013.01); *F01P 2007/146* (2013.01); *F01P 2037/00* (2013.01); *F02F 1/10* (2013.01); *F02F 1/36* (2013.01)

(58) Field of Classification Search

CPC .... F01P 7/165; F01P 3/02; F01P 7/162; F01P 2003/185; F01P 11/04; F01P 5/10

See application file for complete search history.

(56) References Cited

U.S. PATENT DOCUMENTS

2013/0047940 A1* 2/2013 Quix ..... F01P 7/165 123/41.08
2017/0107891 A1* 4/2017 Murai ..... F01P 3/02

FOREIGN PATENT DOCUMENTS

JP 2012-184693 9/2012
JP 2013-160183 8/2013

OTHER PUBLICATIONS

U.S. Appl. No. 15/895,239, filed Feb. 13, 2018.

* cited by examiner

*Primary Examiner* — Jacob A Amick
(74) *Attorney, Agent, or Firm* — Finnegan, Henderson, Farabow, Garrett & Dunner, LLP

(57) ABSTRACT

A cooling apparatus of an engine of the invention has a circulation passage for supplying cooling water to head and block passages through a heat exchanger. The apparatus circulates the cooling water through the circulation passage when a second condition is satisfied and then, a first condition is satisfied. The first condition includes a water supply condition that a supply of the cooling water to the exchanger is requested. The second condition includes the water supply condition and a condition that a cooling water temperature is lower than an engine completely-warmed water temperature.

6 Claims, 39 Drawing Sheets

| | EGR COOLER WATER SUPPLY IS NOT REQUESTED AND HEATER CORE WATER SUPPLY IS NOT REQUESTED. | EGR COOLER WATER SUPPLY IS REQUESTED AND HEATER CORE WATER SUPPLY IS NOT REQUESTED. | EGR COOLER WATER SUPPLY IS NOT REQUESTED AND HEATER CORE WATER SUPPLY IS REQUESTED. | EGR COOLER WATER SUPPLY IS REQUESTED AND HEATER CORE WATER SUPPLY IS REQUESTED. |
|---|---|---|---|---|
| COOL STATE | ACTIVATION CONTROL A | ACTIVATION CONTROL B | ACTIVATION CONTROL C | ACTIVATION CONTROL D |
| FIRST SEMI-WARMED STATE | ACTIVATION CONTROL E | ACTIVATION CONTROL F | ACTIVATION CONTROL G | ACTIVATION CONTROL H |
| SECOND SEMI-WARMED STATE | ACTIVATION CONTROL E | ACTIVATION CONTROL I | ACTIVATION CONTROL J | ACTIVATION CONTROL K |
| COMPLETELY-WARMED STATE | ACTIVATION CONTROL L | ACTIVATION CONTROL M | ACTIVATION CONTROL N | ACTIVATION CONTROL O |

Fig.5

| | EGR COOLER WATER SUPPLY IS NOT REQUESTED AND HEATER CORE WATER SUPPLY IS NOT REQUESTED. | EGR COOLER WATER SUPPLY IS REQUESTED AND HEATER CORE WATER SUPPLY IS NOT REQUESTED. | EGR COOLER WATER SUPPLY IS NOT REQUESTED AND HEATER CORE WATER SUPPLY IS REQUESTED. | EGR COOLER WATER SUPPLY IS REQUESTED AND HEATER CORE WATER SUPPLY IS REQUESTED. |
|---|---|---|---|---|
| COOL STATE | ACTIVATION CONTROL A | ACTIVATION CONTROL B | ACTIVATION CONTROL C | ACTIVATION CONTROL D |
| FIRST SEMI-WARMED STATE | ACTIVATION CONTROL E | ACTIVATION CONTROL F | ACTIVATION CONTROL G | ACTIVATION CONTROL H |
| SECOND SEMI-WARMED STATE | ACTIVATION CONTROL I | ACTIVATION CONTROL I | ACTIVATION CONTROL J | ACTIVATION CONTROL K |
| COMPLETELY-WARMED STATE | ACTIVATION CONTROL L | ACTIVATION CONTROL M | ACTIVATION CONTROL N | ACTIVATION CONTROL O |

Fig.39

COOLING APPARATUS OF INTERNAL COMBUSTION ENGINE

BACKGROUND

Field

The invention relates to a cooling apparatus of an internal combustion engine for cooling the internal combustion engine by cooling water.

Description of the Related Art

In general, an amount of heat transmitted to a cylinder block of an internal combustion engine due to combustion in cylinders, is smaller than the amount of the heat transmitted to a cylinder head of the engine due to the combustion in the cylinders. Thereby, a temperature of the cylinder block is unlikely to increase easily, compared with a temperature of the cylinder head.

There is known a cooling apparatus of the engine for supplying cooling water to the cylinder head without supplying the cooling water to the cylinder block to increase the temperature of the cylinder block promptly when a temperature of the engine is low (for example, see JP 2012-184693 A). Hereinafter, the known cooling apparatus will be referred to as "the known apparatus", and the temperature of the engine will be referred to as "the engine temperature".

In general, the known apparatus has a head water passage corresponding to a passage of the cooling water formed in the cylinder head and a block water passage corresponding to a passage of the cooling water formed in the cylinder block.

The known apparatus further has a normal circulation water passage corresponding to a passage of the cooling water for flowing the cooling water discharged from the head and block water passages, through a radiator, and supplying the cooling water which has flowed through the radiator, to the head and block water passages.

The known apparatus performs a normal circulation operation for circulating the cooling water through the normal circulation water passage to supply the cooling water having a low temperature decreased by the radiator, to the head and block water passages, thereby cooling the cylinder head and the cylinder block.

The known apparatus can increase the temperature of the cylinder block at a large rate if the known apparatus has a direct circulation water passage and is configured to perform a direct circulation operation for circulating the cooling water through the direct circulation water passage. The direct circulation water passage is a passage which supplies the cooling water from the head water passage directly to the block water passage without flowing the cooling water through the radiator and supplies the cooling water from the block water passage to the head water passage. According to the direct circulation operation, the cooling water having the temperature increased by flowing through the head water passage is supplied directly to the block water passage.

Accordingly, the known apparatus can increase the temperature of the cylinder block promptly if the known apparatus is configured to perform the direct circulation operation when a cooling water temperature corresponding to the temperature of the cooling water as a parameter representing the engine temperature, is lower than a predetermined temperature. In addition, if the known apparatus is configured to perform the normal circulation operation when the cooling water temperature becomes equal to or higher than the predetermined temperature, the known apparatus can cool the cylinder head and the cylinder block.

There is known a hybrid vehicle driven by the engine and an electric motor. An operation of the engine of the hybrid vehicle may temporarily stop and then, restart. Further, there is known a vehicle in which the engine operation temporarily stops when the vehicle stops and the engine operation restarts when the vehicle is requested to move. In the vehicles, the cooling water temperature may become lower than the predetermined temperature while the engine operation stops for a relatively long time. In this case, the known apparatus changes the cooling water circulation operation from the normal circulation operation to the direct circulation operation. Thereby, the temperature of the cylinder block increases at the large rate.

In this regard, the cooling water temperature is a parameter representing the engine temperature, however, does not always correspond to the engine temperature. In particular, the cooling water temperature is unlikely to correspond to the engine temperature when the temperature of the cooling water discharged from the head and block water passages is acquired as the cooling water temperature.

In consideration of a relationship between the cooling water temperature and the engine temperature, the inventors of this application have realized that the engine temperature is likely to be higher than a temperature at which the temperature of the cylinder block should be increased at the large rate when the cooling water temperature becomes lower than the predetermined temperature after the cooling water temperature becomes equal to or higher than the predetermined temperature.

Therefore, if the cooling water circulation operation is changed from the normal circulation operation to the direct circulation operation in response to the cooling water temperature becoming lower than the predetermined temperature, the temperature of the cylinder block may increase excessively.

SUMMARY

The invention has been made for solving the above-mentioned problems. An object of the invention is to provide a cooling apparatus of the engine capable of increasing the temperature of the cylinder block promptly when the engine temperature is low and preventing the temperature of the cylinder block from increasing excessively.

A cooling apparatus of an internal combustion engine (10) according to the invention cools a cylinder head (14) and a cylinder block (15) of the internal combustion engine (10).

The cooling apparatus according to the invention comprises a pump (70), a radiator (71), at least one heat exchanger (43 or 72), a head water passage (51), a block water passage (52), a first circulation water passage (56, 57, 552, 62, 584, 53, and 54), a second circulation passage (56, 581, 582, 59 to 61, 583, 584, 53, and 54), a third circulation water passage (56, 57, 581, 582, 59 to 61, 583, 584, and 53 to 55), a fourth circulation water passage (56 to 58, and 53 to 55), at least one sensor (83, 84, 85, or 86), and an electronic control unit (90). The pump (70) circulates the cooling water. The radiator (71) cools the cooling water. The at least one heat exchanger (43 or 72) exchanges heat between the at least one heat exchanger (43 or 72) and the cooling water. The head water passage (51) is formed in the cylinder head (14). The block water passage (52) is formed in the cylinder block (15). The first circulation water passage (56, 57, 552, 62, 584, 53, and 54) supplies the cooling water discharged from the head water passage (51), to the block water passage (52) without flowing the cooling water through the radiator (71) and the at least one heat exchanger (43 or 72) and supplies the cooling water discharged from the block water passage (52), to the head water passage (51). The second circulation passage (56, 581, 582, 59 to 61, 583, 584, 53, and 54) supplies the cooling water discharged from the head water passage (51), to the head water passage (51) through the at least one heat exchanger (43 or 72). The third circulation water passage (56, 57, 581, 582, 59 to 61, 583, 584, and 53 to 55) supplies the cooling water discharged from the head and block water passages (51 and 52), to the head and block water passages (51 and 52) through the at least one heat exchanger (43 or 72). The fourth circulation water passage (56 to 58, and 53 to 55) supplies the cooling water discharged from the head and block water passages (51 and 52), to the head and block water passages (51 and 52) through the radiator (71). The at least one sensor (83, 84, 85, or 86) acquires a temperature of the cooling water as a cooling water temperature. The electronic control unit (90) is configured to control an activation of the pump (70) and select from among the first to fourth circulation water passages (56, 57, 552, 62, 584, 53, and 54; 56, 581, 582, 59 to 61, 583, 584, 53, and 54; 56, 57, 581, 582, 59 to 61, 583, 584, and 53 to 55; and 56 to 58, and 53 to 55) as a circulation water passage for circulating the cooling water.

The electronic control unit (90) is configured to perform a first circulation operation for activating the pump (70) and circulating the cooling water through the first and second circulation water passages (56, 57, 552, 62, 584, 53, and 54; 56, 581, 582, 59 to 61, 583, 584, 53, and 54) (see processes of steps 2515, 2520, and 2230 of FIG. 22) when a low temperature condition and a first condition including a water supply condition are satisfied (see determinations "Yes" at steps 2520 and 2522 of FIG. 25, determinations "Yes" at steps 2210 and 2225 of FIG. 22 and a determination "Yes" at a step 2205 of FIG. 22, and a determination "No" at a step 2210 of FIG. 22). The low temperature condition is a condition that the cooling water temperature is lower than a predetermined water temperature lower than an engine completely-warmed temperature at which warming of the internal combustion engine (10) is completed. The water supply condition is a condition that a supply of the cooling water to the at least one heat exchanger (43 or 72) is requested.

The electronic control unit (90) is further configured to perform a second circulation operation for activating the pump (70) and circulating the cooling water through the third circulation water passage (56, 57, 581, 582, 59 to 61, 583, 584, and 53 to 55) (see processes of steps 2315, 2320, and 2330 of FIG. 23) when a second condition is satisfied (see determinations "Yes" at a step 2530 of FIG. 25, determinations "Yes" at steps 2310 and 2325 of FIG. 23 and a determination "Yes" at a step 2310 of FIG. 23, and a determination "No" at a step 2310 of FIG. 23). The second condition includes a high temperature condition and the water supply condition. The high temperature condition is a condition that the cooling water temperature is lower than the engine completely-warmed water temperature.

The electronic control unit (90) is further configured to perform a cooling circulation operation for activating the pump (70) and circulating the cooling water through the fourth circulation water passage (56 to 58, and 53 to 55) (see processes of steps 2415, 2420, 2430, and 2435 of FIG. 24) when an engine completely-warmed condition is satisfied (see a determination "No" at a step 2530 of FIG. 25). The engine completely-warmed condition is a condition that the cooling water temperature is equal to or higher than the engine completely-warmed water temperature.

The electronic control unit (90) is further configured to perform the second circulation operation (see a process of a step 2545 of FIG. 25) when the second condition is satisfied and then, the first condition is satisfied after an operation of the internal combustion engine (10) is permitted (see determinations "No" at steps 2522 and 2522 of FIG. 25).

As described above, when the cooling water temperature becomes equal to or higher than the predetermined water temperature and then, becomes lower than the predetermined water temperature, the engine temperature is likely to be higher than a temperature, at which the temperature of the cylinder block should be increased at the large rate.

The cooling apparatus according to the invention performs the second circulation operation when the second condition is satisfied and then, the first condition is satisfied after the engine operation is permitted. In this regard, the second condition includes the high temperature condition and the water supply condition. The high temperature condition is a condition that the cooling water temperature is lower than the engine completely-warmed water temperature, and the cooling water temperature is equal to or higher than the predetermined water temperature. The water supply condition is a condition that the supply of the cooling water to the heat exchanger is requested. The first condition includes the low temperature condition and the water supply condition. The low temperature condition is a condition that the cooling water temperature is lower than the predetermined water temperature. Thereby, the cooling water discharged from the head water passage and having an increased temperature, is not supplied directly to the block water passage. The cooling water having a temperature decreased by flowing the heat exchanger is supplied to the block water passage. Thus, the temperature of the cylinder block is prevented from increasing excessively.

The electronic control unit (90) may be configured to perform a third circulation operation for activating the pump (70) and flowing the cooling water through the first circulation water passage (56, 57, 552, 62, 584, 53, and 54) while controlling a flow rate of the cooling water such that the flow rate of the cooling water supplied to the head and block water passages (51 and 52), is smaller than a predetermined flow rate (see a process of a step 2230 of FIG. 22) when a third condition is satisfied (see determinations "Yes" at steps 2520 and 2433 of FIG. 25, and determinations "No" at steps 2205 and 2225 of FIG. 22). The third condition is a condition that the low temperature condition is satisfied, and the water supply condition is not satisfied. In this case, the electronic control unit (90) may be further configured to perform a fourth circulation operation for activating the pump (70) and flowing the cooling water through the first circulation water passage (56, 57, 552, 62, 584, 53, 54) while controlling the flow rate of the cooling water such that the flow rate of the cooling water supplied to the head and block water passages (51 and 52), is equal to or larger than the predetermined flow rate (see a process of a step 2335 of FIG. 23) when a fourth condition is satisfied (see a determination "Yes" at steps 2530 of FIG. 25, and determinations "No" at steps 2305 and 2325 of FIG. 23). The fourth condition is a condition that the high temperature condition is satisfied, and the water supply condition is not satisfied. In this case, the electronic control unit (90) may be further configured to perform the fourth circulation operation (see the process of the step 2335 of FIG. 23) when the fourth condition is satisfied and then, third condition is satisfied after the operation of the internal combustion engine (10) is permitted (see a determination "Yes" at steps 2530 of FIG. 25, and determinations "No" at steps 2305 and 2325 of FIG. 23).

When the water supply condition that the supply of the cooling water to the heat exchanger is requested, is not satisfied, the cooling water is not preferably supplied to the heat exchanger. In this case, the cooling water must be circulated through the first circulation water passage to circulate the cooling water through the head and block water passages.

When the third condition is satisfied after the fourth condition is satisfied since the operation of the internal combustion engine is permitted, the temperature of the cylinder block is likely to be a temperature at which the temperature of the cylinder block should not be increased at the large rate. In this case, the temperature of the cylinder block may be excessively increased if the cooling water is circulated through the first circulation water passage such that the cooling water having the same flow amount as the relatively small flow amount of the cooling water, is supplied to the block water passage when the third circulation is performed.

The cooling apparatus according to the invention circulates the cooling water through the first circulation water passage when the third condition is satisfied after the fourth condition is satisfied. In this case, the flow amount of the cooling water supplied to the block water passage is larger than the flow rate of the cooling water supplied to the block water passage when the third circulation is performed. The cylinder block is at least cooled when the cooling water is supplied to the block water passage, and a degree of cooling the cylinder block increases as the flow amount of the cooling water supplied to the block water passage increases. Therefore, the temperature of the cylinder block is prevented from increasing excessively.

Further, the electronic control unit (90) may be configured to perform a fifth circulation operation for activating the pump (70) and circulating the cooling water through the first circulation water passage (56, 57, 552, 62, 584, 53, and 54) when a third condition is satisfied. The third condition is a condition that the low temperature condition is satisfied, and the water supply condition is not satisfied. In this case, the electronic control unit (90) may be configured to perform a sixth circulation operation for activating the pump (70) and circulating the cooling water through the third circulation water passage (56, 57, 581, 582, 59 to 61, 583, 584, and 53 to 55) when a fourth condition is satisfied. The fourth condition being a condition that the high temperature condition is satisfied, and the water supply condition is not satisfied. In this case, the electronic unit (90) may be configured to perform the sixth circulation operation when the fourth condition is satisfied and then, the third condition is satisfied after the operation of the internal combustion engine is permitted (see FIG. 39).

As described above, when the third condition is satisfied after the fourth condition is satisfied since the operation of the internal combustion engine is permitted, the temperature of the cylinder block is likely to be a temperature at which the temperature should not be increased at the large rate. In this case, when the fifth circulation for circulating the cooling water through the first circulation water passage, is performed, the temperature of the cylinder block is likely to be excessively increased.

When the fourth condition is satisfied and then, the third condition is satisfied, the cooling apparatus according to the invention does not perform the fifth circulation operation and performs the sixth circulation operation for circulating the cooling water through the third circulation water passage. Therefore, the temperature of the cylinder block is prevented from increasing excessively.

Further, the electronic control unit (90) may be configured to perform the second circulation operation (see processes of steps 2315, 2320, and 2330 of FIG. 23) when the engine completely-warmed condition is satisfied and then, the first condition is satisfied after the operation of the internal combustion engine is permitted (see a determination "No" at the step 2522 of FIG. 25).

When the cooling water temperature becomes equal to or higher than the engine completely-warmed water temperature and then, becomes lower than the predetermined water temperature, the engine temperature is likely to be higher than the temperature, at which the temperature of the cylinder block should be increased at the large rate.

When the engine completely-warmed condition is satisfied and then, the first condition is satisfied after the engine operation is permitted, the cooling apparatus according to the invention performs the second circulation operation. Thereby, the cooling water having the temperature increased by flowing through the head water passage, is not supplied to the block water passage, and the cooling water having the temperature decreased by flowing through the heat exchanger, is supplied to the block water passage. Thus, the temperature of the cylinder block is prevented from increasing excessively.

Further, the electronic control unit (90) may be configured to activate the pump (70) and circulate the cooling water through the second circulation passage (56, 581, 582, 59 to 61, 583, 584, 53, and 54) without circulating the cooling water through the first circulation water passage (56, 57, 552, 62, 584, 53, and 54) (see processes of steps 2115, 2120, and 2130 of FIG. 21) when a cool condition and the water supply condition are satisfied (see determinations "Yes" at steps 2520 and 2512 of FIG. 25, determinations "Yes" at steps 2110, 2125 and 2105 of FIG. 21, and a determination "No" at a step 2110 of FIG. 21). The cool condition is a condition that the cooling water temperature is lower than a cool state water temperature lower than the predetermined water temperature.

When the cooling water temperature is lower than the cool state water temperature, the temperature of the cylinder block should be increased at a greatly large rate.

When the cool condition that the cooling water temperature is lower than the cool state water temperature, is satisfied, the cooling apparatus according to the invention does not supply the cooling water to the block water passage. Therefore, the cylinder block is not cooled. Thus, the temperature of the cylinder block increases at the greatly large rate.

Further, the electronic control unit (90) may be configured to stop an activation of the pump (70) (see a process of a step 2135 of FIG. 21) when the cool condition is satisfied, and the water supply condition is not satisfied (see determinations "Yes" at steps 2105 and 2125 of FIG. 21, and determinations "No" at steps 2105 and 2125 of FIG. 21).

As described above, when the cool condition is satisfied, the temperature of the cylinder block should be increased at the greatly large rate. Further, when the water supply condition is not satisfied, the cooling water should not be supplied to the heat exchanger.

When the cool condition is satisfied, and the water supply condition is not satisfied, the cooling apparatus according to the invention stops the activation of the pump. Thereby, the cooling water is not supplied to the block water passage and the heat exchanger. Thus, the temperature of the cylinder block increases at the greatly large rate without supplying the cooling water to the heat exchanger.

In the above description, for facilitating understanding of the present invention, elements of the present invention corresponding to elements of an embodiment described later are denoted by reference symbols used in the description of the embodiment accompanied with parentheses. However, the elements of the present invention are not limited to the elements of the embodiment defined by the reference symbols. The other objects, features, and accompanied advantages of the present invention can be easily understood from the description of the embodiment of the present invention along with the drawings.

BRIEF DESCRIPTION OF THE DRAWINGS

FIG. 5 is a view for showing activation controls executed by the cooling apparatus according to the embodiment.

FIG. 39 is a view for showing the activation controls executed by a cooling apparatus according to a fifth modified example of the embodiment of the invention.

DESCRIPTION OF THE PREFERRED EMBODIMENTS

Below, a cooling apparatus of an internal combustion engine according to an embodiment of the invention will be described with reference to the drawings. The cooling apparatus according to the embodiment is applied to an internal combustion engine 10 shown in FIGS. 1 to 3. Hereinafter, the cooling apparatus according to the embodiment will be referred to as "the embodiment apparatus".

Figure 1:
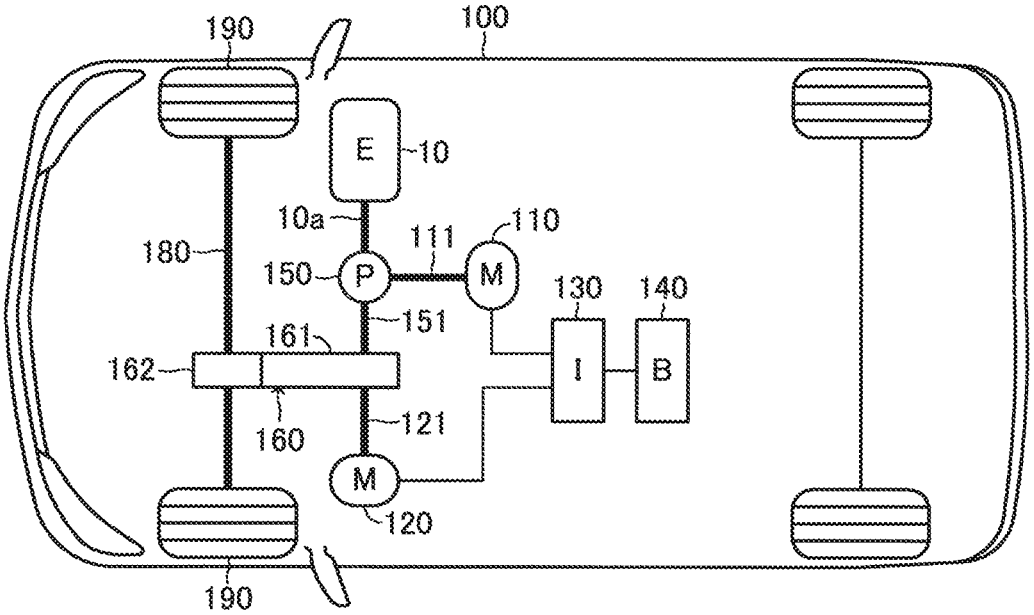
FIG. 1 is a view for showing a vehicle having an internal combustion engine to which a cooling apparatus according to an embodiment of the invention is applied.

As shown in FIG. 1, the engine 10 is installed in a hybrid vehicle 100. The vehicle 100 has a vehicle driving apparatus including the engine 10, a first motor generator 110, a second motor generator 120, an inverter 130, a rechargeable battery 140, a driving force distribution mechanism 150, and a driving force transmission mechanism 160.

The engine 10 is a multi-cylinder (in this embodiment, linear-four-cylinder) four-cycle piston-reciprocation type diesel engine. The engine 10 may be a gasoline engine.

The driving force distribution mechanism 150 distributes an engine torque into a torque for rotating an output shaft 151 of the driving force distribution mechanism 150 and a torque for driving the first motor generator 110 as an electric generator at a predetermined distribution property. The engine torque is a torque output from the engine 10.

The driving force distribution mechanism 150 has a planetary gear mechanism (not shown). The planetary gear mechanism has a sun gear, pinion gears, a planetary carrier, and a ring gear.

A rotation shaft of the planetary carrier is connected to an output shaft 10*a* of the engine 10 and transmits the engine torque to the sun gear and the ring gear via the pinion gears. A rotation shaft of the sun gear is connected to a rotation shaft 111 of the first motor generator 110 and transmits the engine torque from the sun gear to the first motor generator 110. The first motor generator 110 is rotated by the engine torque transmitted from the sun gear, thereby generating electric power. A rotation shaft of the ring gear is connected to the output shaft 151 of the driving force distribution mechanism 150. The engine torque input to the ring gear is transmitted from the driving force distribution mechanism 150 to the driving force transmission mechanism 160 via the output shaft 151.

The driving force transmission mechanism 160 is connected to the output shaft 151 of the driving force distribution mechanism 150 and a rotation shaft 121 of the second motor generator 120. The driving force transmission mechanism 160 includes a reduction gear train 161 and a differential gear 162.

The reduction gear train 161 is connected to a vehicle wheel drive shaft 180 via the differential gear 162. Therefore, the engine torque input from the output shaft 151 of the driving force distribution mechanism 150 to the driving force transmission mechanism 160 and a torque input from the rotation shaft 121 of the second motor generator 120 to the driving force transmission mechanism 160 are transmitted to left and right front driving wheels 190 via the wheel drive shaft 180. In this regard, driving wheels may be left and right rear wheels or left and right front and rear wheels.

The driving force distribution mechanism 150 and the driving force transmission mechanism 160 are known, for example, by JP 2013-177026 A and the like.

The first and second motor generators 110 and 120 are permanent magnet synchronous motors, respectively connected to the inverter 130. The inverter 130 converts a DC power (i.e., direct-current power) supplied from the battery 140 to a three-phase AC power (alternate-current power). The inverter 130 supplies the three-phase AC power to the first motor generator 110, thereby activating the first motor generator 110 as an electric motor. Further, the inverter 130 supplies the three-phase AC power to the second motor generator 120, thereby activating the second motor generator 120 as the electric motor.

When the rotation shaft 111 of the first motor generator 110 is rotated by outside force such as moving energy of the vehicle 100 or the engine torque, the first motor generator 110 activates as an electric generator, thereby generating electric power. When the first motor generator 110 activates as the electric generator, the inverter 130 converts the three-phase AC power generated by the first motor generator 110 to the DC power and stores the DC power in the battery 140.

The first motor generator 110 can apply a regeneration braking force (or a regeneration braking torque) to the driving wheels 190 when the moving energy of the vehicle 100 is input as the outside force to the first motor generator 110 via the driving wheels 190, the wheel drive shaft 180, the driving force transmission mechanism 160, and the driving force distribution mechanism 150.

When the rotation shaft 121 of the second motor generator 120 is rotated by the outside force, the second motor generator 120 activates as the electric generator, thereby generating the electric power. When the second motor generator 120 activates as the generator, the inverter 130 converts the three-phase AC power generated by the second motor generator 120 to the DC power and stores the DC power in the battery 140.

The second motor generator 120 can apply the regeneration braking force (or the regeneration braking torque) to the driving wheels 190 when the moving energy of the vehicle 100 is input as the outside force to the second motor generator 120 via the driving wheels 190, the wheel drive shaft 180, and the driving force transmission mechanism 160.

<Configuration of Engine>

Figure 2:
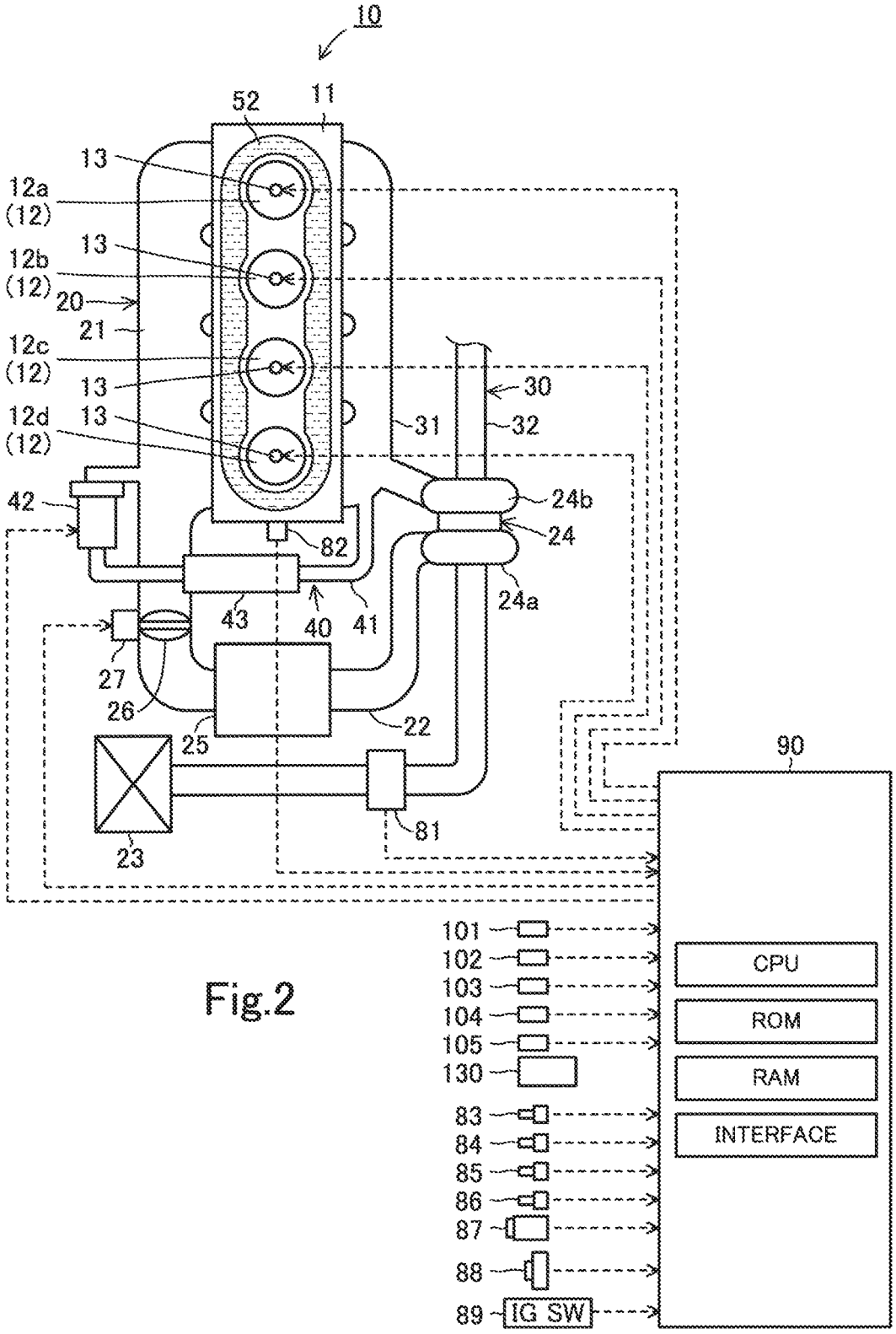
FIG. 2 is a view for showing the engine shown in FIG. 1.

As shown in FIG. 2, the engine 10 includes an engine body 11, an intake system 20, an exhaust system 30, and an EGR system 40.

The engine body 11 includes a cylinder head 14, a cylinder block 15 (see FIG. 3), a crank case (not shown) and the like. Four cylinders or combustion chambers 12*a* to 12*d* are formed in the engine body 11. Fuel injectors 13 are provided such that the fuel injectors 13 expose to upper areas of the cylinders 12*a* to 12*d*, respectively. Hereinafter, the cylinders 12*a* to 12*d* will be collectively referred to as "the cylinders 12". The fuel injectors 13 open in response to commands output from an electronic control unit 90 described later, thereby injecting fuel directly into the cylinders 12, respectively. Hereinafter, the electronic control unit 90 will be referred to as "the ECU 90".

The intake system 20 includes an intake manifold 21, an intake pipe 22, an air cleaner 23, a compressor 24*a* of a turbocharger 24, an intercooler 25, a throttle valve 26, and a throttle valve actuator 27.

The intake manifold 21 includes branch portions and a collecting portion. The branch portions are connected to the cylinders 12, respectively and to a collecting portion. The intake pipe 22 is connected to the collecting portion of the intake manifold 21. The intake manifold 21 and the intake pipe 22 define an intake passage. The air cleaner 23, the compressor 24*a*, the intercooler 25, and the throttle valve 26 are provided at the intake pipe 22 in order from upstream to downstream in a flow direction of the intake air. The throttle valve actuator 27 changes an opening degree of the throttle valve 26 in response to the commands output from the ECU 90.

The exhaust system 30 includes an exhaust manifold 31, an exhaust pipe 32, and a turbine 24*b* of the turbocharger 24.

The exhaust manifold 31 includes branch portions and a collecting portion. The branch portions are connected to the cylinders 12, respectively and to a collecting portion. The exhaust pipe 32 is connected to the collecting portion of the exhaust manifold 31. The exhaust manifold 31 and the exhaust pipe 32 define an exhaust passage. The turbine 24*b* is provided in the exhaust pipe 32.

The EGR system 40 includes an exhaust gas recirculation pipe 41, an EGR control valve 42, and an EGR cooler 43.

The exhaust gas recirculation pipe 41 communicates with the exhaust passage upstream of the turbine 24*b*, in particular, the exhaust manifold 31 and the intake passage downstream of the throttle valve 26, in particular, the intake manifold 21. The exhaust gas recirculation pipe 41 defines an EGR gas passage.

The EGR control valve 42 is provided in the exhaust gas recirculation pipe 41. The EGR control valve 42 changes a passage cross-section area of the EGR gas passage in response to the commands output from the ECU 90, thereby, changing an amount of an exhaust gas (i.e., EGR gas) recirculated from the exhaust passage to the intake passage. The exhaust gas is a gas discharged from the engine 10 to the exhaust passage.

The EGR cooler 43 is provided in the exhaust gas recirculation pipe 41 and lowers a temperature of the EGR gas passing through the exhaust gas recirculation pipe 41 by cooling water as described later. Therefore, the EGR cooler 43 is a heat exchanger for exchanging heat between the cooling water and the EGR gas, in particular, the heat exchanger for applying the heat from the EGR gas to the cooling water.

Figure 3:
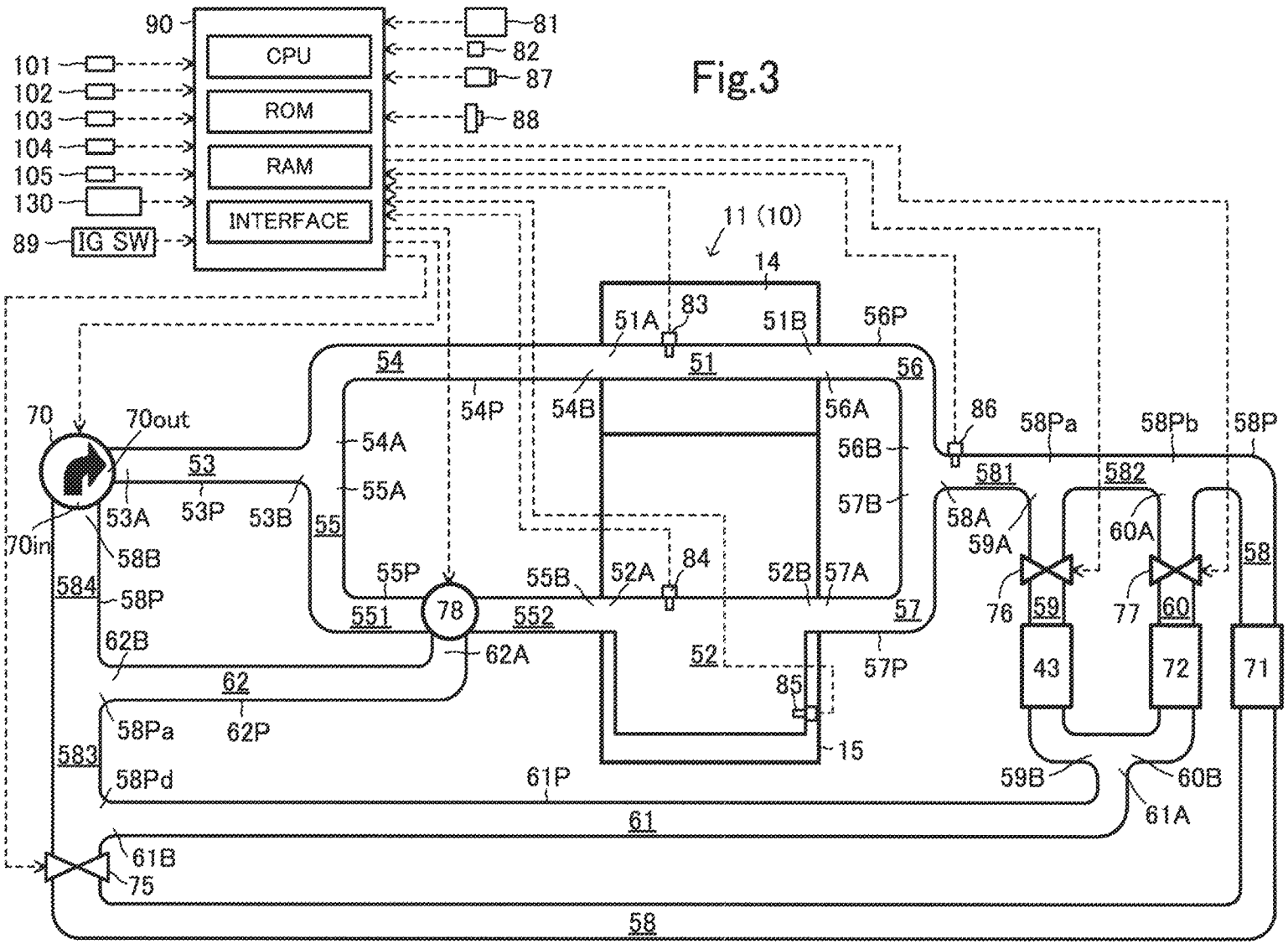
FIG. 3 is a view for showing the cooling apparatus according to the embodiment.

As shown in FIG. 3, a water passage 51 is formed in the cylinder head 14 in a known matter. The cooling water for cooling the cylinder head 14 flows through the water passage 51. Hereinafter, the water passage 51 will be referred to as "the head water passage 51". The head water passage 51 is one of elements of the embodiment apparatus. Hereinafter, the water passage is a passage through which the cooling water flows.

A water passage 52 is formed in the cylinder block 15 in a known matter. The cooling water for cooling the cylinder block 15 flows through the water passage 52. Hereinafter, the water passage 52 will be referred to as "the block water passage 52". In particular, the block water passage 52 is formed from an area near the cylinder head 14 to an area remote from the cylinder head 14 along cylinder bores defining the cylinders 12, thereby cooling the cylinder bores. The block water passage 52 is one of the elements of the embodiment apparatus.

The embodiment apparatus includes a pump 70. The pump 70 has a suctioning opening 70in and a discharging opening 70out. The cooling water is suctioned into the pump 70 through the suctioning opening 70in. The suctioned cooling water is discharged from the pump through the discharging opening 70out. Hereinafter, the suctioning opening 70in will be referred to as "the pump suctioning opening 70in", and the discharging opening 70out will be referred to as "the pump discharging opening 70out".

A cooling water pipe 53P defines a water passage 53. The cooling water pipe 53P is connected to the pump discharging opening 70out at a first end 53A thereof. Therefore, the cooling water discharged through the pump discharging opening 70out flows into the water passage 53.

A cooling water pipe 54P defines a water passage 54. A cooling water pipe 55P defines a water passage 55. A first end 54A of the cooling water pipe 54P and a first end 55A of the cooling water pipe 55P are connected to a second end 53B of the cooling water pipe 53P.

A second end 54B of the cooling water pipe 54P is connected to the cylinder head 14 such that the water passage 54 communicates with a first end 51A of the head water passage 51. A second end 55B of the cooling water pipe 55P is connected to the cylinder block 15 such that the water passage 55 communicates with a first end 52A of the block water passage 52.

A cooling water pipe 56P defines a water passage 56. A first end 56A of the cooling water pipe 56P is connected to the cylinder head 14 such that the water passage 56 communicates with a second end 51B of the head water passage 51.

A cooling water pipe 57P defines a water passage 57. A first end 57A of the cooling water pipe 57P is connected to the cylinder block 15 such that the water passage 57 communicates with a second end 52B of the block water passage 52.

A cooling water pipe 58P defines a water passage 58. A first end 58A of the cooling water pipe 58P is connected to a second end 56B of the cooling water pipe 56P and a second end 57B of the cooling water pipe 57P. A second end 58B of the cooling water pipe 58P is connected to the pump suctioning opening 70in. The cooling water pipe 58P is provided such that the cooling water pipe 58P passes through a radiator 71. Hereinafter, the water passage 58 will be referred to as "the radiator water passage 58".

The radiator 71 exchanges the heat between the cooling water passing through the radiator 71 and an outside air, thereby lowering the temperature of the cooling water. A decreasing amount of a temperature of the cooling water flowing through the radiator 71, is larger than the decreasing amount of the temperature of the cooling water flowing through the EGR cooler 43 and/or a heater core 72.

A shut-off valve 75 is provided in the cooling water pipe 58P between the radiator 71 and the pump 70. When the shut-off valve 75 is set to an opening position, the shut-off valve 75 permits the cooling water to flow through the radiator water passage 58. On the other hand, when the shut-off valve 75 is set to a closed position, the shut-off valve 75 shuts off a flow of the cooling water through the radiator water passage 58.

A cooling water pipe 59P defines a water passage 59. A first end 59A of the cooling water pipe 59P is connected to a first portion 58Pa of the cooling water pipe 58P between the first end 58A of the cooling water pipe 58P and the radiator 71. The cooling water pipe 59P is provided such that the cooling water pipe 59P passes through the EGR cooler 43. Hereinafter, the water passage 59 will be referred to as "the EGR cooler water passage 59".

A shut-off valve 76 is provided in the cooling water pipe 59P between the EGR cooler 43 and the first end 59A of the cooling water pipe 59P. When the shut-off valve 76 is set to an opening position, the shut-off valve 76 permits the cooling water to flow through the EGR cooler water passage 59. On the other hand, when the shut-off valve 76 is set to a closed position, the shut-off valve 76 shuts off a flow of the cooling water through the EGR cooler water passage 59.

A cooling water pipe 60P defines a water passage 60. A first end 60A of the cooling water pipe 60P is connected to a second portion 58Pb of the cooling water pipe 58P between the first portion 58Pa of the cooling water pipe 58P and the radiator 71. The cooling water pipe 60P is provided such that the cooling water pipe 60P passes through the heater core 72. Hereinafter, the water passage 60 will be referred to as "the heater core water passage 60".

Hereinafter, a portion 581 of the radiator water passage 58 between the first end 58A of the cooling water pipe 58P, and the first portion 58Pa of the cooling water pipe 58P will be referred to as "the first portion 581 of the radiator water passage 58". Further, a portion 582 of the radiator water passage 58 between the first portion 58Pa of the cooling water pipe 58P and the second portion 58Pb of the cooling water pipe 58P will be referred to as "the second portion 582 of the radiator water passage 58".

When the temperature of the cooling water passing through the heater core 72 is higher than a temperature of the heater core 72, the heater core 72 is warmed by the cooling water, thereby storing the heat. Therefore, the heater core 72 is a heat exchanger for exchanging the heat with the cooling water, in particular, a heat exchanger for removing the heat from the cooling water. The heat stored in the heater core 72 is used for warming an interior of the vehicle 100 having the engine 10.

A shut-off valve 77 is provided in the cooling water pipe 60P between the heater core 72 and the first end 60A of the cooling water pipe 60P. When the shut-off valve 77 is set to an opening position, the shut-off valve 77 permits the cooling water to flow through the heater core water passage 60. On the other hand, when the shut-off valve 77 is set to a closed position, the shut-off valve 77 shuts off a flow of the cooling water through the heater core water passage 60.

A cooling water pipe 61P defines a water passage 61. A first end 61A of the cooling water pipe 61P is connected to a second end 59B of the cooling water pipe 59P and a second end 60B of the cooling water pipe 60P. A second end 61B of the cooling water pipe 61P is connected to a third portion 58Pc of the cooling water pipe 58P between the shut-off valve 75 and the pump suctioning opening 70in.

A cooling water pipe 62P defines a water passage 62. A first end 62A of the cooling water pipe 62P is connected to a switching valve 78 provided in the cooling water pipe 55P. A second end 62B of the cooling water pipe 62P is connected to a fourth portion 58Pd of the cooling water pipe 58P between the third portion 58Pc of the cooling water pipe 58P and the pump suctioning opening 70in.

Hereinafter, a portion 551 of the water passage 55 between the switching valve 78 and the first end 55A of the cooling water pipe 55P will be referred to as "the first portion 551 of the water passage 55". Further, a portion 552 of the water passage 55 between the switching valve 78 and the second end 55B of the cooling water pipe 55P will be referred to as "the second portion 552 of the water passage 55". Further, a portion 583 of the radiator water passage 58 between the third portion 58Pc of the cooling water pipe 58P and the fourth portion 58Pd of the cooling water pipe 58P will be referred to as "the third portion 583 of the water passage 58". Further, a portion 584 of the radiator water passage 58 between the fourth portion 58Pd of the cooling water pipe 58P and the pump suctioning opening 70in will be referred to as "the fourth portion 584 of the water passage 58".

When the switching valve 78 is set to a first position, the switching valve 78 permits the cooling water to flow between the first portion 551 of the water passage 55 and the second portion 552 of the water passage 55 and shuts off a flow of the cooling water between the first portion 551 of the water passage 55 and the water passage 62, and a flow of the cooling water between the second portion 552 of the water passage 55 and the water passage 62. Hereinafter, the first position of the switching valve 78 will be referred to as "the normal flow position".

When the switching valve 78 is set to a second position, the switching valve 78 permits the cooling water to flow between the second portion 552 of the water passage 55 and the water passage 62, and shuts off the flow of the cooling water between the first portion 551 of the water passage 55 and the water passage 62, and a flow of the cooling water between the first and second portions 551 and 552 of the water passage 55. Hereinafter, the second position of the switching valve 78 will be referred to as "the opposite flow position".

When the switching valve 78 is set to a third position, the switching valve 78 shuts off the flow of the cooling water between the first and second portions 551 and 552 of the water passage 55, the flow of the cooling water between the first portion 551 of the water passage 55 and the water passage 62, and the flow of the cooling water between the second portion 552 of the water passage 55 and the water passage 62. Hereinafter, the third position of the switching valve 78 will be referred to as "the shut-off position".

The water passage 56, the water passage 57, the second portion 552 of the water passage 55, the water passage 62, the fourth portion 584 of the radiator water passage 58, the water passage 53, and the water passage 54 define a first circulation water passage for supplying the cooling water from the head water passage 51 to the block water passage 52 without causing the cooling water to flow through the EGR cooler 43 and the heater core 72 and supplying the cooling water from the block water passage 52 to the head water passage 51.

The water passage 56, the first and second portions 581 and 582 of the radiator water passage 58, the water passages 59 to 61, the third and fourth portions 583 and 584 of the radiator water passage 58, and the water passages 53 and 54 define a second circulation water passage for causing the cooling water flowing out from the head water passage 51 to pass through the EGR cooler 43 and the heater core 72 and then, supplying the cooling water to the head water passage 51 without supplying the cooling water to the block water passage 52.

The water passages 56 and 57, the first and second portions 581 and 582 of the radiator water passage 58, the water passages 59 to 61, the third and fourth portions 583 and 584 of the radiator water passage 58, and the water passages 53 to 55 define a third circulation water passage for causing the cooling water flowing out from the head and block water passages 51 and 52 to pass through the EGR cooler 43 and the heater core 72 and then, supplying the cooling water to the head and block water passages 51 and 52.

The water passages 56 and 57, the radiator water passage 58, and the water passages 53 to 55 define a fourth circulation water passage for causing the cooling water flowing out from the head and block water passages 51 and 52 to pass through the radiator 71 and then, supplying the cooling water to the head and block water passages 51 and 52.

The head water passage 51 is a first water passage formed in the cylinder head 14. The block water passage 52 is a second water passage formed in the cylinder block 15. The water passages 53 and 54 define a third water passage for connecting the first end 51A corresponding to one end of the head water passage 51 (i.e., the first water passage) to the pump discharging opening 70out.

The water passages 53, 55 and 62, the fourth portion 584 of the radiator water passage 58, and the switching valve 78 configure a connection switching mechanism for switching a pump connection between a normal connection of the first end 52A of the block water passage 52 to the pump discharging opening 70out and an opposite connection of the first end 52A of the block water passage 52 to the pump suctioning opening 70in. The pump connection is a connection of the first end 52A corresponding to one end of the block water passage 52, i.e., the second water passage to the pump 70.

The water passages 56 and 57 define a fourth water passage for connecting the second end 51B corresponding to the other end of the head water passage 51, i.e., the first water passage to the second end 52B corresponding to the other end of the block water passage 52, i.e., the second water passage.

The radiator water passage 58 is a fifth water passage for connecting the water passages 56 and 57 (i.e., the fourth water passage) to the pump suctioning opening 70in. The shut-off valve 75 is a shut-off valve for shutting off and opening the radiator water passage 58 (i.e., the fifth water passage).

The water passages 53 and 55 define a normal connection water passage for connecting the first end 52A of the block water passage 52 (i.e., the second water passage) to the pump discharging opening 70out. The second portion 552 of the water passage 55, the water passage 62, and the fourth portion 584 of the radiator water passage 58 define an opposite connection water passage for connecting the first end 52A of the block water passage 52 (i.e., the second water passage) to the pump suctioning opening 70in.

The switching valve 78 is a switching part selectively set to any of the normal flow position for connecting the first end 52A of the block water passage 52 (i.e., the second water passage) to the pump discharging opening 70out via the water passages 53 and 55 (i.e., the normal connection water passage) and the opposite flow position for connecting the first end 52A of the block water passage 52 (i.e., the second water passage) to the pump suctioning opening 70in via the second portion 552 of the water passage 55, the water passage 62, and the fourth portion 584 of the radiator water passage 58 (i.e., the opposite connection water passage).

In other words, the switching valve 78 is a switching part for switching the water passage between the normal and opposite connection water passages. As described above, the normal connection water passage is defined by the water passages 53 and 55 for connecting the first end 52A of the block water passage 52 (i.e., the second water passage) to the pump discharging opening 70out. The opposite connection water passage is defined by the second portion 552 of the water passage 55, the water passage 62, and the fourth portion 584 of the radiator water passage 58 for connecting the first end 52A of the block water passage 52 (i.e., the second water passage) to the pump suctioning opening 70in.

The embodiment apparatus has the ECU 90. The ECU 90 is an electronic control circuit. The ECU 90 includes a micro-computer as a main component part. The micro-computer includes a CPU, a ROM, a RAM, an interface and the like. The CPU executes instructions or routines stored in a memory such as the ROM, thereby realizing various functions described later.

As shown in FIGS. 2 and 3, the ECU 90 is connected to an air-flow meter 81, a crank angle sensor 82, water temperature sensors 83 to 86, an outside air temperature sensor 87, a heater switch 88, and an ignition switch 89.

The air-flow meter 81 is provided in the intake pipe 22 upstream of the compressor 24*a*. The air-flow meter 81 measures a mass flow rate Ga of an air passing therethrough and sends a signal for expressing the mass flow rate Ga to the ECU 90. Hereinafter, the mass flow rate Ga will be referred to as "the intake air amount Ga". The ECU 90 acquires the intake air amount Ga on the basis of the signal sent from the air-flow meter 81. In addition, the ECU 90 acquires a total amount ΣGa on the basis of the intake air amount Ga. The total amount ΣGa corresponds to an amount of the air suctioned into the cylinders 12*a* to 12*d* after the ignition switch 89 is set to an ON position and then, an operation of the engine 10 starts. Hereinafter, the total amount ΣGa will be referred to as "the after-engine-start integrated air amount ΣGa".

The crank angle sensor 82 is provided on the engine body 11 adjacent to a crank shaft (not shown) of the engine 10. The crank angle sensor 82 outputs a pulse signal each time the crank shaft rotates by a constant angle (in this embodiment, 10°). The ECU 90 acquires a crank angle (i.e., an absolute crank angle) of the engine 10 on the basis of the pulse signals and signals sent from a cam position sensor (not shown). The absolute crank angle at a compression top dead center of predetermined one of the cylinders 12, is set to zero. In addition, the ECU 90 acquires an engine speed NE on the basis of the pulse signals sent from the crank angle sensor 82.

The water temperature sensor 83 is provided in the cylinder head 14 such that the water temperature sensor 83 detects a temperature TWhd of the cooling water in the head water passage 51. The water temperature sensor 83 detects the temperature TWhd and sends a signal expressing the temperature TWhd to the ECU 90. Hereinafter, the temperature TWhd will be referred to as "the head water temperature TWhd". The ECU 90 acquires the head water temperature TWhd on the basis of the signal sent from the water temperature sensor 83.

The water temperature sensor 84 is provided in the cylinder block 15 such that the water temperature sensor 84 detects a temperature TWbr_up of the cooling water in the block water passage 52 near the cylinder head 14. The water temperature sensor 84 detects the temperature TWbr_up and sends a signal expressing the temperature TWbr_up to the ECU 90. Hereinafter, the temperature TWbr_up will be referred to as "the upper block water temperature TWbr_up". The ECU 90 acquires the upper block water temperature TWbr_up on the basis of the signal sent from the water temperature sensor 84.

The water temperature sensor 85 is provided in the cylinder block 15 such that the water temperature sensor 85 detects a temperature TWbr_low of the cooling water in the block water passage 52 remote from the cylinder head 14. The water temperature sensor 85 detects the temperature TWbr_low and sends a signal expressing the temperature TWbr_low to the ECU 90. Hereinafter, the temperature TWbr_low will be referred to as "the lower block water temperature TWbr_low". The ECU 90 acquires the lower block water temperature TWbr_low on the basis of the signal sent from the water temperature sensor 85. The ECU 90 acquires a difference ΔTWbr of the lower block water temperature TWbr_low with respect to the upper block water temperature TWbr_up (ΔTWbr=TWbr_up−TWbr_low). Hereinafter, the difference ΔTWbr will be referred to as "the block water temperature difference ΔTWbr".

The water temperature sensor 86 is provided in a portion of the cooling water pipe 58P defining the first portion 581 of the radiator water passage 58. The water temperature sensor 86 detects a temperature TWeng of the cooling water in the first portion 581 of the radiator water passage 58 and sends a signal expressing the temperature TWeng to the ECU 90. Hereinafter, the temperature TWeng will be referred to as "the engine water temperature TWeng". The ECU 90 acquires the engine water temperature TWeng on the basis of the signal sent from the water temperature sensor 86.

The outside air temperature sensor 87 detects a temperature Ta of the outside air and sends a signal expressing the temperature Ta. Hereinafter, the temperature Ta will be referred to as "the outside air temperature Ta". The ECU 90 acquires the outside air temperature Ta on the basis of the signal sent from the outside air temperature sensor 87.

The heater switch 88 is operated by a driver of the vehicle 100 having the engine 10. When the heater switch 88 is set to an ON position by the driver, the ECU 90 causes the heater core 72 to discharge the heat stored to the interior of the vehicle 100. On the other hand, when the heater switch 88 is set to an OFF position by the driver, the ECU 90 causes the heater core 72 to stop discharging the heat to the interior of the vehicle 100.

The ignition switch 89 is operated by the driver of the vehicle 100. When the driver sets the ignition switch 89 to an ON position, the operation of the engine 10 is permitted to start. On the other hand, when the driver sets the ignition switch 89 to an OFF position, the operation of the engine 10 is stopped. Hereinafter, an operation of setting the ignition switch 89 to the ON position by the driver will be referred to as "the ignition ON operation". Further, an operation of setting the ignition switch 89 to the OFF position by the driver will be referred to as "the ignition OFF operation". Further, the operation of the engine 10 will be referred to as "the engine operation".

Further, the ECU 90 is connected to the throttle valve actuator 27, the EGR control valve 42, the pump 70, the shut-off valves 75 to 77, and the switching valve 78.

The ECU 90 sets a target value of the opening degree of the throttle valve 26, depending on an engine operation state and controls the activation of the throttle valve actuator 27 such that the opening degree of the throttle valve 26 corresponds to the target value. The engine operation state is defined by an engine load KL and the engine speed NE.

The ECU 90 sets a target value EGRtgt of the opening degree of the EGR control valve 42, depending on the engine operation state and controls the activation of the EGR control valve 42 such that the opening degree of the EGR control valve 42 corresponds to the target value EGRtgt. Hereinafter, the target value EGRtgt will be referred to as "the target EGR control valve opening degree EGRtgt".

Figure 4:
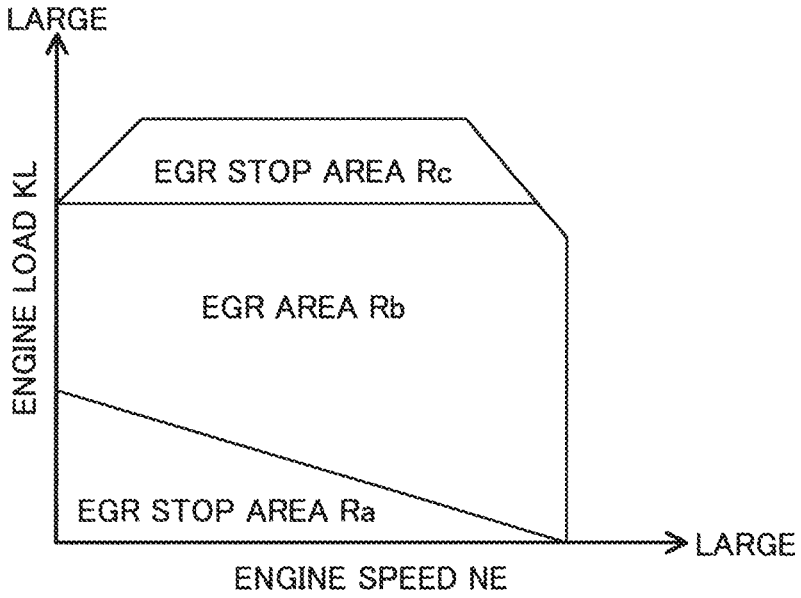
FIG. 4 is a view for showing a map used for controlling an EGR control valve shown in FIG. 2.

The ECU 90 stores a map shown in FIG. 4. When the engine operation state is in an EGR stop area Ra or Rc shown in FIG. 4, the ECU 90 sets the target EGR control valve opening degree EGRtgt to zero. In this case, no EGR gas is supplied to the cylinders 12.

On the other hand, when the engine operation state is in an EGR area Rb shown in FIG. 4, the ECU 90 sets the target EGR control valve opening degree EGRtgt to a value larger than zero, depending on the engine operation state. In this case, the EGR gas is supplied to the cylinders 12.

As described later, the ECU 90 controls activations of the pump 70, the shut-off valves 75 to 77, and the switching valve 78, depending on a temperature Teng of the engine 10. Hereinafter, the temperature Teng will be referred to as "the engine temperature Teng".

The ECU 90 is connected to an acceleration pedal operation amount sensor 101, a vehicle speed sensor 102, a battery sensor 103, a first rotation angle sensor 104, and a second rotation angle sensor 105.

The acceleration pedal operation amount sensor 101 detects an operation amount AP of an acceleration pedal (not shown) and sends a signal expressing the operation amount AP to the ECU 90. Hereinafter, the operation amount AP will be referred to as "the acceleration pedal operation amount AP". The ECU 90 acquires the acceleration pedal operation amount AP on the basis of the signal sent from the acceleration pedal operation amount sensor 101.

The vehicle speed sensor 102 detects a moving speed V of the vehicle 100 and sends a signal expressing the moving speed V. Hereinafter, the moving speed V will be referred to as "the vehicle speed V". The ECU 90 acquires the vehicle speed V on the basis of the signal sent from the vehicle speed sensor 102.

The battery sensor 103 includes a current sensor, a voltage sensor, and a temperature sensor. The current sensor of the battery sensor 103 detects a current flowing into the battery 140 or flowing out from the battery 140 and sends a signal expressing the current to the ECU 90. The voltage sensor of the battery sensor 103 detects a voltage of the battery 140 and sends a signal expressing the voltage to the ECU 90. The temperature sensor of the battery sensor 103 detects a temperature of the battery 140 and sends a signal expressing the temperature to the ECU 90.

The ECU 90 acquires an electric power amount SOC stored in the battery 140 by a known technique on the basis of the signals sent from the current, voltage, and temperature sensors. Hereinafter, the electric power amount SOC will be referred to as "the battery charge amount SOC".

The first rotation angle sensor 104 detects a rotation angle of the first motor generator 110 and sends a signal expressing the detected rotation angle to the ECU 90. The ECU 90 acquires a rotation speed NM1 of the first motor generator 110 on the basis of the signal sent from the first rotation angle sensor 104. Hereinafter, the rotation speed NM1 will be referred to as "the first MG rotation speed NM1".

The second rotation angle sensor 105 detects a rotation angle of the second motor generator 120 and sends a signal expressing the detected rotation angle to the ECU 90. The ECU 90 acquires a rotation speed NM2 of the second motor generator 120 on the basis of the signal sent from the second rotation angle sensor 105. Hereinafter, the rotation speed NM2 will be referred to as "the second MG rotation speed NM1".

The ECU 90 is connected to the inverter 130. The ECU 90 controls an activation of the inverter 130, thereby controlling the activation of the first and second motor generators 110 and 120.

<Summary of Activation of Embodiment Apparatus>

Next, a summary of an activation of the embodiment apparatus will be described. The embodiment apparatus executes any of activation controls A to O described later, depending on a warmed state of the engine 10, presence or absence of an EGR cooler water supply request described later, and presence or absence of a heater core water supply request described later. Hereinafter, the warmed state of the engine 10 will be simply referred to as the warmed state".

A determination of the warmed state will be described. The embodiment apparatus determines which one of a cool state, a first semi-warmed state, a second semi-warmed state, and a completely-warmed state, the warmed state is. Hereinafter, the cool state, the first semi-warmed state, the second semi-warmed state, and the completely-warmed state will be collectively referred to as "the cool state and the like".

The cool state is a state that the engine temperature Teng is estimated to be lower than a predetermined threshold temperature Teng1. Hereinafter, the predetermined threshold temperature Teng1 will be referred to as "the first engine temperature Teng1".

The first semi-warmed state is a state that the engine temperature Teng is estimated to be equal to or higher than the first engine temperature Teng1 and lower than a predetermined threshold temperature Teng2. Hereinafter, the predetermined threshold temperature Teng2 will be referred to as "the second engine temperature Teng2". The second engine temperature Teng2 is set to a temperature higher than the first engine temperature Teng1.

The second semi-warmed state is a state that the engine temperature Teng is estimated to be equal to or larger than the second engine temperature Teng2 and lower than a predetermined threshold temperature Teng3. Hereinafter, the predetermined threshold temperature Teng3 will be referred to as "the third engine temperature Teng3". The third engine temperature Teng3 is set to a temperature higher than the second engine temperature Teng2.

The completely-warmed state is a state that the engine temperature Teng is estimated to be equal to or larger than the third engine temperature Teng3.

When an engine cycle number Cig is equal to or smaller than a predetermined after-engine-start cycle number Cig_th, the embodiment apparatus determines which one of the cool state and the like, the warmed state is on the basis of the engine water temperature TWeng correlating with the engine temperature Teng as described below. The after-engine-start cycle number Cig is total number of engine cycles after the ignition switch 89 is set to the ON position. In this embodiment, the predetermined after-engine-start cycle number Cig_th is two to three cycles which corresponds to eight to twelve combustion strokes of the engine 10.

<Cool Condition>

The embodiment apparatus determines that the warmed state is the cool state when a cool condition Cac is satisfied. The cool condition Cac is a condition that the engine water temperature TWeng is lower than a predetermined threshold water temperature TWeng1. Hereinafter, the predetermined threshold water temperature TWeng1 will be referred to as "the first engine water temperature TWeng1".

The temperature of the cooling water is relatively low when the cool condition Cac is satisfied, compared with when a second semi-warmed condition Ca2 or a completely-warmed condition Caw described later is satisfied. Therefore, the cool condition Cac is one of low temperature conditions that the temperature of the cooling water is relatively low.

<First Semi-Warmed Condition>

The embodiment apparatus determines that the warmed state is the first semi-warmed state when a first semi-warmed condition Ca1 is satisfied. The first semi-warmed condition Ca1 is a condition that the engine water temperature TWeng is equal to or higher than the first engine water temperature TWeng1 and lower than a predetermined threshold water temperature TWeng2. Hereinafter, the predetermined threshold water temperature TWeng2 will be referred to as "the second engine water temperature TWeng2". The second engine water temperature TWeng2 is set to a temperature higher than the first engine water temperature TWeng1.

The temperature of the cooling water is relatively low when the first semi-warmed condition Ca1 is satisfied, compared with when the second semi-warmed condition Ca2 or the completely-warmed condition Caw described later is satisfied. Therefore, the first semi-warmed condition Ca1 is one of the low temperature conditions that the temperature of the cooling water is relatively low.

<Second Semi-Warmed Condition>

The embodiment apparatus determines that the warmed state is the second semi-warmed state when the second semi-warmed condition Ca2 is satisfied. The second semi-warmed condition Ca2 is a condition that the engine water temperature TWeng is equal to or higher than the second engine water temperature TWeng2 and lower than a predetermined threshold water temperature TWeng3. Hereinafter, the predetermined threshold water temperature TWeng3 will be referred to as "the third engine water temperature TWeng3". The third engine water temperature TWeng3 is set to a temperature higher than the second engine water temperature TWeng2.

The temperature of the cooling water is relatively high when the second semi-warmed condition Ca2 is satisfied, compared with when the cool condition Cac or the first semi-warmed condition Ca1 is satisfied. Therefore, the second semi-warmed condition Ca2 is one of high temperature conditions that the temperature of the cooling water is relatively high.

<Complete Warmed Condition>

The embodiment apparatus determines that the warmed state is the completely-warmed state when the completely-warmed condition Caw is satisfied. The completely-warmed condition Caw is a condition that the engine water temperature TWeng is equal to or higher than the third engine water temperature TWeng3.

The temperature of the cooling water is relatively high when the completely-warmed condition Caw is satisfied, compared with when the cool condition Cac or the first semi-warmed condition Ca1 is satisfied. Therefore, the completely-warmed condition Caw is one of the high temperature conditions that the temperature of the cooling water is relatively high.

On the other hand, when the after-engine-start cycle number Cig is larger than the predetermined after-engine-start cycle number Cig_th, the embodiment apparatus determines which one of the cool state and the like, the warmed state is on the basis of at least four of the upper block water temperature TWbr_up, the head water temperature TWhd, the block water temperature difference ΔTWbr, the after-engine-start integrated air amount ΣGa, and the engine water temperature TWeng which correlate with the engine temperature Teng.

<Cool Condition>

The embodiment apparatus determines that the warmed state is the cool state when a cool condition Cbc is satisfied. The cool condition Cbc is satisfied when at least one of conditions Cbc1 to Cbc4 described below is satisfied.

The condition Cbc1 is a condition that the upper block water temperature TWbr_up is equal to or lower than a predetermined threshold water temperature TWbr_up1. Hereinafter, the predetermined threshold water temperature TWbr_up1 will be referred to as "the first upper block water temperature TWbr_up1". The upper block water temperature TWbr_up is a parameter correlating with the engine temperature Teng. Therefore, the embodiment apparatus can determine which one of the cool state and the like, the warmed state is on the basis of the upper block water temperature TWbr_up with the appropriately-set first upper block water temperature TWbr_up1 and appropriately-set water temperature thresholds described later.

The condition Cbc2 is a condition that the head water temperature TWhd is equal to or lower than a predetermined threshold water temperature TWhd1. Hereinafter, the predetermined threshold water temperature TWhd1 will be referred to as "the first head water temperature TWhd1". The head water temperature TWhd is the parameter correlating with the engine temperature Teng. Therefore, the embodiment apparatus can determine which one of the cool state and the like, the warmed state is on the basis of the head water temperature TWhd with the appropriately-set first head water temperature TWhd1 and appropriately-set water temperature thresholds described later.

The condition Cbc3 is a condition that the after-engine-start integrated air amount ΣGa is equal to or smaller than a predetermined threshold air amount ΣGa1. Hereinafter, the predetermined threshold air amount ΣGa1 will be referred to as "the first air amount ΣGa1". As described above, the after-engine-start integrated air amount ΣGa is the amount of the air suctioned into the cylinders 12*a* to 12*d* after the ignition switch 89 is set to the ON position and then, the engine operation starts. When a total amount of the air suctioned into the cylinders 12*a* to 12*d* increases, a total amount of the fuel supplied to the cylinders 12*a* to 12*d* from the fuel injectors 13 increases. As a result, a total amount of heat generated in the cylinders 12*a* to 12*d* increases. Thus, before the after-engine-start integrated air amount ΣGa reaches a certain amount, the engine temperature Teng increases as the after-engine-start integrated air amount Ga increases. Therefore, the after-engine-start integrated air amount Ga is a parameter correlating with the engine temperature Teng and the temperature of the cooling water. Therefore, the embodiment apparatus can determine which one of the cool state and the like, the warmed state is on the basis of the after-engine-start integrated air amount ΣGa with the appropriately-set first air amount ΣGa1 and appropriately-set air amount thresholds described later.

The condition Cbc4 is a condition that the engine water temperature TWeng is equal to or lower than a predetermined threshold water temperature TWeng4. Hereinafter, the predetermined threshold water temperature TWeng4 will be referred to as "the fourth engine water temperature TWeng4". The engine water temperature TWeng is the parameter correlating with the engine temperature Teng. Therefore, the embodiment apparatus can determine which one of the cool state and the like, the warmed state is on the basis of the engine water temperature TWeng with the appropriately-set fourth engine water temperature TWeng4 and appropriately-set water temperature thresholds described later.

The temperature of the cooling water is relatively low when the cool condition Cbc is satisfied, compared with when the second semi-warmed condition Cb2 or a completely-warmed condition Cbw is satisfied. Therefore, the cool condition Cbc is one of the low temperature conditions that the temperature of the cooling water is relatively low.

The embodiment apparatus may be configured to determine that the cool condition Cbc is satisfied when at least two or three or all of the conditions Cbc1 to Cbc4 are satisfied.

<First Semi-Warmed Condition>

The embodiment apparatus determines that the warmed state is the first semi-warmed state when a first semi-warmed condition Cb1 is satisfied. The first semi-warmed condition Cb1 is satisfied when at least one of conditions Cb11 to Cb15 described below is satisfied.

The condition Cb11 is a condition that the upper block water temperature TWbr_up is higher than the first upper block water temperature TWbr_up1 and equal to or lower than a predetermined threshold water temperature TWbr_up2. Hereinafter, the predetermined threshold water temperature TWbr_up2 will be referred to as "the second upper block water temperature TWbr_up2". The second upper block water temperature TWbr_up2 is set to a temperature higher than the first upper block water temperature TWbr_up1.

The condition Cb12 is a condition that the head water temperature TWhd is higher than the first head water temperature TWhd1 and equal to or lower than a predetermined threshold water temperature TWhd2. Hereinafter, the predetermined threshold water temperature TWhd2 will be referred to as "the second head water temperature TWhd2". The second head water temperature TWhd2 is set to a temperature higher than the first head water temperature TWhd1.

The condition Cb13 is a condition that the block water temperature difference ΔTWbr is larger than a predetermined threshold ΔTWbrth. As described above, the block water temperature difference ΔTWbr is the difference between the upper and lower block water temperatures TWbr_up and TWbr_low (ΔTWbr=TWbr_up−TWbr_low). In the cool state immediately after the engine 10 starts by the ignition switch ON operation, the block water temperature difference ΔTWbr is not much large. In the first semi-warmed state, the block water temperature difference ΔTWbr increases temporarily while the engine temperature Teng increases. Then, in the second semi-warned state, the block water temperature difference ΔTWbr decreases. Thus, the block water temperature difference ΔTWbr is a parameter correlating with the engine temperature Teng and the temperature of the cooling water, in particular, when the warmed state is the first semi-warmed state. Therefore, the embodiment apparatus can determine whether the warmed state is the first semi-warmed state on the basis of the block water temperature difference ΔTWbr with the appropriately-set predetermined threshold ΔTWbrth.

The condition Cb14 is a condition that the after-engine-start integrated air amount ΣGa is larger than the first air amount ΣGa1 and equal to or smaller than a predetermined threshold air amount ΣGa2. Hereinafter, the predetermined threshold air amount ΣGa2 will be referred to as "the second air amount ΣGa2". The second air amount ΣGa2 is set to a value larger than the first air amount ΣGa1.

The condition Cb15 is a condition that the engine water temperature TWeng is higher than the engine water temperature TWeng 4 and equal to or lower than a predetermined threshold water temperature TWeng5. Hereinafter, the predetermined threshold water temperature TWeng5 will be referred to as "the fifth engine water temperature TWeng5". The fifth engine water temperature TWeng5 is set to a temperature higher than the fourth engine water temperature TWeng4.

The temperature of the cooling water is relatively low when the first semi-warmed condition Cb1 is satisfied, compared with when the second semi-warmed condition Cb2 or the completely-warmed condition Cbw is satisfied. Therefore, the first semi-warmed condition Cb1 is one of the low temperature conditions that the temperature of the cooling water is relatively low.

The embodiment apparatus may be configured to determine that the first semi-warmed condition Cb1 is satisfied when at least two or three or four or all of the conditions Cb11 to Cb15 are satisfied.

<Second Semi-Warmed Condition>

The embodiment apparatus determines that the warmed state is the second semi-warmed state when a second semi-warmed condition Cb2 is satisfied. The second semi-warmed condition Cb2 is satisfied when at least one of conditions Cb21 to Cb24 described below is satisfied.

The condition Cb21 is a condition that the upper block water temperature TWbr_up is higher than the second upper block water temperature TWbr_up2 and equal to or lower than a predetermined threshold water temperature TWbr_up3. Hereinafter, the predetermined threshold water temperature TWbr_up3 will be referred to as "the third upper block water temperature TWbr_up3". The third upper block water temperature TWbr_up3 is set to a temperature higher than the second upper block water temperature TWbr_up2.

The condition Cb22 is a condition that the head water temperature TWhd is higher than the second head water temperature TWhd2 and equal to or lower than a predetermined threshold water temperature TWhd3. Hereinafter, the predetermined threshold water temperature TWhd3 will be referred to as "the third head water temperature TWhd3". The third head water temperature TWhd3 is set to a temperature higher than the second head water temperature TWhd2.

The condition Cb23 is a condition that the after-engine-start integrated air amount ΣGa is larger than the second air amount ΣGa2 and equal to or smaller than a predetermined threshold air amount ΣGa3. Hereinafter, the predetermined threshold air amount ΣGa3 will be referred to as "the third air amount ΣGa3". The third air amount ΣGa3 is set to a value larger than the second air amount ΣGa2.

The condition Cb24 is a condition that the engine water temperature TWeng is higher than the engine water temperature TWeng 5 and equal to or lower than a predetermined threshold water temperature TWeng6. Hereinafter, the predetermined threshold water temperature TWeng6 will be referred to as "the sixth engine water temperature TWeng6". The sixth engine water temperature TWeng6 is set to a temperature higher than the fifth engine water temperature TWeng5.

The temperature of the cooling water is relatively high when the second semi-warmed condition Cb2 is satisfied, compared with when the cool condition Cbc or the first semi-warmed condition Cb1 is satisfied. Therefore, the second semi-warmed condition Cb2 is one of the high temperature conditions that the temperature of the cooling water is relatively high.

The embodiment apparatus may be configured to determine that the second semi-warmed condition Cb2 is satisfied when at least two or three or all of the conditions Cb21 to Cb24 are satisfied.

<Completely-Warmed Condition>

The embodiment apparatus determines that the warmed state is the completely-warmed state when a completely-warmed condition Cbw is satisfied. The completely-warmed condition Cbw is satisfied when at least one of conditions Cbw1 to Cbw4 described below is satisfied.

The condition Cbw1 is a condition that the upper block water temperature TWbr_up is higher than the third upper block water temperature TWbr_up3.

The condition Cbw2 is a condition that the head water temperature TWhd is higher than the third upper block water temperature TWhd3.

The condition Cbw3 is a condition that the after-engine-start integrated air amount ΣGa is larger than the third air amount ΣGa3.

The condition Cbw4 is a condition that the engine water temperature TWeng is higher than the engine water temperature TWeng 6.

The temperature of the cooling water is relatively high when the completely-warmed condition Cbw is satisfied, compared with when the cool condition Cbc or the first semi-warmed condition Cb1 is satisfied. Therefore, the completely-warmed condition Cbw is one of the high temperature conditions that the temperature of the cooling water is relatively high.

The embodiment apparatus may be configured to determine that the completely-warmed condition Cbw is satisfied when at least two or three or all of the conditions Cbw1 to Cbw4 is satisfied.

<EGR Cooler Water Supply Request>

As described above, when the engine operation state is in the EGR area Rb shown in FIG. 4, the EGR gas is supplied to the cylinders 12. When the EGR gas is supplied to the cylinders 12, it is preferred to supply the cooling water to the EGR cooler water passage 59, thereby cooling the EGR gas by the cooling water at the EGR cooler 43.

In this regard, when the EGR gas is cooled by the cooling water having a too low temperature at the EGR cooler 43, water in the EGR gas may be condensed in the exhaust gas recirculation pipe 41. The condensed water may corrode the exhaust gas recirculation pipe 41. Therefore, when the temperature of the cooling water is too low, it is preferred not to supply the cooling water to the EGR cooler water passage 59.

The embodiment apparatus determines that a supply of the cooling water to the EGR cooler water passage 59 is requested when the engine operation state is in the EGR area Rb, and the engine water temperature TWeng is higher than a predetermined threshold water temperature TWeng7 (in this embodiment, 60° C.). Hereinafter, a request of the supply of the cooling water to the EGR cooler water passage 59 will be referred to as "the EGR cooler water supply request". Further, the predetermined threshold water temperature TWeng7 will be referred to as "the seventh engine water temperature TWeng7".

Further, even though the engine water temperature TWeng is equal to or lower than the seventh engine water temperature TWeng7, the engine temperature Teng is expected to increase immediately when the engine load KL is relatively large. As a result, the engine water temperature TWeng is expected to become higher than the seventh engine water temperature TWeng7 immediately. Therefore, when the cooling water is supplied to the EGR cooler water passage 59, an amount of the condensed water generated, is small, and the exhaust gas recirculation pipe 41 is unlikely to be corroded.

Accordingly, even though the engine operation state is in the EGR area Rb, and the engine water temperature TWeng is equal to or lower than the seventh engine water temperature TWeng7, the embodiment apparatus determines that the EGR cooler water supply is requested when the engine load KL is equal to or larger than a predetermined threshold engine load KLth. Therefore, the embodiment apparatus determines that the EGR cooler water supply is not requested when the engine load KL is smaller than the threshold engine load KLth while the engine operation state is in the EGR area Rb, and the engine water temperature TWeng is equal to or lower than the seventh engine water temperature TWeng7.

On the other hand, when the engine operation state is in the EGR stop area Ra or Rc shown in FIG. 4, no EGR gas is supplied to the cylinders 12. Thus, the cooling water does not need to be supplied to the EGR cooler water passage 59. Accordingly, the embodiment apparatus determines that the EGR cooler water supply is not requested when the engine operation state is in the EGR stop area Ra or Rc shown in FIG. 4.

<Heater Core Water Supply Request>

The heater core 72 removes the heat of the cooling water flowing through the heater core water passage 60 to decrease the temperature of the cooling water. As a result, the complete warming of the engine 10 is delayed. In this regard, when the outside air temperature Ta is relatively low, the temperature of the interior of the vehicle 100 is also relatively low. Therefore, the persons including the driver in the vehicle 100 (hereinafter, will be referred to as the driver and the like) is likely to request a warming of the interior of the vehicle 100. Thus, even though the warming of the engine 10 is delayed due to the outside air temperature Ta being relatively low, it is preferred to flow the cooling water through the heater core water passage 60 to increase the amount of the heat stored in the heater core 72 in preparation for a request of the warming of the interior of the vehicle 100.

Accordingly, when the outside air temperature Ta is relatively low, the embodiment apparatus determines that a supply of the cooling water to the heater core water passage 60 is requested, independently of a set state of the heater switch 88 even though the engine temperature Teng is relatively low. A request of the supply of the cooling water to the heater core water passage 60 is the heater core water supply request described above. In this regard, when the engine temperature Teng is greatly low, the embodiment apparatus determines that the supply of the cooling water to the heater core water passage 60 is not requested. Hereinafter, the supply of the cooling water to the heater core water passage 60 will be referred to as "the heater core water supply".

In particular, the embodiment apparatus determines that the heater core water supply is requested when the engine water temperature TWeng is higher than a predetermined threshold water temperature TWeng8 while the outside air temperature Ta is equal to or lower than a predetermined threshold temperature Tath. Hereinafter, the predetermined threshold water temperature TWeng8 will be referred to as "the eighth engine water temperature TWeng8", and the predetermined threshold temperature Tath will be referred to as "the threshold temperature Tath". In this embodiment, the eighth engine water temperature TWeng8 is, for example, 20° C.

On the other hand, when the engine water temperature TWeng is equal to or lower than the eighth engine water temperature TWeng8 while the outside air temperature Ta is equal to or lower than the threshold temperature Tath, the embodiment apparatus determines that the heater core water supply is not requested.

When the outside air temperature Ta is relatively high, the temperature of the interior of the vehicle 100 is also relatively high. Thus, the driver and the like may not request the warming of the interior of the vehicle 100. Therefore, it is sufficient to flow the cooling water through the heater core water passage 60 to warm the heater core 72 only when the engine temperature Teng is relatively high, and the heater switch 88 is set to the ON position while the outside air temperature Ta is relatively high.

Accordingly, the embodiment apparatus determines that the heater core water supply is requested when the engine temperature Teng is relatively high, and the heater switch 88 is set to the ON position while the outside air temperature Ta is relatively high. On the other hand, when the engine temperature Teng is relatively low or the heater switch 88 is set to the OFF position while the outside air temperature Ta is relatively high, the embodiment apparatus determines that the heater core water supply is not requested.

In particular, the embodiment apparatus determines that the heater core water supply is requested when the heater switch 88 is set to the ON position, and the engine water temperature TWeng is higher than a predetermined threshold water temperature TWeng9 while the outside air temperature Ta is higher than the threshold temperature Tath. Hereinafter, the predetermined threshold water temperature TWeng9 will be referred to as "the ninth engine water temperature TWeng9". The ninth engine water temperature TWeng9 may be set to a value higher than the eighth engine water temperature TWeng8. In this embodiment, the ninth engine water temperature TWeng9 is, for example, 20° C.

On the other hand, when the heater switch 88 is set to the OFF position or the engine water temperature TWeng is equal to or lower than the ninth engine water temperature TWeng9 while the outside air temperature Ta is higher than the threshold temperature Tath, the embodiment apparatus determines that the heater core water supply is not requested.

Next, activation controls of the pump 70, the shut-off valves 75 to 77, and the switching valve 78 executed by the embodiment apparatus will be described. Hereinafter, the pump 70, the shut-off valves 75 to 77, and the switching valve 78 will be collectively referred to as "the pump 70 and the like". As shown in FIG. 5, the embodiment apparatus executes any of the activation controls A to O, depending on the warmed state, the presence or absence of the EGR cooler water supply request, and the presence or absence of the heater core water supply request.

<Cool State Control>

First, a cool state control corresponding to the activation control of the pump 70 and the like will be described. The cool state control is executed when the embodiment apparatus determines that the warmed state is the cool state.

<Activation Control A>

When the cooling water is supplied to the head and block water passages 51 and 52, the cylinder head 14 and the cylinder block 15 are at least cooled. Therefore, it is preferred not to supply the cooling water to the head and block water passages 51 and 52 when the warmed state is the cool state. In this case, it is requested to increase the temperature of the cylinder head 14 and the temperature of the cylinder block 15. In addition, when the EGR cooler water supply and the heater core water supply are not requested, it is not necessary to supply the cooling water to the EGR cooler water passage 59 and the heater core water passage 60. Hereinafter, the temperature of the cylinder head 14 will be referred to as "the head temperature Thd", and the temperature of the cylinder block 15 will be referred to as "the block temperature Tbr".

Accordingly, when the EGR cooler water supply and the heater core water supply are not requested while the warmed state is the cool state, the embodiment apparatus executes the activation control A as the cool state control. According to the activation control A, when the activation of the pump 70 is stopped, the embodiment apparatus continues to stop the activation of the pump 70. When the pump 70 has been activated, the embodiment apparatus stops the activation of the pump 70. In this case, the shut-off valves 75 to 77 may be set to any of the open and closed positions, and the switching valve 78 may be set to any of the normal, opposite, and shut-off positions.

According to the activation control A, no cooling water is supplied to the head and block water passages 51 and 52. Therefore, the head and block temperatures Thd and Tbr increase at a large rate, compared with when the cooling water cooled by the radiator 71 is supplied to the head and block water passages 51 and 52.

<Activation Control B>

When the EGR cooler water supply is requested, and the heater core water supply is not requested while the warmed state is the cool state, the cooling water should be supplied to the EGR cooler 43. Accordingly, the embodiment apparatus executes the activation control B as the cool state control. According to the activation control B, the embodiment apparatus activates the pump 70, sets the shut-off valves 75 and 77 to the closed positions, respectively, sets the shut-off valve 76 to the open position, and sets the switching valve 78 to the shut-off position. When the embodiment apparatus executes the activation control B, the cooling water circulates as shown by arrows in FIG. 6.

According to the activation control B, the cooling water is discharged to the water passage 53 via the pump discharging opening 70out and then, flows into the head water passage 51 via the water passage 54. The cooling water flows through the head water passage 51 and then, flows into the EGR cooler water passage 59 through the water passage 56 and the radiator water passage 58. The cooling water flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, no cooling water is supplied to the block water passage 52. On the other hand, the cooling water which is not cooled by the radiator 71 is supplied to the head water passage 51. Therefore, the head and block temperatures Thd and Tbr are increased at the large rate, compared with when the cooling water which is cooled by the radiator 71, is supplied to the head and block water passages 51 and 52.

In addition, the cooling water is supplied to the EGR cooler water passage 59. Thus, the EGR cooler water supply is accomplished in response to the EGR cooler water supply request.

<Activation Control C>

When the heater core water supply is requested, and the EGR cooler water supply is not requested while the warmed state is the cool state, the cooling water should be supplied to the heater core 72. Accordingly, when the heater core water supply is requested, and the EGR cooler water supply is not requested while the warmed state is the cool state, the embodiment apparatus executes the activation control C as the cool state control. According to the activation control C, the embodiment apparatus activates the pump 70, sets the shut-off valves 75 and 76 to the closed positions, respectively, sets the shut-off valve 77 to the open position, and sets the switching valve 78 to the shut-off position. When the embodiment apparatus executes the activation control C, the cooling water circulates as shown by arrows in FIG. 7.

According to the activation control C, the cooling water is discharged to the water passage 53 via the pump discharging opening 70out and then, flows into the head water passage 51 via the water passage 54. The cooling water flows through the head water passage 51 and then, flows into the heater core water passage 60 via the water passage 56 and the radiator water passage 58. The cooling water flows through the heater core 72 and then, sequentially flows through the water passage 61, the third portion 583 of the radiator water passage 58, and the fourth portion 584 of the radiator water passage 58. Then, the cooling water is suctioned into the pump 70 via the pump suctioning opening 70in.

Thereby, similar to the activation control B, no cooling water is supplied to the block water passage 52, and the cooling water which is not cooled by the radiator 71, is supplied to the head water passage 51. Therefore, similar to the activation control B, the head and block temperatures Thd and Tbr increase at the large rate.

In addition, the cooling water is supplied to the heater core water passage 60. Thus, the heater core water supply is accomplished in response to the heater core supply request.

<Activation Control D>

When the EGR cooler water supply and the heater core water supply are requested while the warmed state is the cool state, the embodiment apparatus executes the activation control D as the cool state control. According to the activation control D, the embodiment apparatus activates the pump 70, sets the shut-off valve 75 to the closed position, sets the shut-off valves 76 and 77 to the open positions, respectively, and sets the switching valve 78 to the shut-off position. When the embodiment apparatus executes the activation control D, the cooling water circulates as shown by arrows in FIG. 8.

According to the activation control D, the cooling water is discharged to the water passage 53 via the pump discharging opening 70out and then, flows into the head water passage 51 via the water passage 54. The cooling water flows through the head water passage 51 and then, flows into the EGR cooler water passage 59 and the heater core water passage 60 via the water passage 56 and the radiator water passage 58.

The cooling water flowing into the EGR cooler water passage 59 flows through the EGR cooler 43 and then, sequentially flows through the water passage 61, the third portion 583 of the radiator water passage 58, and the fourth portion 584 of the radiator water passage 58. Then, the cooling water is suctioned into the pump 70 via the pump suctioning opening 70in. On the other hand, the cooling water flowing into the heater core water passage 60 flows through the heater core 72 and then, sequentially flows through the water passage 61, the third portion 583 of the radiator water passage 58, and the fourth portion 584 of the radiator water passage 58. Then, the cooling water is suctioned into the pump 70 via the pump suctioning opening 70in.

Thereby, effects similar to effects achieved by the activation controls B and C, are achieved.

<First Semi-Warmed State Control>

Next, a first semi-warmed state control corresponding to the activation control of the pump 70 and the like will be described. The first semi-warmed state control is executed when the embodiment apparatus determines that the warmed state is the first semi-warmed state.

<Activation Control E>

When the warmed state is the first semi-warmed state, the head and block temperatures Thd and Tbr are requested to be increased at the large rate. When the EGR cooler water supply and the heater core water supply are not requested while the warmed state is the first semi-warmed state, the embodiment apparatus should execute the activation control A only for accomplishing a request of increasing the head and block temperatures Thd and Tbr, similar to when the warmed state is the cool state.

In this regard, when the warmed state is the first semi-warmed state, the head and block temperatures Thd and Tbr are high, compared with when the warmed state is the cool state. Therefore, if the embodiment apparatus executes the activation control A, the cooling water stays in the head and block water passages 51 and 52. As a result, the temperature of parts of the cooling water staying in the head and block water passages 51 and 52 may increase to a greatly high temperature. Thus, the cooling water staying in the head and block water passages 51 and 52 may boil.

Accordingly, when the EGR cooler water supply and the heater core water supply are not requested while the warmed state is the first semi-warmed state, the embodiment apparatus executes the activation control E as the first semi-warmed state control. According to the activation control E, the embodiment apparatus activates the pump 70, sets the shut-off valves 75 to 77 to the closed positions, respectively, and sets the switching valve 78 to the opposite flow position. When the embodiment apparatus executes the activation control E, the cooling water circulates as shown by arrows in FIG. 9.

According to the activation control E, the cooling water is discharged to the water passage 53 via the pump discharging opening 70out and then, flows into the head water passage 51 via the water passage 54. The cooling water flows through the head water passage 51 and then, flows into the block water passage 52 through the water passages 56 and 57. The cooling water flows through the block water passage 52 and then, flows through the second portion 552 of the block water passage 52, the water passage 62, and the fourth portion 584 of the radiator water passage 58. Then, the cooling water is suctioned into the pump 70 via the pump suctioning opening 70in.

Thereby, the cooling water is supplied from the head water passage 51 directly to the block water passage 52 without flowing through any of the radiator 71, the EGR cooler 43, and the heater core 72. In this case, the temperature of the cooling water supplied to the block water passage 52, is increased since the temperature of the cooling water is increased while the cooling water flows through the head water passage 51. Thus, the block temperature Tbr increases at the large rate, compared with when the cooling water is supplied to the block water passage 52 through any of the radiator 71, the EGR cooler 43, and the heater core 72. Hereinafter, the radiator 71, the EGR cooler 43, and the heater core 72 will be collectively referred to as "the radiator 71 and the like".

In addition, the cooling water is supplied to the head water passage 51 without flowing through the radiator 71 and the like. Thus, when the cooling water is supplied to the head water passage 51 without flowing through the radiator 71 and the like, the head temperature Thd increases at the large rate, compared with when the cooling water is supplied to the head water passage 51 through the radiator 71 and the like.

In addition, the cooling water flows through the head and block water passages 51 and 52. Thus, the temperature of the cooling water is prevented from increasing to the greatly high temperature in the head and block water passages 51 and 52. As a result, the cooling water is prevented from boiling in the head and block water passages 51 and 52.

When the cooling water flows through the head and block water passages 51 and 52, the cylinder head 14 and the cylinder block 15 are cooled by the cooling water. Thus, an increasing rate of the head and block temperatures Thd and Tbr decreases. A degree of decreasing the increasing rate increases as a flow rate of the cooling water flowing through the head and block water passages 51 and 52, increases. On the other hand, when the warmed state is the first semi-warmed state, the head and block temperatures Thd and Tbr should be increased at the large rate for completing the warming of the engine 10 as soon as possible.

Accordingly, when the embodiment apparatus executes the activation control E as the first semi-warmed state control, the embodiment apparatus controls the activation of the pump 70 such that the cooling water is discharged from the pump 70 at a minimum flow rate capable of preventing the cooling water from boiling in the head and block water passages 51 and 52. Thereby, the cooling water flows through the head and block water passages 51 and 52 at the minimum flow rate capable of preventing the cooling water from boiling in the head and block water passages 51 and 52. Thus, the increasing rate of the head and block temperatures Thd and Tbr is maintained at the large rate.

Therefore, according to the activation control E executed as the first semi-warmed state control, the head and block temperatures Thd and Tbr increase at the large rate while the cooling water is prevented from boiling in the head and block water passages 51 and 52. Hereinafter, the minimum flow rate capable of preventing the cooling water from boiling in the head and block water passages 51 and 52 will be simply referred to as "the minimum flow rate".

It should be noted that the embodiment apparatus may be configured to previously set an appropriate flow rate larger than the minimum flow rate as a predetermined flow rate and control the activation of the pump 70 to control the flow rate of the cooling water discharged from the pump 70 to a rate smaller than the predetermined flow rate when the embodiment apparatus executes the activation control E as the first semi-warmed state control. Hereinafter, the flow rate of the cooling water discharged from the pump 70 will be referred to as "the pump discharge flow rate".

Further, the embodiment apparatus may be configured to control a position of the switching valve 78 and/or the activation of the pump 70 to control the flow rate of the cooling water flowing through the switching valve 78 to the minimum flow rate when the switching valve 78 can adjust the flow rate of the cooling water flowing therethrough. Thereby, the flow rate of the cooling water flowing through the head and block water passages 51 and 52, is controlled to the minimum flow rate.

<Activation Control F>

When the EGR cooler water supply is requested, and the heater core water supply is not requested while the warmed state is the first semi-warmed state, the embodiment apparatus executes the activation control F as the first semi-warmed state control. According to the activation control F, the embodiment apparatus activates the pump 70, sets the shut-off valves 75 and 77 to the closed positions, respectively, sets the shut-off valve 76 to the open position, and sets the switching valve 78 to the opposite flow position. When the embodiment apparatus executes the activation control F, the cooling water circulates as shown by arrows in FIG. 10.

According to the activation control F, the cooling water is discharged to the water passage 53 via the pump discharging opening 70out and then, flows into the head water passage 51 via the water passage 54.

A part of the cooling water flowing into the head water passage 51, flows through the head water passage 51 and then, flows directly into the block water passage 52 via the water passages 56 and 57. The cooling water flows through the block water passage 52 and then, flows through the second portion 552 of the water passage 55, the water passage 62, and the fourth portion 584 of the radiator water passage 58. Then, the cooling water is suctioned into the pump 70 via the pump suctioning opening 70in.

On the other hand, the remaining of the cooling water flowing into the head water passage 51, flows through the EGR cooler water passage 59 via the water passage 56 and the radiator water passage 58. The cooling water flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, the cooling water is supplied from the head water passage 51 directly to the block water passage 52 without flowing through the radiator 71. In this case, the temperature of the cooling water supplied to the block water passage 52, is increased since the temperature of the cooling water is increased while the cooling water flows through the head water passage 51. Thus, the block temperature Tbr increases at the large rate, compared with when the cooling water is supplied to the block water passage 52 through the radiator 71.

In addition, the cooling water is supplied to the head water passage 51 without flowing through the radiator 71. In this case, the head temperature Thd increases at the large rate, compared with when the cooling water is supplied to the head water passage 51 through the radiator 71.

In addition, the cooling water is supplied to the EGR cooler water passage 59. Thus, the EGR cooler water supply is accomplished in response to the EGR cooler water supply request.

In addition, similar to the activation control E, the cooling water flows through the head and block water passages 51 and 52. Thus, the cooling water is prevented from boiling in the head and block water passages 51 and 52.

<Activation Control G>

When the heater core water supply is requested, and the EGR cooler water supply is not requested while the warmed state is the first semi-warmed state, the embodiment apparatus executes the activation control G as the first semi-warmed state control. According to the activation control G, the embodiment apparatus activates the pump 70, sets the shut-off valves 75 and 76 to the closed positions, respectively, sets the shut-off valve 77 to the open position, and sets the switching valve 78 to the opposite flow position. When the embodiment apparatus executes the activation control G, the cooling water circulates as shown by arrows in FIG. 11.

According to the activation control G, the cooling water is discharged to the water passage 53 via the pump discharging opening 70out and then, flows into the head water passage 51 via the water passage 54.

A part of the cooling water flowing into the head water passage 51, flows through the head water passage 51 and then, flows into the block water passage 52 via the water passages 56 and 57. The cooling water flows through the block water passage 52 and then, flows through the second portion 552 of the water passage 55, the water passage 62, and the fourth portion 584 of the radiator water passage 58. Then, the cooling water is suctioned into the pump 70 via the pump suctioning opening 70in.

On the other hand, the remaining of the cooling water flowing into the head water passage 51, flows through the heater core water passage 60 via the water passage 56 and the radiator water passage 58. The cooling water flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, the cooling water is supplied from the head water passage 51 directly to the block water passage 52 without flowing through the radiator 71. In this case, the temperature of the cooling water supplied to the block water passage 52, is increased since the temperature of the cooling water is increased while the cooling water flows through the head water passage 51. Thus, similar to the activation control F, the block temperature Tbr increases at the large rate. In addition, the cooling water is supplied to the head water passage 51 without flowing through the radiator 71. Thus, similar to the activation control F, the head temperature Thd increases at the large rate. In addition, the cooling water is supplied to the heater core water passage 60. Thus, the heater core water supply is accomplished in response to the heater core water supply request.

In addition, similar to the activation control E, the cooling water flows through the head and block water passages 51 and 52. Thus, the cooling water is prevented from boiling in the head and block water passages 51 and 52.

<Activation Control H>

When the EGR cooler water supply and the heater core water supply are requested while the warmed state is the first semi-warmed state, the embodiment apparatus executes the activation control H as the first semi-warmed state control. According to the activation control H, the embodiment apparatus activates the pump 70, sets the shut-off valve 75 to the closed position, sets the shut-off valves 76 and 77 to the open positions, respectively, and sets the switching valve 78 to the opposite flow position. When the embodiment apparatus executes the activation control H, the cooling water circulates as shown by arrows in FIG. 12.

According to the activation control H, the cooling water is discharged to the water passage 53 via the pump discharging opening 70out and then, flows into the head water passage 51 via the water passage 54.

A part of the cooling water flowing into the head water passage 51, flows through the head water passage 51 and then, flows directly into the block water passage 52 via the water passages 56 and 57. The cooling water flows through the block water passage 52 and then, flows through the second portion 552 of the water passage 55, the water passage 62, and the fourth portion 584 of the radiator water passage 58. Then, the cooling water is suctioned into the pump 70 via the pump suctioning opening 70in.

On the other hand, the remaining of the cooling water flowing into the head water passage 51, flows through the EGR cooler water passage 59 and the heater core water passage 60 via the water passage 56 and the radiator water passage 58. The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70in. On the other hand, the cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, effects similar to effects achieved by the activation controls F and G, are achieved.

<Second Semi-Warmed State Control>

Next, a second semi-warmed state control corresponding to the activation control of the pump 70 and the like will be described. The second semi-warmed state control is executed when the embodiment apparatus determines that the warmed state is the second semi-warmed state.

<Activation Control E>

When the warmed state is the second semi-warmed state, the head and block temperatures Thd and Tbr are requested to be increased. When the EGR cooler water supply and the heater core water supply are not requested while the warmed state is the second semi-warmed state, the embodiment apparatus should execute the activation control A only for accomplishing the request of increasing the head and block temperatures Thd and Tbr, similar to when the warmed state is the cool state.

In this regard, when the warmed state is the second semi-warmed state, the head and block temperatures Thd and Tbr are high, compared with when the warmed state is the cool state. Therefore, if the embodiment apparatus executes the activation control A, the cooling water stays in the head water passage 51 and 52. As a result, the temperature of the parts of the cooling water staying in the head and block water passages 51 and 52 may increase to the greatly high temperature. Thus, the cooling water staying in the head and block water passages 51 and 52 may boil.

Accordingly, when the EGR cooler water supply and the heater core water supply are not requested while the warmed state is the second semi-warmed state, the embodiment apparatus executes the activation control E as the second semi-warmed state control. According to the activation control E, the embodiment apparatus activates the pump 70, sets the shut-off valves 75 to 77 to the closed positions, respectively, and sets the switching valve 78 to the opposite flow position. When the embodiment apparatus executes the activation control E, the cooling water circulates as shown by the arrows in FIG. 9.

As described above, when the cooling water flows through the head and block water passages 51 and 52, the cylinder head 14 and the cylinder block 15 are cooled by the cooling water. As a result, the increasing rate of the head and block temperatures Thd and Tbr decreases. The degree of decreasing the increasing rate increases as the flow rate of the cooling water flowing through the head and block water passages 51 and 52, increases.

In addition, when the warmed state is the second semi-warmed state, the head and block temperatures Thd and Tbr are high, compared with when the warmed state is the first semi-warmed state. Thus, the cooling water may boil in the head and block water passages 51 and 52. Therefore, when the warmed state is the second semi-warmed state, the increasing rate of the head and block temperatures Thd and Tbr are preferably small for the purpose of preventing the cooling water from boiling in the head and block water passages 51 and 52, compared with when the warmed state is the first semi-warmed state.

Accordingly, when the embodiment apparatus executes the activation control E as the second semi-warmed state control, the embodiment apparatus controls the activation of the pump 70 such that the pump discharge flow rate is larger than the minimum flow rate. Thereby, the flow rate of the cooling water flowing through the head and block water passages 51 and 52, is large, compared with when the activation control E is executed as the first semi-warmed state control. Thus, the head and block temperatures Thd and Tbr increase at an appropriately large rate while the cooling water is prevented from boiling in the head and block water passages 51 and 52.

It should be noted that the embodiment apparatus may be configured to control the activation of the pump 70 such that the pump discharge flow rate is equal to or larger than the predetermined flow rate when the embodiment apparatus is configured to execute the activation control E as the first semi-warmed state control to control the activation of the pump 70 such that the pump discharge flow rate is smaller than the predetermined flow rate.

<Activation Control I>

When the EGR cooler water supply is requested, and the heater core water supply is not requested while the warmed state is the second semi-warmed state, the embodiment apparatus executes the activation control I as the second semi-warmed state control. According to the activation control I, the embodiment apparatus activates the pump 70, sets the shut-off valves 75 and 77 to the closed positions, respectively, sets the shut-off valve 76 to the open position, and sets the switching valve 78 to the normal flow position. When the embodiment apparatus executes the activation control I, the cooling water circulates as shown by arrows in FIG. 13.

According to the activation control I, a part of the cooling water discharged to the water passage 53 via the pump discharging opening 70out, flows into the head water passage 51 via the water passage 54. The remaining of the cooling water discharged to the water passage 53 via the pump discharging opening 70out, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57.

The cooling water flowing into the radiator water passage 58, flows into the EGR cooler water passage 59. The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, the cooling water is supplied to the head and block water passages 51 and 52 without flowing through the radiator 71. Therefore, the head and block temperatures Thd and Tbr increase at the large rate, compared with when the cooling water is supplied to the head and block water passages 51 and 52 through the radiator 71. In addition, the cooling water is supplied to the EGR cooler water passage 59. Thus, the EGR cooler water supply is accomplished in response to the EGR cooler water supply request.

In addition, when the warmed state is the second semi-warmed state, the block temperature Tbr is relatively high, compared with when the warmed state is the first semi-warmed state. Therefore, the increasing rate of the block temperature Tbr is preferably small for the purpose of preventing the cylinder block 15 from overheating, compared with when the warmed state is the first semi-warmed state. In addition, the cooling water preferably flows through the block water passage 52 for the purpose of preventing the cooling water from boiling in the block water passage 52.

According to the activation control I, the cooling water discharged from the head water passage 51, does not flows directly into the block water passage 52. The cooling water flowing through the EGR cooler 43, flows into the block water passage 52. Thus, the increasing rate of the block temperature Tbr is small, compared with when the cooling water discharged from the head water passage 51, flows directly into the block water passage 52, that is, when the warmed state is the first semi-warmed state. In addition, the cooling water flows through the block water passage 52. Thus, the cylinder block 15 is prevented from overheating, and the cooling water is prevented from boiling in the block water passage 52.

<Activation Control J>

When the heater core water supply is requested, and the EGR cooler water supply is not requested while the warmed state is the second semi-warmed state, the embodiment apparatus executes the activation control J as the second semi-warmed state control. According to the activation control J, the embodiment apparatus activates the pump 70, sets the shut-off valves 75 and 77 to the closed positions, respectively, sets the shut-off valve 76 to the open position, and sets the switching valve 78 to the normal flow position. When the embodiment apparatus executes the activation control J, the cooling water circulates as shown by arrows in FIG. 14.

According to the activation control J, a part of the cooling water discharged to the water passage 53 via the pump discharging opening 70out, flows into the head water passage 51 via the water passage 54. The remaining of the cooling water discharged to the water passage 53 via the pump discharging opening 70out, flows into the block water passage 52 via the water passage 55.

The cooling water flowing into the head water passage 51, flows through the head water passage 51 and then, flows into the heater core water passage 60 via the water passage 56 and the radiator water passage 58. The cooling water flowing into the block water passage 52, flows through the block water passage 52 and then, flows into the heater core water passage 60 via the water passage 57 and the radiator water passage 58.

The cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, the cooling water is supplied to the head and block water passages 51 and 52 without flowing through the radiator 71. Therefore, similar to the activation control I, the head and block temperatures Thd and Tbr increase at the large rate. In addition, the cooling water is supplied to the heater core water passage 60. Thus, the heater core water supply is accomplished in response to the heater core water supply request.

It should be noted that as described, regarding the activation control I, when the warmed state is the second semi-warmed state, the increasing rate of the block temperature Tbr is preferably small, compared with when the warmed state is the first semi-warmed state, and the cooling water preferably flows through the block water passage 52.

According to the activation control J, similar to the activation control I, the cooling water discharged from the head water passage 51, does not flows directly into the block water passage 52. The cooling water flows into the block water passage 52 through the EGR cooler 43. Thus, the increasing rate of the block temperature Tbr is small, compared with when the cooling water discharged from the head water passage 51, flows directly into the block water passage 52, that is, when the warmed state is the first semi-warmed state. In addition, the cooling water flows through the block water passage 52. Thus, the cylinder block 15 is prevented from overheating, and the cooling water is prevented from boiling in the block water passage 52.

<Activation Control K>

When the EGR cooler water supply and the heater core water supply are requested while the warmed state is the second semi-warmed state, the embodiment apparatus executes the activation control K as the second semi-warmed state control. According to the activation control K, the embodiment apparatus activates the pump 70, sets the shut-off valve 75 to the closed position, sets the shut-off valves 76 and 77 to the open positions, respectively, and sets the switching valve 78 to the normal flow position. When the embodiment apparatus executes the activation control K, the cooling water circulates as shown by arrows in FIG. 15.

According to the activation control K, a part of the cooling water discharged to the water passage 53 via the pump discharging opening 70out, flows into the head water passage 51 via the water passage 54. The remaining of the cooling water discharged to the water passage 53 via the pump discharging opening 70out, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57.

The cooling water flowing into the radiator water passage 58, flows into the EGR cooler water passage 59 and the heater core water passage 60.

The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70in. The cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, effects similar to effects achieved by the activation controls I and J, are achieved.

<Complete Warmed State Control>

Next, a completely-warmed state control corresponding to the activation control of the pump 70 and the like will be described. The completely-warmed state control is executed when the embodiment apparatus determines that the warmed state is the completely-warmed state.

When the warmed state is the completely-warmed state, the cylinder head 14 and the cylinder block 15 should be cooled. Accordingly, the embodiment apparatus cools the cylinder head 14 and the cylinder block 15 by the cooling water cooled by the radiator 71 when the warmed state is the completely-warmed state.

<Activation Control L>

In particular, when the EGR cooler water supply and the heater core water supply are not requested while the warmed state is the completely-warmed state, the embodiment apparatus executes the activation control L as the completely-warmed state control. According to the activation control L, the embodiment apparatus activates the pump 70, sets the shut-off valves 76 and 77 to the closed positions, respectively, sets the shut-off valve 75 to the open position, and sets the switching valve 78 to the normal flow position. When the embodiment apparatus executes the activation control L, the cooling water circulates as shown by arrows in FIG. 16.

According to the activation control L, a part of the cooling water discharged to the water passage 53 via the pump discharging opening 70out, flows into the head water passage 51 via the water passage 54. The remaining of the cooling water discharged to the water passage 53 via the pump discharging opening 70out, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57. The cooling water flowing into the radiator water passage 58, flows through the radiator 71 and then, is suctioned into the pump 70 via the pump suctioning opening 70in.

Thereby, the cooling water is supplied to the head and block water passages 51 and 52 through the radiator 71. Thus, the cylinder head 14 and the cylinder block 15 are cooled by the cooling water having the low temperature.

<Activation Control M>

When the EGR cooler water supply is requested, and the heater core water supply is not requested while the warmed state is the completely-warmed state, the embodiment apparatus executes the activation control M as the completely-warmed state control. According to the activation control M, the embodiment apparatus activates the pump 70, sets the shut-off valve 77 to the closed position, sets the shut-off valves 75 and 76 to the open positions, respectively, and sets the switching valve 78 to the normal flow position. When the embodiment apparatus executes the activation control M, the cooling water circulates as shown by arrows in FIG. 17.

According to the activation control M, a part of the cooling water discharged to the water passage 53 via the pump discharging opening 70out, flows into the head water passage 51 via the water passage 54. The remaining of the cooling water discharged to the water passage 53 via the pump discharging opening 70out, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57.

A part of the cooling water flowing into the radiator water passage 58, flows through the radiator 71 and then, is suctioned into the pump 70 via the pump suctioning opening 70in.

The remaining of the cooling water flowing into the radiator water passage 58, flows into the EGR cooler water passage 59. The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, the cooling water is supplied to the EGR cooler water passage 59. In addition, the cooling water is supplied to the head and block water passages 51 and 52 through the radiator 71. Therefore, the cylinder head 14 and the cylinder block 15 are cooled by the cooling water having the low temperature. In addition, the EGR cooler water supply is accomplished in response to the EGR cooler water supply request.

<Activation Control N>

When the heater core water supply is requested, and the EGR cooler water supply is not requested while the warmed state is the completely-warmed state, the embodiment executes the activation control N as the completely-warmed state control. According to the activation control N, the embodiment apparatus activates the pump 70, sets the shut-off valve 76 to the closed position, sets the shut-off valves 75 and 76 to the open positions, respectively, and sets the switching valve 78 to the normal flow position. When the embodiment apparatus executes the activation control N, the cooling water circulates as shown by arrows in FIG. 18.

According to the activation control N, a part of the cooling water discharged to the water passage 53 via the pump discharging opening 70out, flows into the head water passage 51 via the water passage 54. The remaining of the cooling water discharged to the water passage 53 via the pump discharging opening 70out, flows into the block water passage 52 via the water passage 55.

The cooling water flowing into the head water passage 51, flows through the head water passage 51 and then, flows into the radiator water passage 58 via the water passage 56 and the radiator water passage 58. The cooling water flowing into the block water passage 52, flows through the block water passage 52 and then, flows into the radiator water passage 58 via the water passage 57.

A part of the cooling water flowing into the radiator water passage 58, flows through the radiator 71 and then, is suctioned into the pump 70 via the pump suctioning opening 70in.

The remaining of the cooling water flowing into the radiator water passage 58, flows into the heater core water passage 60. The cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, the cooling water is supplied to the heater core water passage 60. In addition, the cooling water is supplied to the head and block water passages 51 and 52 through the radiator 71. Therefore, the cylinder head 14 and the cylinder block 15 are cooled by the cooling water having the low temperature. In addition, the heater core water supply is accomplished in response to the heater core water supply request.

<Activation Control O>

When the EGR cooler water supply and the heater core water supply are requested while the warmed state is the completely-warmed state, the embodiment apparatus executes the activation control O as the completely-warmed state control. According to the activation control O, the embodiment apparatus activates the pump 70, sets the shut-off valve 75 to 77 to the open positions, respectively, and sets the switching valve 78 to the normal flow position. When the embodiment apparatus executes the activation control O, the cooling water circulates as shown by arrows in FIG. 19.

According to the activation control O, a part of the cooling water discharged to the water passage 53 via the pump discharging opening 70out, flows into the head water passage 51 via the water passage 54. The remaining of the cooling water discharged to the water passage 53 via the pump discharging opening 70out, flows into the block water passage 52 via the water passage 55. The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57.

A part of the cooling water flowing into the radiator water passage 58, flows through the radiator 71 and then, is suctioned into the pump 70 via the pump suctioning opening 70in.

The remaining of the cooling water flowing into the radiator water passage 58, flows into the EGR cooler water passage 59 and the heater core water passage 60. The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70in. The cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70in.

Thereby, effects similar to effects achieved by the activation controls L to N, are achieved.

As described above, according to the embodiment apparatus, the prompt increase of the head and block temperatures Thd and Tbr and the prevention of the boil of the cooling water in the head and block water passages 51 and 52 are accomplished by adding the water passage 62, the switching valve 78, and the shut-off valve 75 to the known cooling apparatus at a low manufacturing cost when the engine temperature Teng is low, in particular, when the warmed state is the first or second semi-warmed state.

<Change of Activation Control>

The embodiment apparatus needs to change the position of at least one of the shut-off valve 75 to 77 from the closed position to the open position and the position of the switching valve 78 from the opposite flow position to the normal flow position for changing the activation control from any of the activation controls E to H to any of the activation controls I to O. Hereinafter, the shut-off valve 75 to 77 will be collectively referred to as "the shut-off valve 75 and the like".

If the position of the switching valve 78 is changed from the opposite flow position to the normal flow position before the positions of the shut-off valve 75 and the like are changed from the closed position to the open position, the water passage has been shut off until the positions of the shut-off valve 75 and the like are changed after the position of the switching valve 78 is changed. Also, if the positions of the shut-off valve 75 and the like are changed from the closed positions to the open positions, and simultaneously, the position of the switching valve 78 is changed from the opposite flow position to the normal flow position, the water passage is shut off instantly.

When the water passage is shut off, the pump 70 is activated even though the cooling water cannot circulate the water passages.

Accordingly, the embodiment apparatus first changes the positions of the shut-off valve 75 and the like from the closed positions to the open positions and then, changes the position of the switching valve 78 from the opposite flow position to the normal flow position for changing the activation control from any of the activation controls E to H to any of the activation controls I to O.

Thereby, a state that the pump 70 is activated even though the water passages are shut off and thus, the cooling water cannot circulate through the water passages, is prevented from occurring when the activation control is changed from any of the activation controls E to H to the activation controls I to O.

<Hybrid Control>

Next, a control of the engine 10, the first motor generator 110 and the second motor generator 120 executed by the ECU 90 will be described. The ECU 90 acquires a request torque TQreq on the basis of the acceleration pedal operation amount AP and the vehicle speed V. The request torque TQreq is a torque requested by the driver as a driving torque applied to the driving wheels 190 for driving the driving wheels 190.

The ECU 90 multiplies the request torque TQreq by the second MG rotation speed NM2 to calculate an output Pdry to be input into the driving wheels 190. Hereinafter, the output Pdry will be referred to as "the requested driving output Pdrv".

The ECU 90 acquires an output Pchg to be input into the first motor generator 110 for controlling the battery charge amount SOC to a target value SOCtgt of the battery charge amount SOC on the basis of a difference ΔSOC between the target value SOCtgt and the present battery charge amount SOC (ΔSOC=SOCtgt−SOC).

The ECU 90 calculates a sum of the request driving output Pdry and the request charge output Pchg as an output Peng to be output from the engine 10. Hereinafter, the output Peng will be referred to as "the requested engine output Peng".

The ECU 90 determines whether the request engine output Peng is smaller than a lower limit value of an optimal operation output of the engine 10. The lower limit value of the optimal operation output of the engine 10 is a minimum value of the output of the engine 10 at which the engine 10 operates at an efficiency larger than a predetermined efficiency. The optimal operation output is defined by a combination of an optimal engine torque TQeop and an optimal engine speed NEeop.

When the request engine output Peng is smaller than the lower limit value of the optimal operation output of the engine 10, the ECU 90 determines that an engine operation condition is not satisfied. When the ECU 90 determines that the engine operation condition is not satisfied, the ECU 90 sets a target value TQeng_tgt of the engine torque and a target value NEtgt of the engine speed to zero, respectively. Hereinafter, the target value TQeng_tgt will be referred to as "the target engine torque TQeng_tgt and the target value NEtgt will be referred to as "the target engine speed NEtgt.

In addition, the ECU 90 calculates a target value TQmg2_*tgt* of the torque to be output from the second motor generator 120 for inputting the request driving output Pdry into the driving wheels 190 on the basis of the second MG rotation speed NM2. Hereinafter, the target value TQmg2_*tgt* will be referred to as "the target second MG torque TQmg2_*tgt*".

On the other hand, when the request engine output Peng is equal to or larger than the lower limit value of the optimal operation output of the engine 10, the ECU 90 determines that the engine operation condition is satisfied. When the ECU 90 determines that the engine operation condition is satisfied, the ECU 90 sets the target engine torque TQeng_tgt and the target engine speed NEtgt as the target values of the optimum engine torque TQeop and the optimum engine speed NEeop for outputting the request engine output Peng from the engine 10, respectively. In this case, the target engine torque TQeng_tgt and the target engine speed NEtgt are set to values larger than zero, respectively.

The ECU 90 calculates a target first MG rotation speed NM1*tgt* on the basis of the target engine speed NEtgt and the second MG rotation speed NM2.

The ECU 90 calculates the target first MG torque TQmg1_*tgt* on the basis of the target engine torque TQeng_tgt, the target first MG rotation speed NM1*tgt*, the second MG rotation speed NM2, and a torque distribution property of the driving force distribution mechanism 150.

In addition, the ECU 90 calculates the target second MG torque TQmg2_*tgt* on the basis of the request torque TQreq, the target engine torque TQeng_tgt, and the torque distribution property.

The ECU 90 controls the engine operation such that the target engine torque TQeng_tgt and the target engine speed NEtgt are accomplished. When the target engine torque TQeng_tgt and the target engine speed NEtgt are larger than zero, that is, when the engine operation condition is satisfied, the ECU 90 causes the engine 10 to operate. On the other hand, when the target engine torque TQeng_tgt and the target engine speed NEtgt are zero, that is, when the engine operation condition is not satisfied, the ECU 90 stops the engine operation.

Further, the ECU 90 controls the activation of the first motor generator 110 and the second motor generator 120 by controlling the inverter 130 such that the target first MG rotation speed NM1*tgt*, the target first MG torque TQmg1_*tgt*, and the target second MG torque TQmg2_*tgt* are accomplished. When the first motor generator 110 generates the electric power, the second motor generator 120 may be driven by the electric power supplied from the battery 140 as well as the electric power generated by the first motor generator 110.

It should be noted that the aforementioned calculation of the target engine torque TQeng_tgt, the target engine speed NEtgt, the target first MG torque TQmg1_*tgt*, the target first MG rotation speed NM1*tgt*, and the target second MG torque TQmg2_*tgt* for the vehicle 100 is known (for example, see JP 2013-177026 A).

As described above, when the ECU 90 determines that the engine operation condition is not satisfied, the ECU 90 sets the target engine torque TQeng_tgt and the target engine speed NEtgt to zero, respectively. In this case, the engine operation is stopped. If the engine operation is stopped after any of the second semi-warmed conditions Ca2 and Cb2, and the completely-warmed conditions Caw and Cbw, is satisfied, the temperature of the cooling water may decrease. Thus, any of the first semi-warmed condition Ca1 and Cb1, and the cool condition Cac and Cbc, is satisfied when the engine operation is restarted. Hereinafter, the second semi-warmed conditions Ca2 and Cb2, and the completely-warmed conditions Caw and Cbw will be referred to as "the second semi-warmed condition Ca2 and the like", and the first semi-warmed conditions Ca1 and Cb1, and the cool condition Cac and Cbc will be referred to as "the first semi-warmed condition Ca1 and the like".

The temperature of the cooling water is the parameter representing the engine temperature Teng. However, the temperature of the cooling water does not always correspond to the engine temperature Teng. Especially, the temperature of the cooling water discharged from the head and block water passages 51 and 52, that is, the engine water temperature TWeng detected by the water temperature sensor 86 is unlikely to correspond to the engine temperature Teng.

In this regard, in consideration of the relationship between the temperature of the cooling water and the engine temperature Teng, the inventors of this application have realized that the engine temperature Teng is likely to be larger than the temperature at which the block temperature Tbr should be increased at the large rate when the temperature of the cooling water becomes lower than a threshold temperature at which any of the second semi-warmed condition Ca2 and the like is satisfied after the temperature of the cooling water becomes equal to or higher than the threshold temperature.

Therefore, if the first semi-warmed state control is executed when any of the first semi-warmed condition Ca1 and the like is satisfied after any of the second semi-warmed condition Ca2 and the like is satisfied, the block temperature Tbr increases excessively. As a result, the cooling water may boil in the block water passage 52.

Accordingly, the embodiment apparatus executes the second semi-warmed state control without executing the first semi-warmed state control or the cool state control when any of the first semi-warmed condition Ca1 and the like is satisfied after any of the second semi-warmed condition Ca2 and the like is satisfied and thus, the second semi-warmed state control or the completely-warmed state control is executed since the ignition switch 89 is positioned to the ON position, i.e., since the engine operation is permitted.

Thereby, any of the activation controls I to K is executed when any of the EGR cooler water supply and the heater core water supply is requested. When any of the activation controls I to K is executed, the cooling water discharged from the head and block water passages 51 and 52, flows through at least one of the EGR cooler 43 and the heater core 72 and then, is supplied to the head and block water passages 51 and 52.

Therefore, the increasing rate of the block temperature Tbr is small, compared with when the first semi-warmed state control or the cool state control is executed. Thus, the block temperature Tbr is prevented from increasing excessively. As a result, the cooling water in the block water passage 52 is prevented from boiling.

It should be noted that the cooling water should flow through the radiator 71 for circulating the cooling water normally when the EGR cooler water supply and the heater core water supply are not requested and thus, the cooling water does not flow through the EGR cooler 43 and the heater core 72. In this case, the cooling water cooled by the radiator 71 is supplied to the head and block water passages 51 and 52. As a result, the increasing rates of the head and block temperatures Thd and Tbr decrease.

In this regard, when the activation control A is executed, the pump 70 is not activated. In this case, no cooling water is supplied to the head and block water passages 51 and 52. Therefore, the head and block temperatures Thd and Tbr increase at the large rate. However, as described above, when any of the second semi-warmed condition Ca2 and the like is satisfied before the engine operation is stopped, the head and block temperatures Thd and Tbr may be relatively high at restart of the engine operation. In this case, if the activation control A is executed, the head and block temperatures Thd and Tbr increase excessively. As a result, the cooling water may boil in the head and block water passages 51 and 52.

Accordingly, the embodiment apparatus executes the activation control E as the second semi-warmed state control when the EGR cooler water supply and the heater core water supply are not requested.

<Activation Control at Engine Operation Stop>

Next, the activation control of the pump 70 and the like when the ignition OFF operation is performed, will be described. As described above, when the ignition OFF operation is performed, the embodiment apparatus stops the engine operation. Thereafter, when the ignition on operation is performed, and the engine operation condition is satisfied, the embodiment apparatus causes the engine operation to start. In this regard, when the shut-off valve 75 is immobilized at the closed position, and the switching valve 78 is immobilized at the opposite flow position, that is, when the shut-off valve 75 and the switching valve 78 become immobilized during the stop of the engine operation, the cooling water cooled by the radiator 71 cannot be supplied to the head and block water passages 51 and 52 after the engine operation starts. In this case, the engine 10 may overheat after the warming of the engine 10 is completed.

Accordingly, the embodiment apparatus executes an engine operation stop timing control. According to the engine operation stop timing control, the embodiment apparatus stops the activation of the pump 70 when the ignition OFF operation is performed. If the switching valve 78 is set to the opposite flow position when the embodiment apparatus stops the activation of the pump 70, the embodiment apparatus sets the switching valve 78 to the normal flow position. In addition, if the shut-off valve 75 is set to the closed position when the embodiment apparatus stops the activation of the pump 70, the embodiment apparatus sets the shut-off valve 75 to the normal flow position. Thereby, the shut-off valve 75 and 78 is set to the open and normal flow positions, respectively during the stop of the engine operation. Therefore, even when the shut-off valve 75 and 78 become immobilized during the stop of the engine operation, the cooling water cooled by the radiator 71 is supplied to the head and block water passages 51 and 52 after the engine operation starts. Thus, the engine 10 is prevented from overheating after the warming of the engine 10 is completed.

<Concrete Operation of Embodiment Apparatus>

Next, a concrete operation of the embodiment apparatus will be described. The CPU of the ECU 90 of the embodiment apparatus is configured or programmed to execute a routine shown by a flowchart in FIG. 20 each time a predetermined time elapses.

Figure 20:
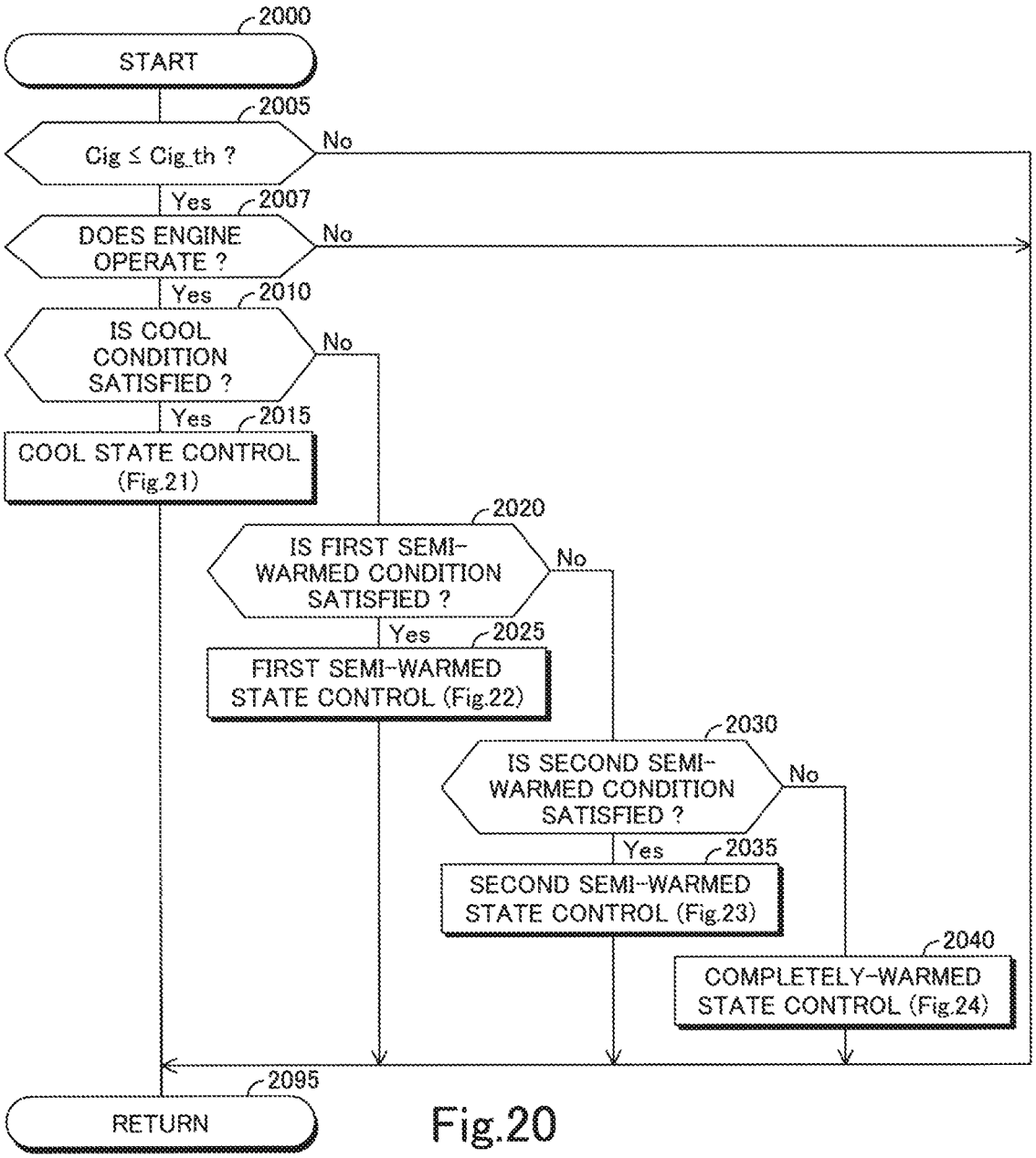
FIG. 20 is a flowchart for showing a routine executed by a CPU of an ECU shown in FIGS. 2 and 3.

Therefore, at a predetermined timing, the CPU starts a process from a step 2000 of FIG. 20 and then, proceeds with the process to a step 2005 to determine whether the after-engine-start cycle number Cig is equal to or smaller than the predetermined after-engine-start cycle number Cig_th. When the after-engine-start cycle number Cig is larger than the predetermined after-engine-start cycle number Cig_th, the CPU determines "No" at the step 2005 and then, proceeds with the process to a step 2095 to terminate this routine once.

On the other hand, when the after-engine-start cycle number Cig is equal to or smaller than the predetermined after-engine-start cycle number Cig_th, the CPU determines "Yes" at the step 2005 and then, proceeds with the process to a step 2007 to determine whether the engine 10 operates. When the engine 10 does not operates, the CPU determines "No" at the step 2007 and then, proceeds with the process to the step 2095 to terminate this routine once.

On the other hand, when the engine 10 operates, the CPU determines "Yes" at the step 2007 and then, proceeds with the process to a step 2010 to determine whether the cool condition Cac is satisfied.

Figure 21:
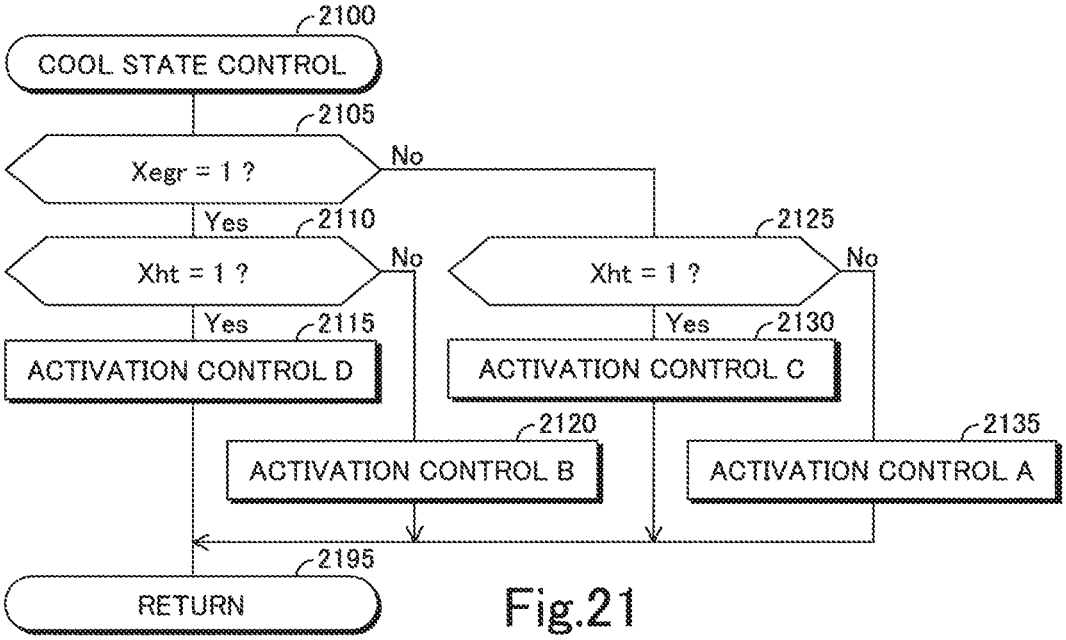
FIG. 21 is a flowchart for showing a routine executed by the CPU.

When the cool condition Cac is satisfied, the CPU determines "Yes" at the step 2010 and then, proceeds with the process to a step 2015 to execute a cool state control routine shown by a flowchart in FIG. 21.

Therefore, when the CPU proceeds with the process to the step 2015, the CPU starts a process from a step 2100 of FIG. 21 and then, proceeds with the process to a step 2105 to determine whether a value of an EGR cooler water supply request flag Xegr is "1", that is, the EGR cooler water supply is requested. The value of the flag Xegr is set by a routine shown in FIG. 26 described later.

When the value of the EGR cooler water supply request flag Xegr is "1", the CPU determines "Yes" at the step 2105 and then, proceeds with the process to a step 2110 to determine whether a value of a heater core water supply request flag Xht is "1", that is, the heater core water supply is requested. The value of the flag Xht is set by a routine shown in FIG. 27 described later.

Figure 8:
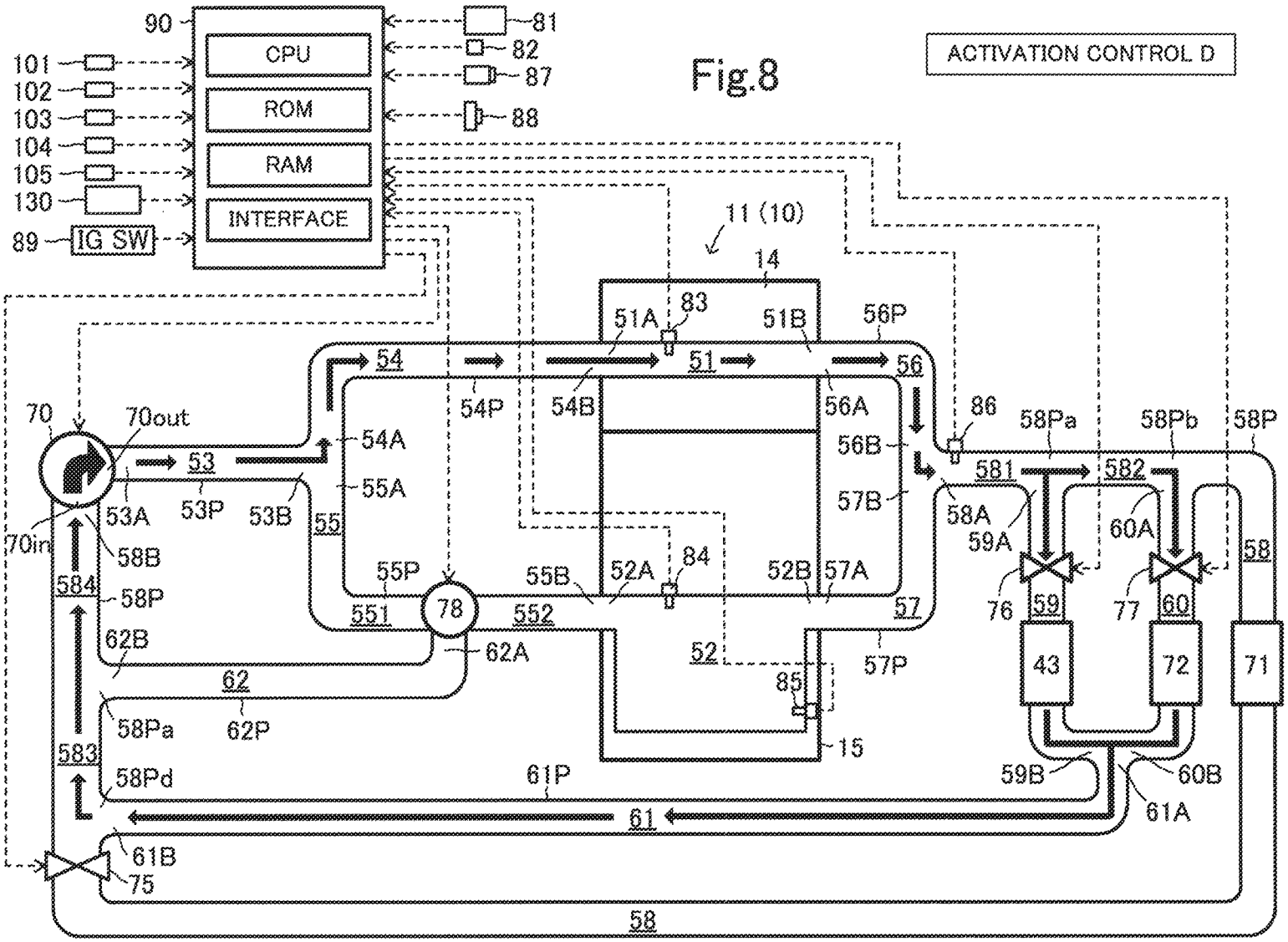
FIG. 8 is a view similar to FIG. 3 and which shows the flow of the cooling water when the cooling apparatus according to the embodiment executes an activation control D.

When the value of the heater core water supply request flag Xht is "1", the CPU determines "Yes" at the step 2110 and then, proceeds with the process to a step 2115 to execute the activation control D to control the activation of the pump 70 and the like (see FIG. 8). Then, the CPU proceeds with the process to the step 2095 of FIG. 20 via a step 2195 to terminate the routine shown in FIG. 20 once.

Figure 6:
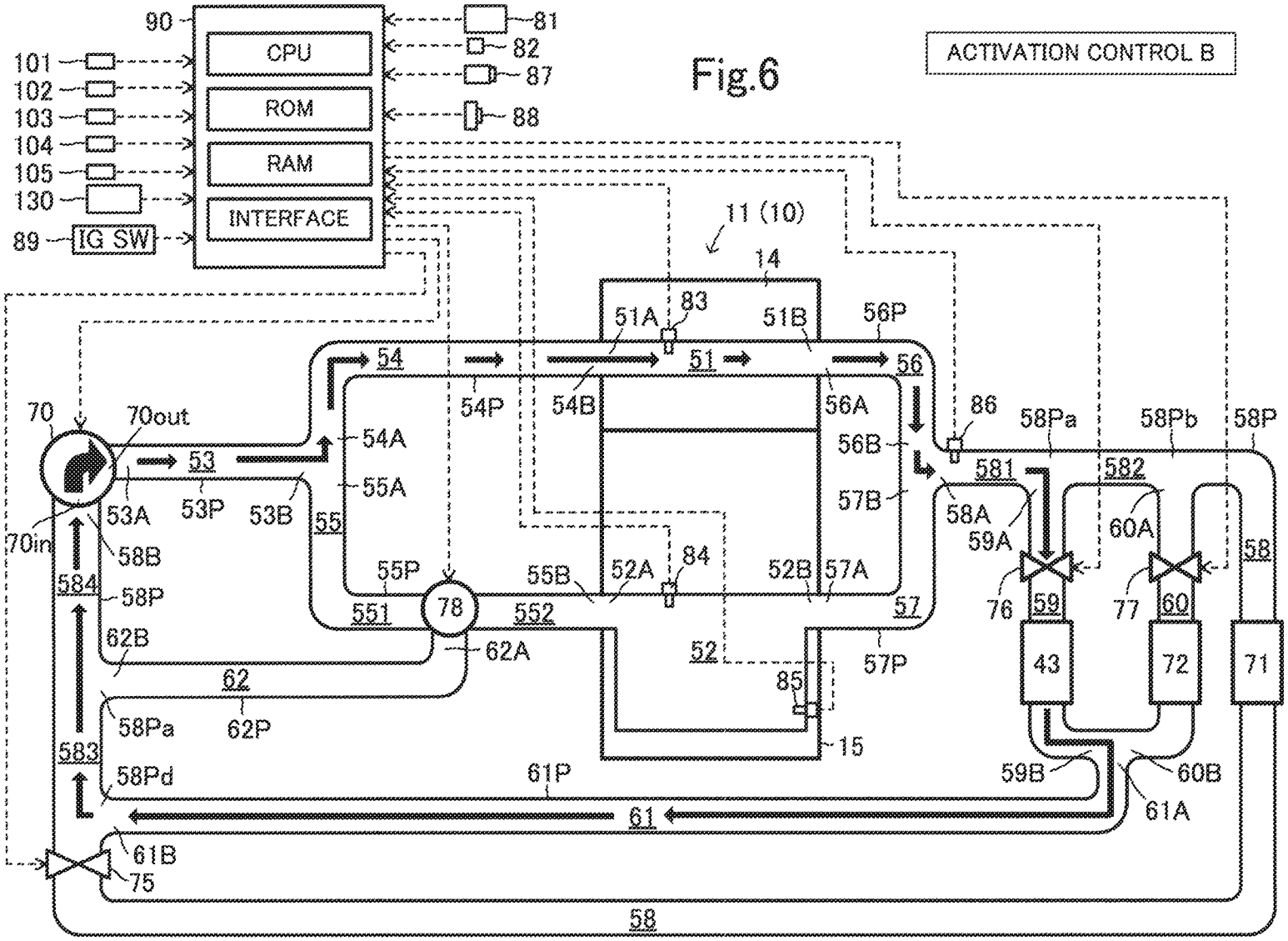
FIG. 6 is a view similar to FIG. 3 and which shows flow of cooling water when the cooling apparatus according to the embodiment executes an activation control B.

On the other hand, when the value of the heater core water supply request flag Xht is "0" at a time of the CPU executing the process of the step 2110, the CPU determines "No" at the step 2110 and then, proceeds with the process to a step 2120 to execute the activation control B to control the activation of the pump 70 and the like (see FIG. 6). Then, the CPU proceeds with the process to the step 2095 of FIG. 20 via the step 2195 to terminate the routine shown in FIG. 20 once.

When the value of the EGR cooler water supply request flag Xegr is "0" at a time of the CPU executing the process of the step 2105, the CPU determines "No" at the step 2105 and then, proceeds with the process to a step 2125 to determine whether the value of the heater core water supply request flag Xht is "1".

Figure 7:
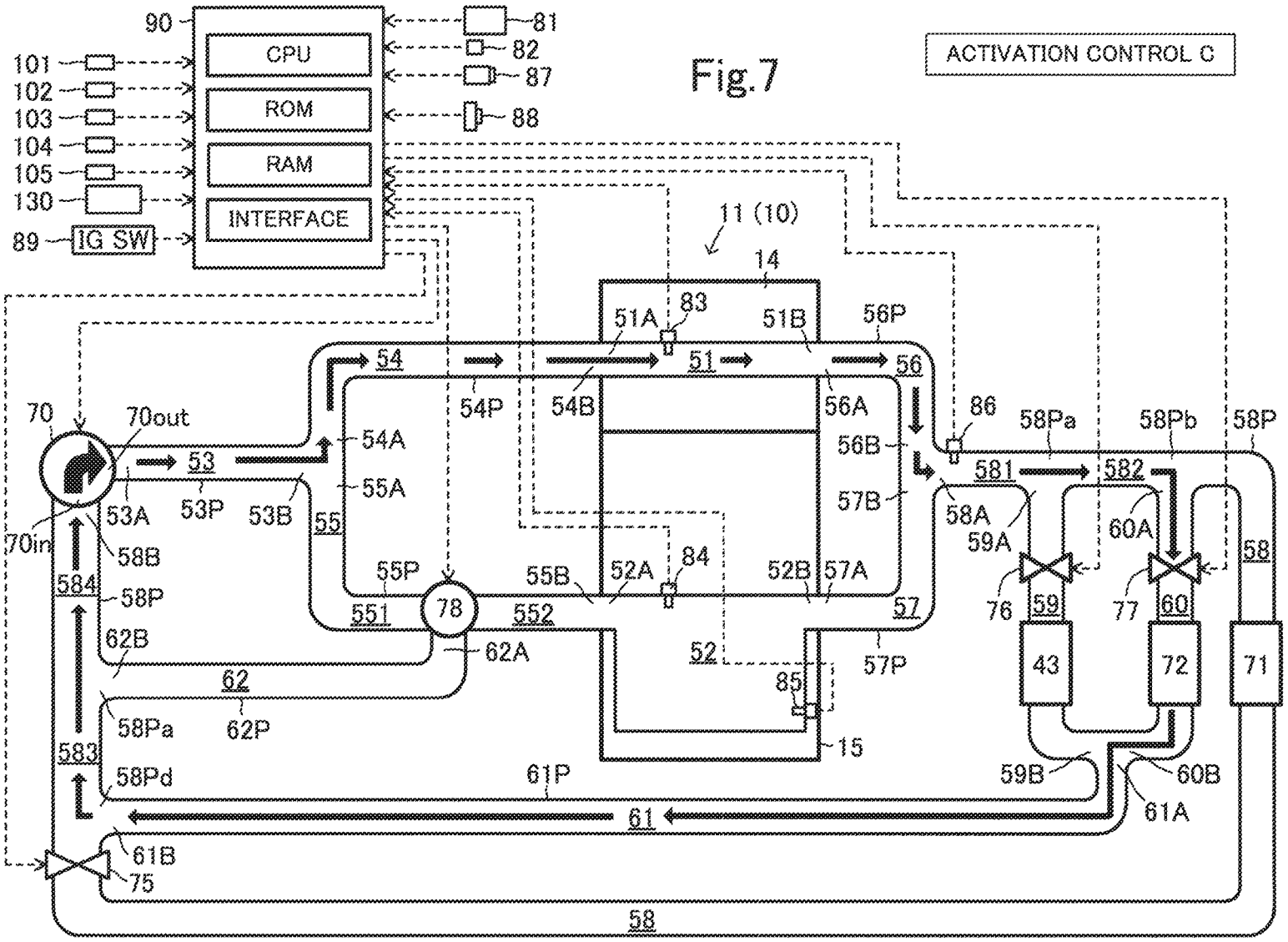
FIG. 7 is a view similar to FIG. 3 and which shows the flow of the cooling water when the cooling apparatus according to the embodiment executes an activation control C.

When the value of the heater core water supply request flag Xht is "1", the CPU determine "Yes" at the step 2125 and then, proceeds with the process to a step 2130 to execute the activation control C to control the activation of the pump 70 and the like (see FIG. 7). Then, the CPU proceeds with the process to the step 2095 of FIG. 20 via the step 2195 to terminate the routine shown in FIG. 20 once.

On the other hand, when the value of the heater core water supply request flag Xht is "0" at a time of the CPU executing the process of the step 2125, the CPU determines "No" at the step 2125 and then, proceeds with the process to a step 2135 to execute the activation control A to control the activation of the pump 70 and the like. Then, the CPU proceeds with the process to the step 2095 of FIG. 20 via the step 2195 to terminate the routine shown in FIG. 20 once.

When the cool condition Cac is not satisfied at a time of the CPU executing the process of the step 2010 of FIG. 20, the CPU determines "No" at the step 2010 and then, proceeds with the process to a step 2020 to determine whether the first semi-warmed condition Ca1 is satisfied.

Figure 22:
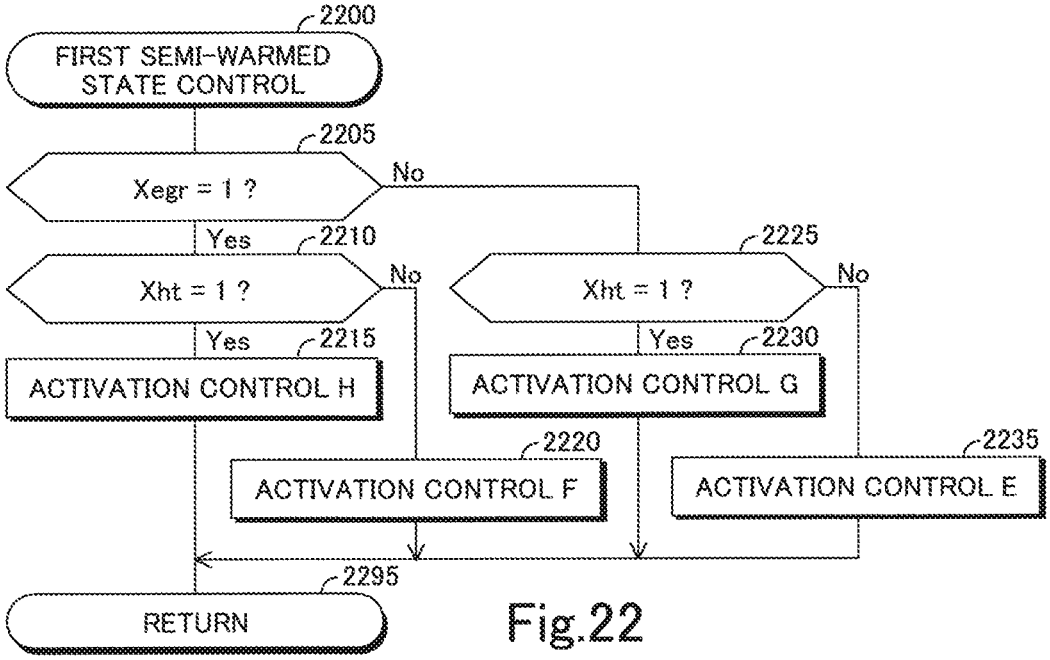
FIG. 22 is a flowchart for showing a routine executed by the CPU.

When the first semi-warmed condition Ca1 is satisfied, the CPU determines "Yes" at the step 2020 and then, proceeds with the process to a step 2025 to execute a first semi-warmed state control routine shown by a flowchart in FIG. 22.

Therefore, when the CPU proceeds with the process to the step 2025, the CPU starts a process from a step 2200 of FIG. 22 and then, proceeds with the process to a step 2205 to determine whether the value of the EGR cooler water supply request flag Xegr is "1", that is, the EGR cooler water supply is requested.

When the value of the EGR cooler water supply request flag Xegr is "1", the CPU determines "Yes" at the step 2205 and then, proceeds with the process to a step 2210 to determine whether the value of the heater core water supply request flag Xht is "1", that is, the heater core water supply is requested.

Figure 12:
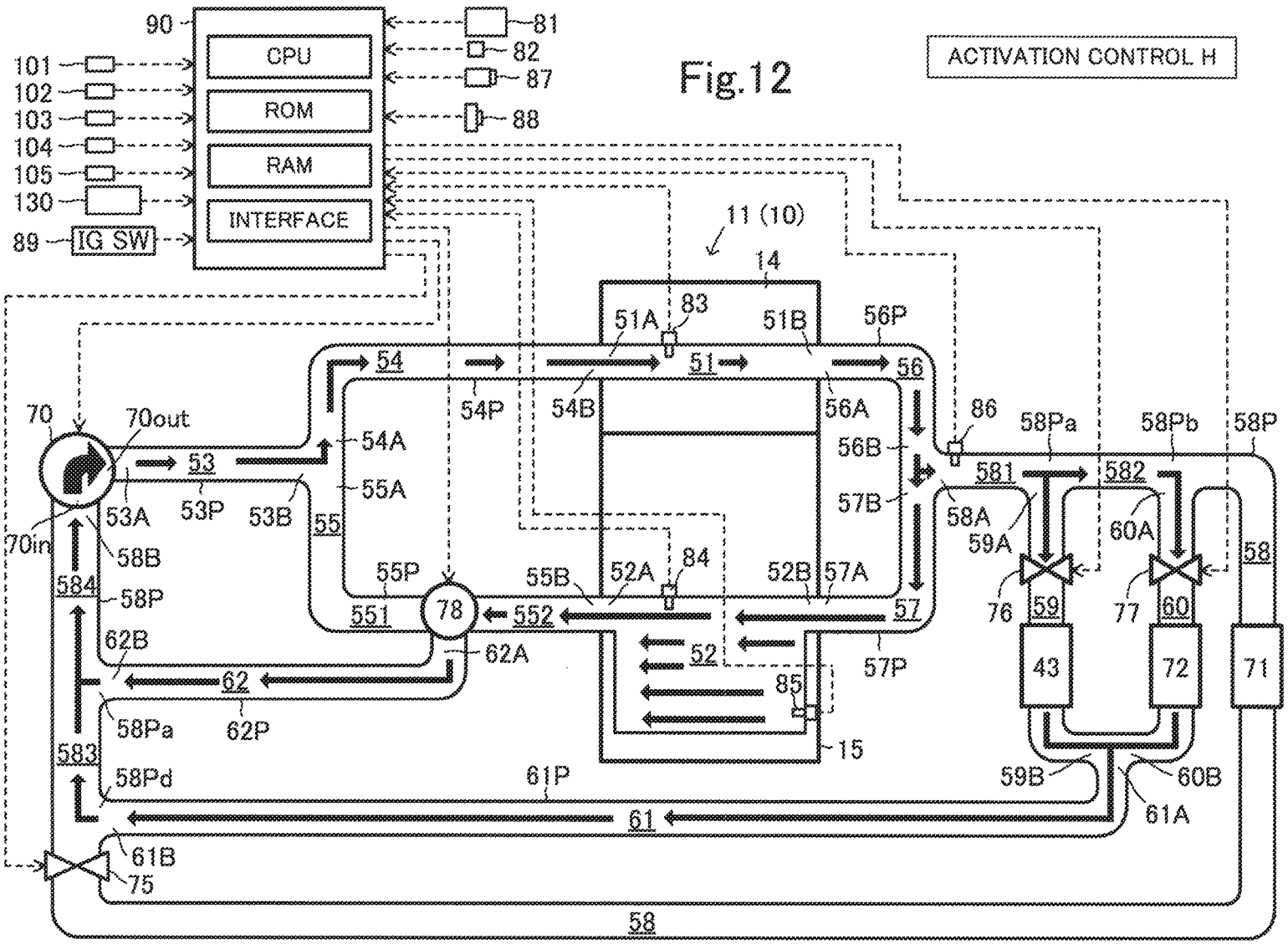
FIG. 12 is a view similar to FIG. 3 and which shows the flow of the cooling water when the cooling apparatus according to the embodiment executes an activation control H.

When the value of the heater core water supply request flag Xht is "1", the CPU determines "Yes" at the step 2210 and then, proceeds with the process to a step 2215 to execute the activation control H to control the activation of the pump 70 and the like (see FIG. 12). Then, the CPU proceeds with the process to the step 2095 of FIG. 20 via a step 2295 to terminate the routine shown in FIG. 20 once.

Figure 10:
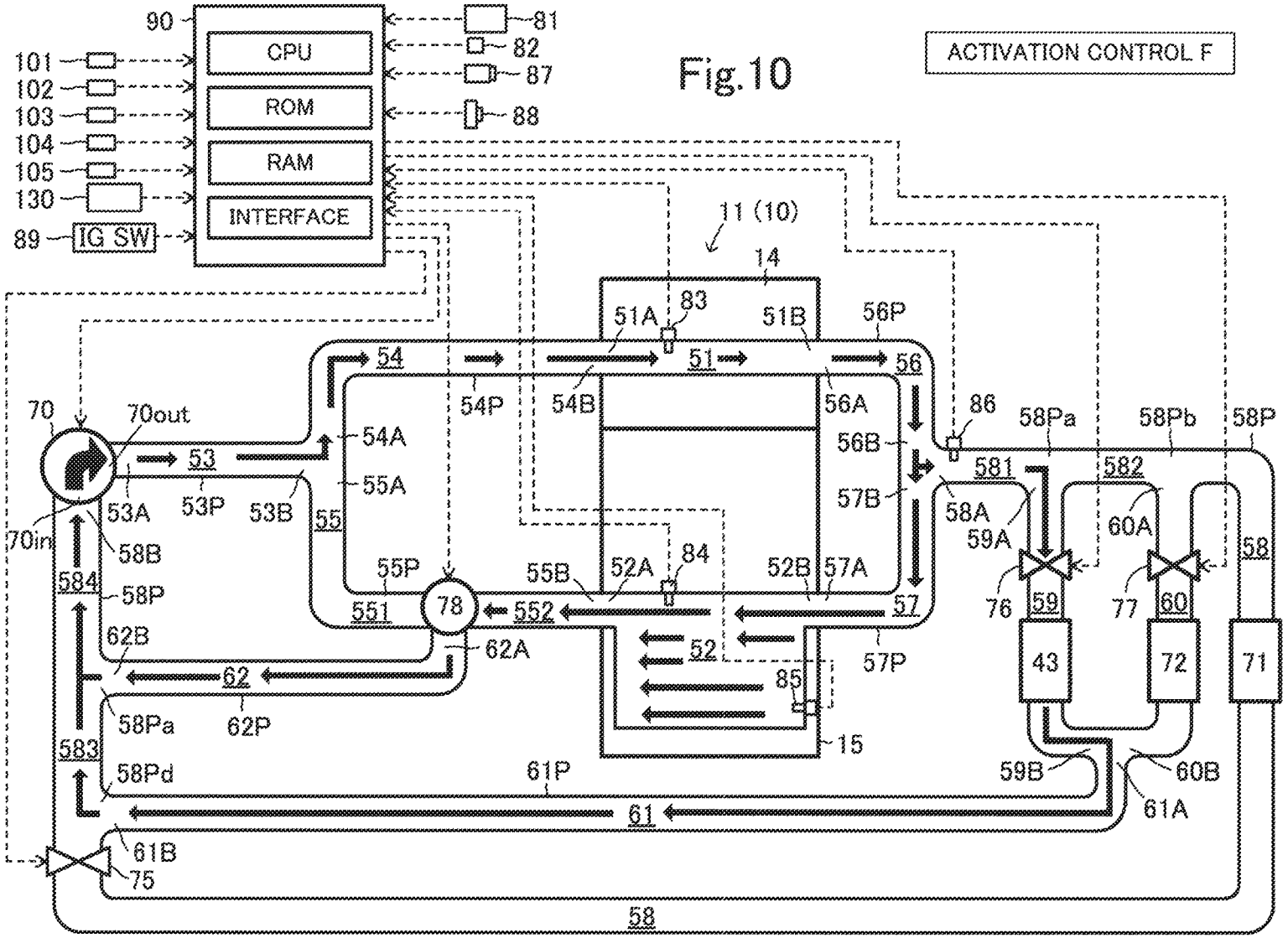
FIG. 10 is a view similar to FIG. 3 and which shows the flow of the cooling water when the cooling apparatus according to the embodiment executes an activation control F.

On the other hand, when the value of the heater core water supply request flag Xht is "0" at a time of the CPU executing the process of the step 2210, the CPU determines "No" at the step 2210 and then, proceeds with the process to a step 2220 to execute the activation control F to control the activation of the pump 70 and the like (see FIG. 10). Then, the CPU proceeds with the process to the step 2095 of FIG. 20 via the step 2295 to terminate the routine shown in FIG. 20 once.

When the value of the EGR cooler water supply request flag Xegr is "0" at a time of the CPU executing the process of the step 2205, the CPU determines "No" at the step 2205 and then, proceeds with the process to a step 2225 to determine whether the value of the heater core water supply request flag Xht is "1".

Figure 11:
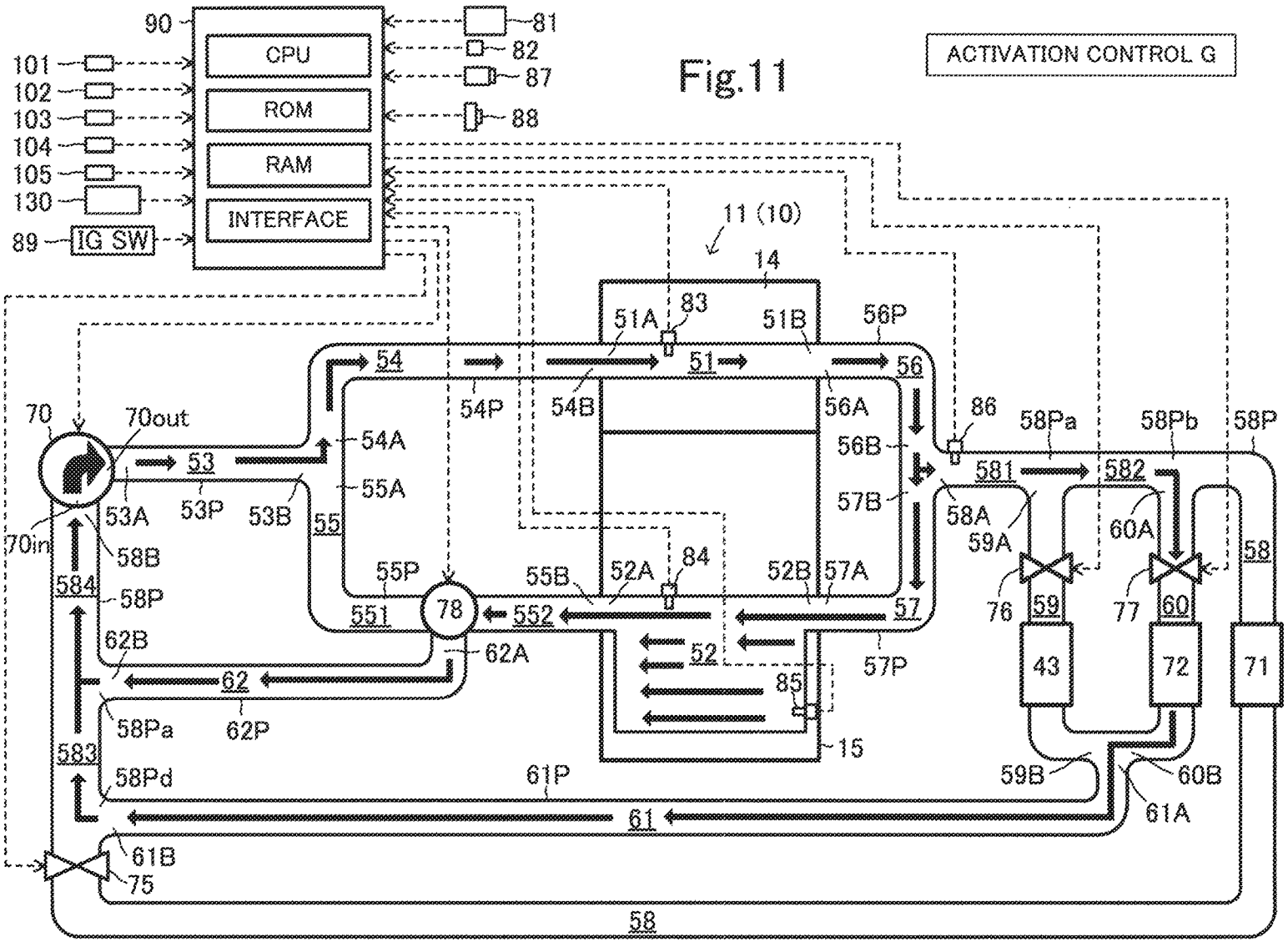
FIG. 11 is a view similar to FIG. 3 and which shows the flow of the cooling water when the cooling apparatus according to the embodiment executes an activation control G.

When the value of the heater core water supply request flag Xht is "1", the CPU determines "Yes" at the step 2225 and then, proceeds with the process to a step 2230 to execute the activation control G to control the activation of the pump 70 and the like (see FIG. 11). Then, the CPU proceeds with the process to the step 2095 of FIG. 20 via the step 2295 to terminate the routine shown in FIG. 20 once.

Figure 9:
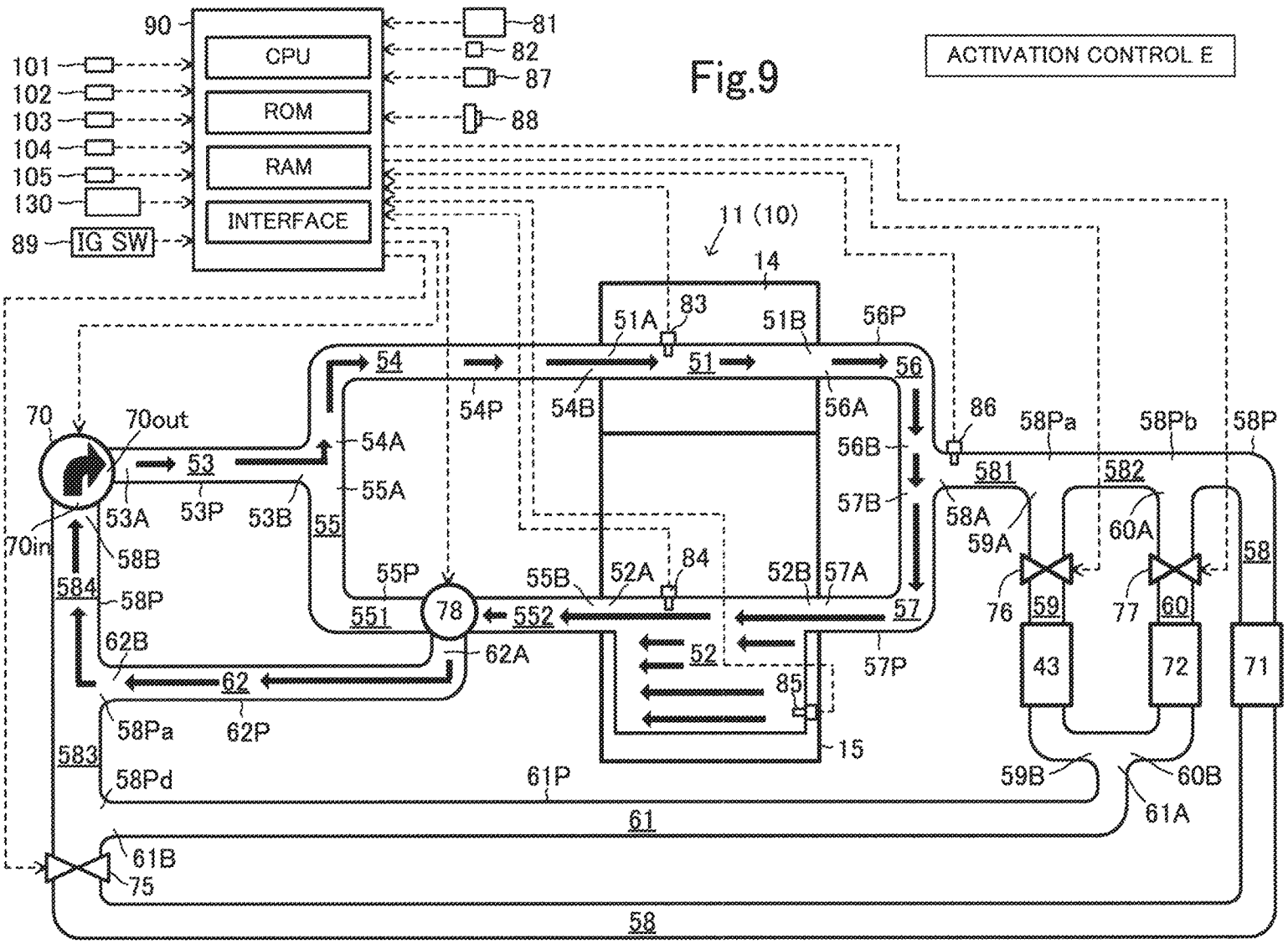
FIG. 9 is a view similar to FIG. 3 and which shows the flow of the cooling water when the cooling apparatus according to the embodiment executes an activation control E.

On the other hand, when the value of the heater core water supply request flag Xht is "0" at a time of the CPU executing the process of the step 2225, the CPU determines "No" at the step 2225 and then, proceeds with the process to a step 2235 to execute the activation control E to control the activation of the pump 70 and the like (see FIG. 9). Then, the CPU proceeds with the process to the step 2095 of FIG. 20 via the step 2295 to terminate the routine shown in FIG. 20 once.

When the first semi-warmed condition Ca1 is not satisfied at a time of the CPU executing the process of the step 2020 of FIG. 20, the CPU determines "No" at the step 2020 and then, proceeds with the process to a step 2030 to determine whether the second semi-warmed condition Ca2 is satisfied.

Figure 23:
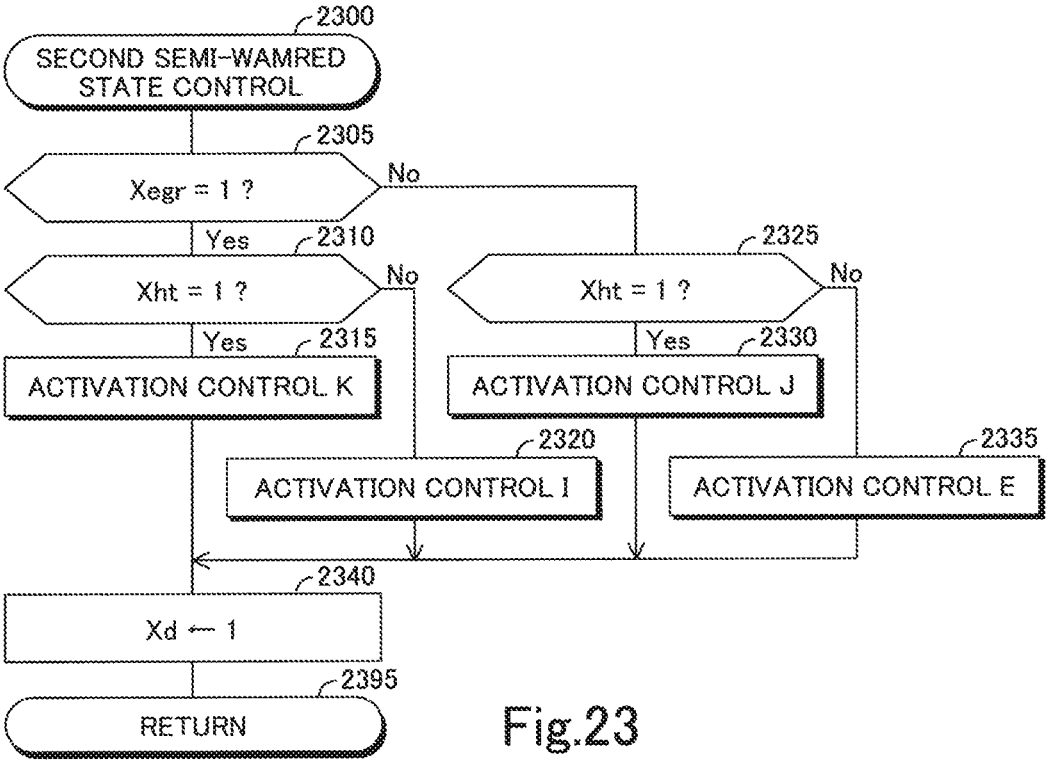
FIG. 23 is a flowchart for showing a routine executed by the CPU.

When the second semi-warmed condition Ca2 is satisfied, the CPU determines "Yes" at the step 2030 and then, proceeds with the process to a step 2035 to execute a second semi-warmed state control routine shown by a flowchart in FIG. 23.

Therefore, when the CPU proceeds with the process to the step 2035, the CPU starts a process from a step 2300 of FIG. 23 and then, proceeds with the process to a step 2305 to determine whether the value of the EGR cooler water supply request flag Xegr is "1", that is, the EGR cooler water supply is requested.

When the value of the EGR cooler water supply request flag Xegr is "1", the CPU determines "Yes" at the step 2305 and then, proceeds with the process to a step 2310 to determine whether the value of the heater core water supply request flag Xht is "1", that is, the heater core water supply is requested.

Figure 15:
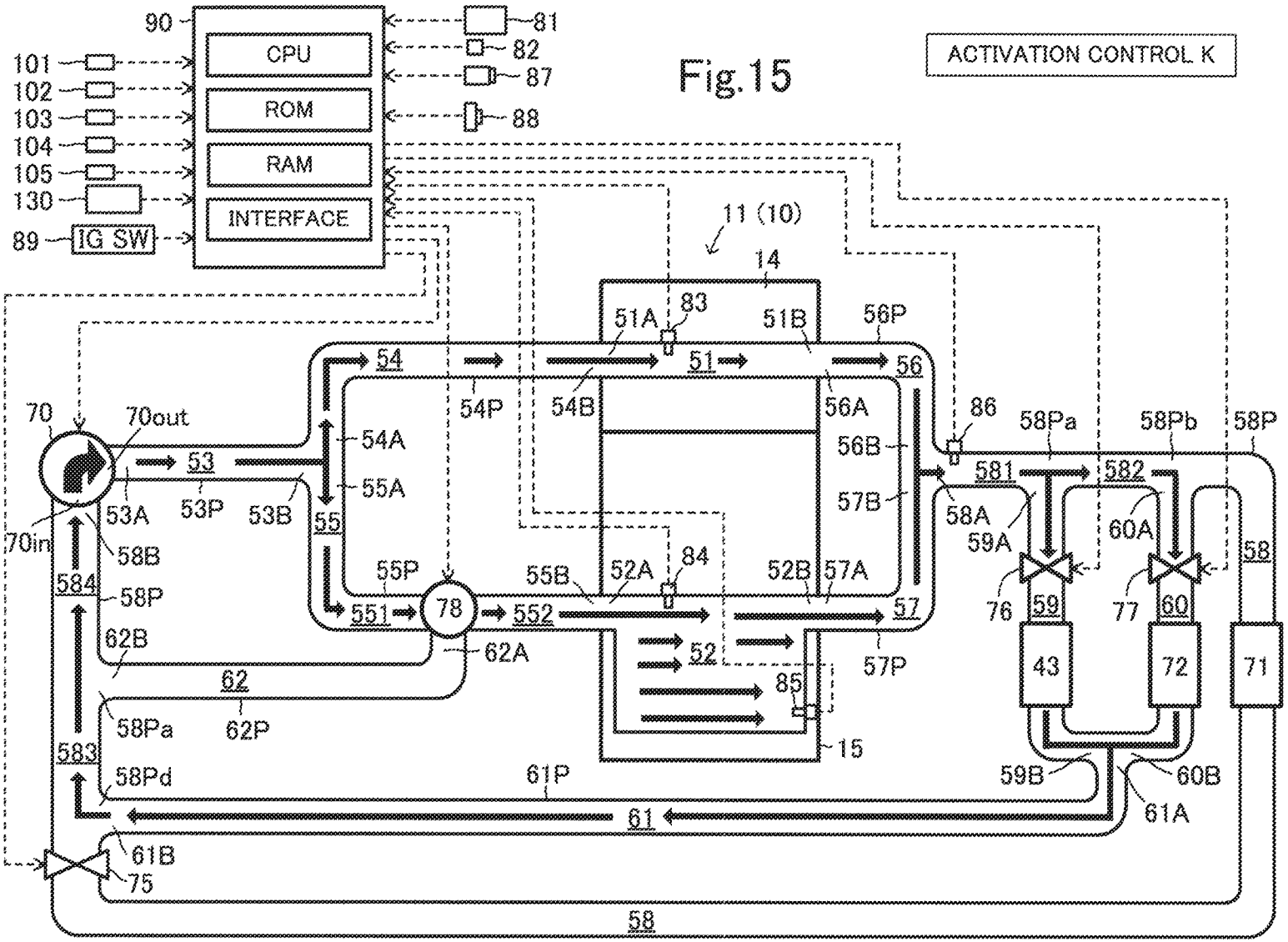
FIG. 15 is a view similar to FIG. 3 and which shows the flow of the cooling water when the cooling apparatus according to the embodiment executes an activation control K.

When the value of the heater core water supply request flag Xht is "1", the CPU determines "Yes" at the step 2310 and then, proceeds with the process to a step 2315 to execute the activation control K to control the activation of the pump 70 and the like (see FIG. 15).

Then, the CPU proceeds with the process to a step 2340 to set a value of a warmed state flag Xd to "1". Then, the CPU proceeds with the process to the step 2095 of FIG. 20 via a step 2395 to terminate the routine shown in FIG. 20 once.

The warmed state flag Xd indicates whether the second semi-warmed condition or the completely-warmed condition is satisfied after the ignition switch 89 is positioned to the ON position. The value of the warmed state flag Xd is set to "0" when the ignition switch 89 is set to the OFF position.

When the value of the warmed state flag Xd is "1", the warmed state flag Xd indicates that the second semi-warmed condition or the completely-warmed condition is satisfied at least once after the ignition switch 89 is set to the ON position. When the value of the warmed state flag Xd is "0", the warmed state flag Xd indicates that the second semi-warmed condition or the completely-warmed condition has not been satisfied after the ignition switch 89 is set to the ON position.

Figure 24:
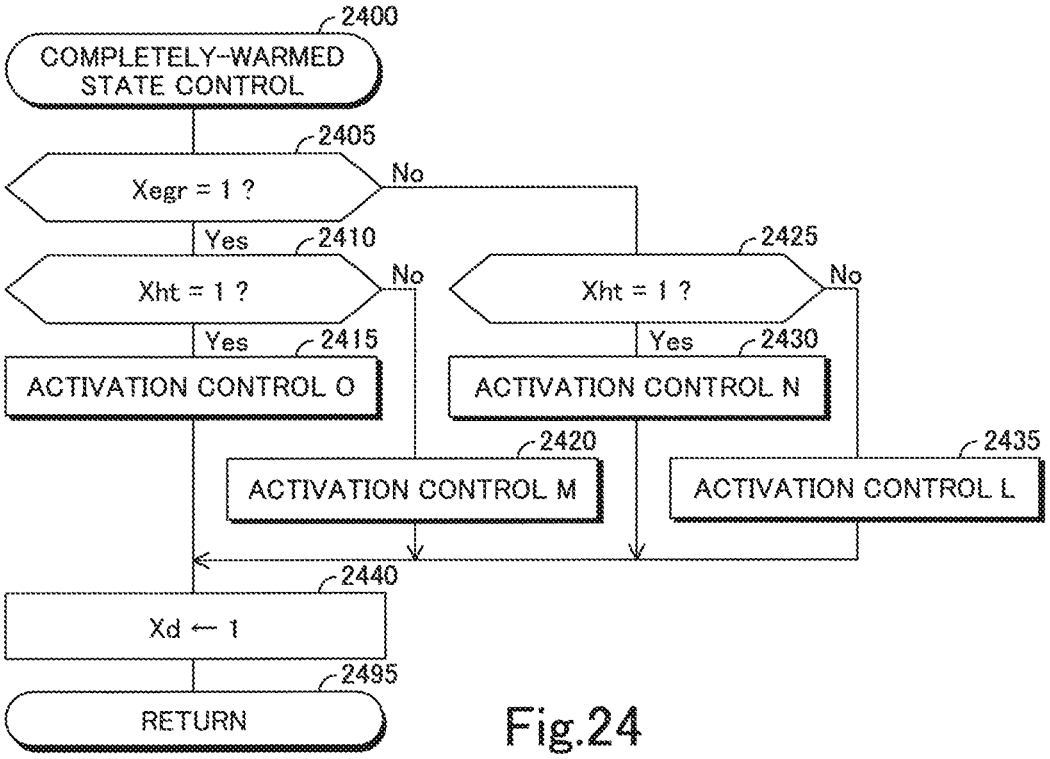
FIG. 24 is a flowchart for showing a routine executed by the CPU.

It should be noted that the activation controls K, I, J, and E executed at the steps 2315, 2320, 2330, and 2335 of FIG. 23 are the second semi-warmed state controls, respectively, and the activation controls O, M, N, and L executed at the steps 2415, 2420, 2430, and 2435 of FIG. 24 are the completely-warmed state controls, respectively.

When the value of the warmed state flag Xd is "1", the CPU determines "No" at the step 2512 or 2522 of FIG. 25 described later. As a result, the second semi-warmed state control is executed even when the cool condition or the first semi-warmed condition is satisfied.

Figure 13:
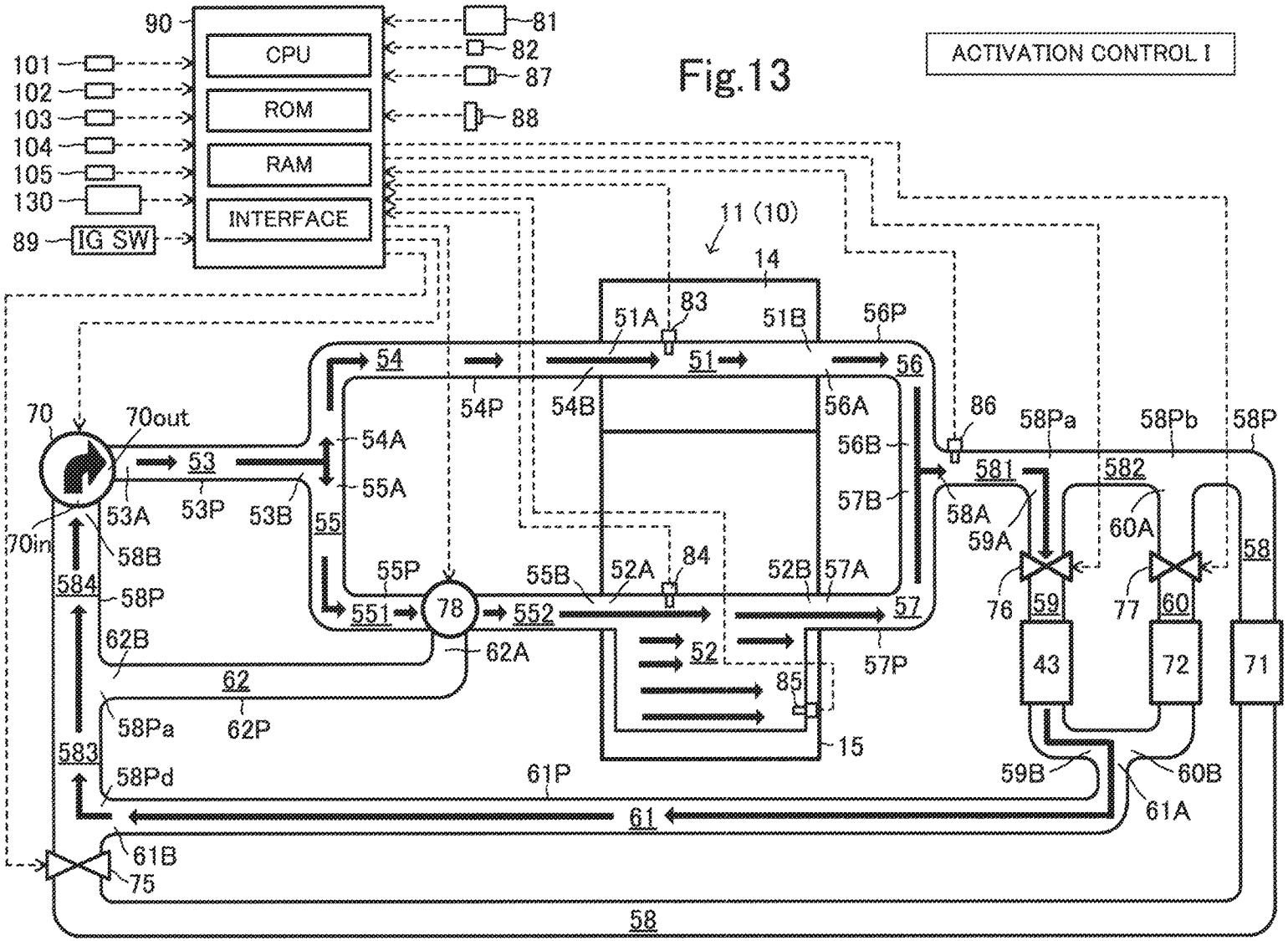
FIG. 13 is a view similar to FIG. 3 and which shows the flow of the cooling water when the cooling apparatus according to the embodiment executes an activation control I.

When the value of the heater core water supply request flag Xht is "0" at a time of the CPU executing the process of the step 2310 of FIG. 23, the CPU determines "No" at the step 2310 and then, proceeds with the process to a step 2320 to execute the activation control I to control the activation of the pump 70 and the like (see FIG. 13). Then, the CPU executes the process of the step 2340 described above and then, proceeds with the process to the step 2095 of FIG. 20 via the step 2395 to terminate the routine shown in FIG. 20 once.

When the value of the EGR cooler water supply request flag Xegr is "0" at a time of the CPU executing the process of the step 2305, the CPU determines "No" at the step 2305 and then, proceeds with the process to a step 2325 to determine whether the value of the heater core water supply request flag Xht is "1".

Figure 14:
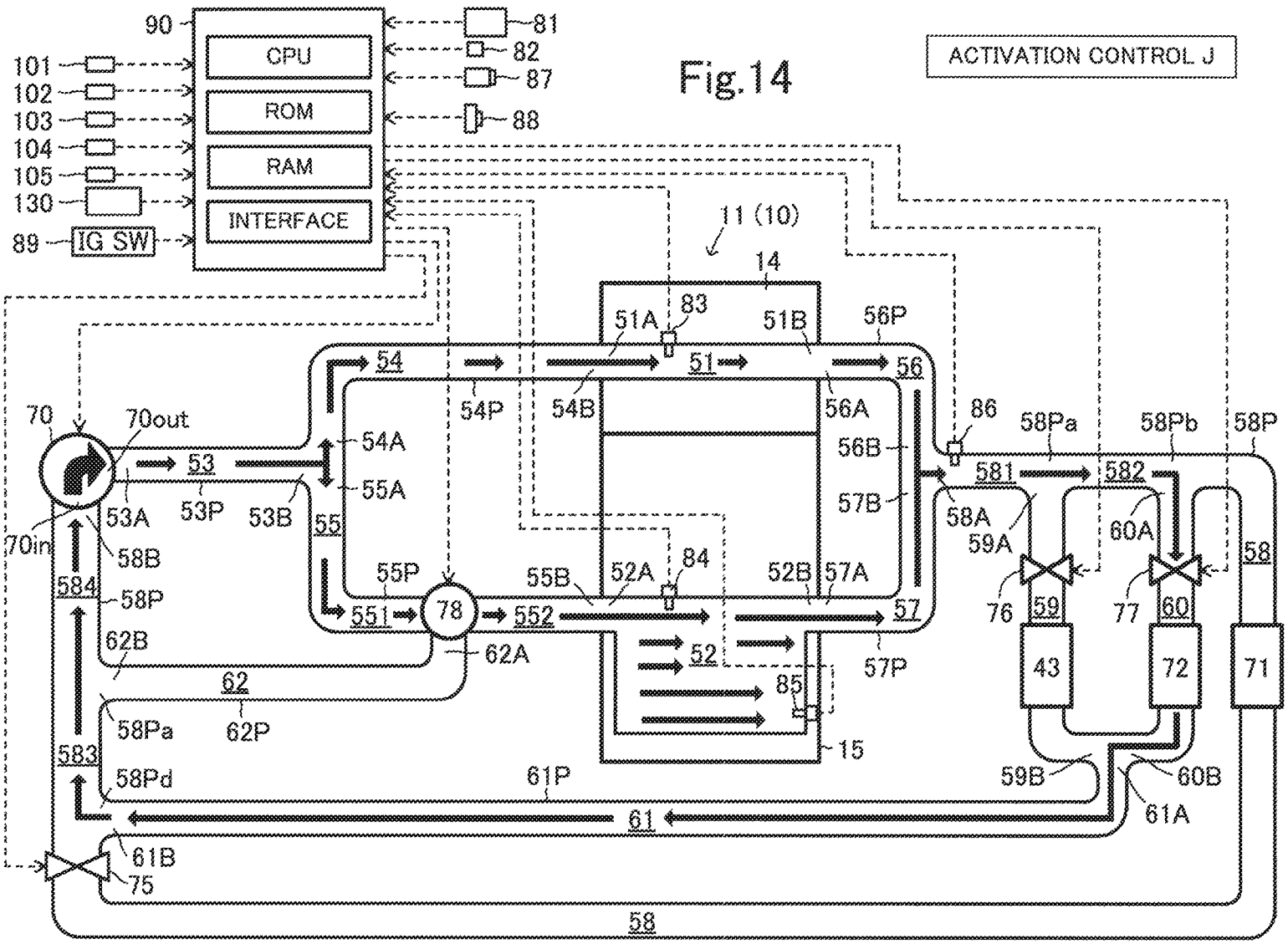
FIG. 14 is a view similar to FIG. 3 and which shows the flow of the cooling water when the cooling apparatus according to the embodiment executes an activation control J.

When the value of the heater core water supply request flag Xht is "1", the CPU determines "Yes" at the step 2325 and then, proceeds with the process to a step 2330 to execute the activation control J to control the activation of the pump 70 and the like (see FIG. 14). Then, the CPU executes the process of the step 2340 described above and then, proceeds with the process to the step 2095 of FIG. 20 via the step 2395 to terminate the routine shown in FIG. 20 once.

On the other hand, when the value of the heater core water supply request flag Xht is "0" at a time of the CPU executing the process of the step 2325, the CPU determines "No" at the step 2325 and then, proceeds with the process to a step 2335 to execute the activation control E to control the activation of the pump 70 and the like (see FIG. 9). Then, the CPU executes the process of the step 2340 described above and then, proceeds with the process to the step 2095 of FIG. 20 via the step 2395 to terminate the routine shown in FIG. 20 once.

When the second semi-warmed condition Ca2 is not satisfied at a time of the CPU executing the process of the step 2030 of FIG. 20, the CPU determines "No" at the step 2030 and then, proceeds with the process to a step 2040 to execute a completely-warmed state control routine shown by a flowchart in FIG. 24.

Therefore, when the CPU proceeds with the process to the step 2040, the CPU starts a process from a step 2400 of FIG. 24 and then, proceeds with the process to a step 2405 to determine whether the value of the EGR cooler water supply request flag Xegr is "1", that is, the EGR cooler water supply is requested.

When the value of the EGR cooler water supply request flag Xegr is "1", the CPU determines "Yes" at the step 2405 and then, proceeds with the process to a step 2410 to determine whether the value of the heater core water supply request flag Xht is "1", that is, the heater core water supply is requested.

Figure 19:
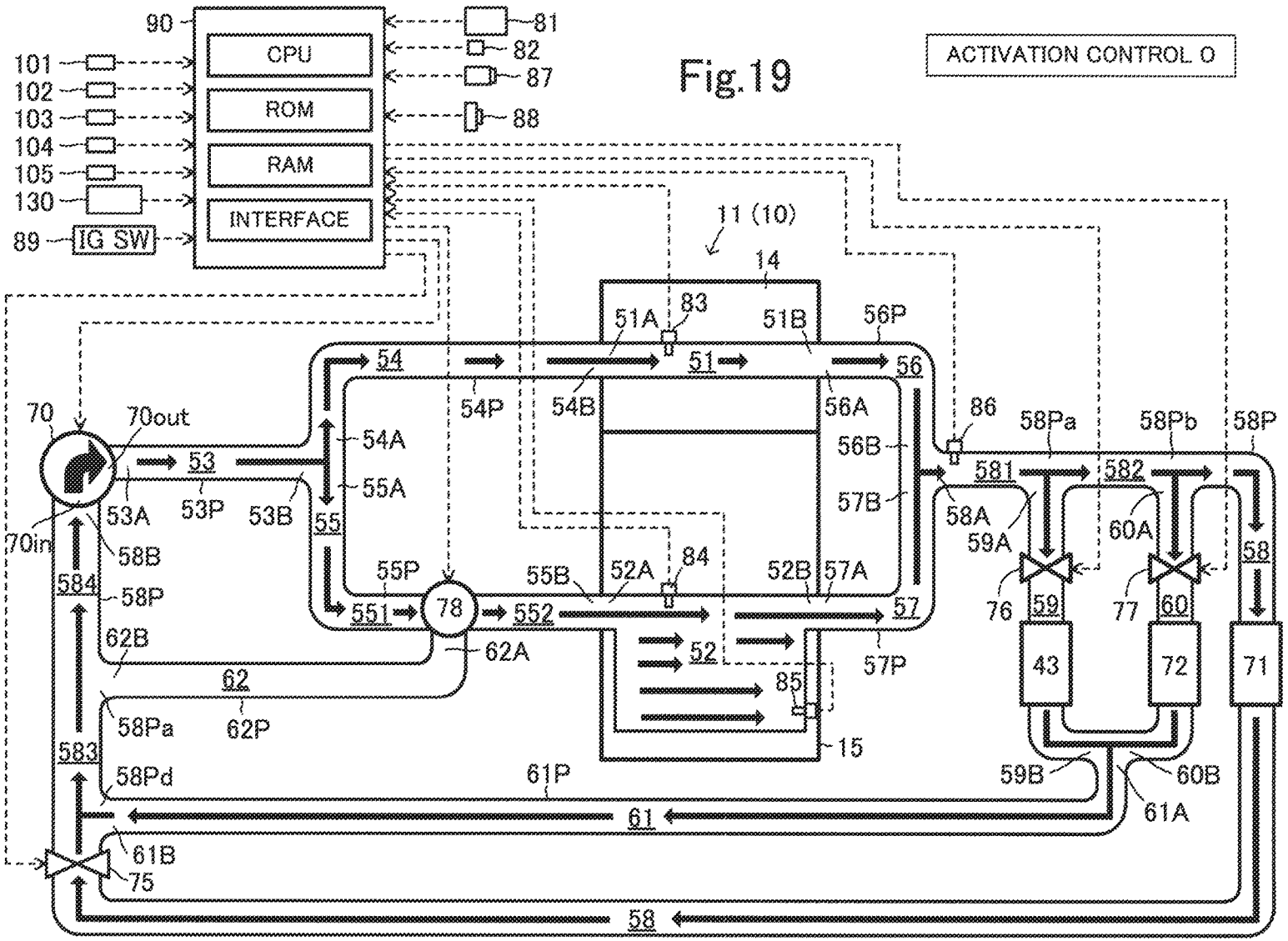
FIG. 19 is a view similar to FIG. 3 and which shows the flow of the cooling water when the cooling apparatus according to the embodiment executes an activation control O.

When the value of the heater core water supply request flag Xht is "1", the CPU determines "Yes" at the step 2410 and then, proceeds with the process to a step 2415 to execute the activation control O to control the activation of the pump 70 and the like (see FIG. 19). Then, the CPU proceeds with the process to a step 2440 to set the value of the warmed state flag Xd to "1". Then, the CPU proceeds with the process to the step 2095 of FIG. 20 via a step 2495 to terminate the routine shown in FIG. 20 once.

Figure 17:
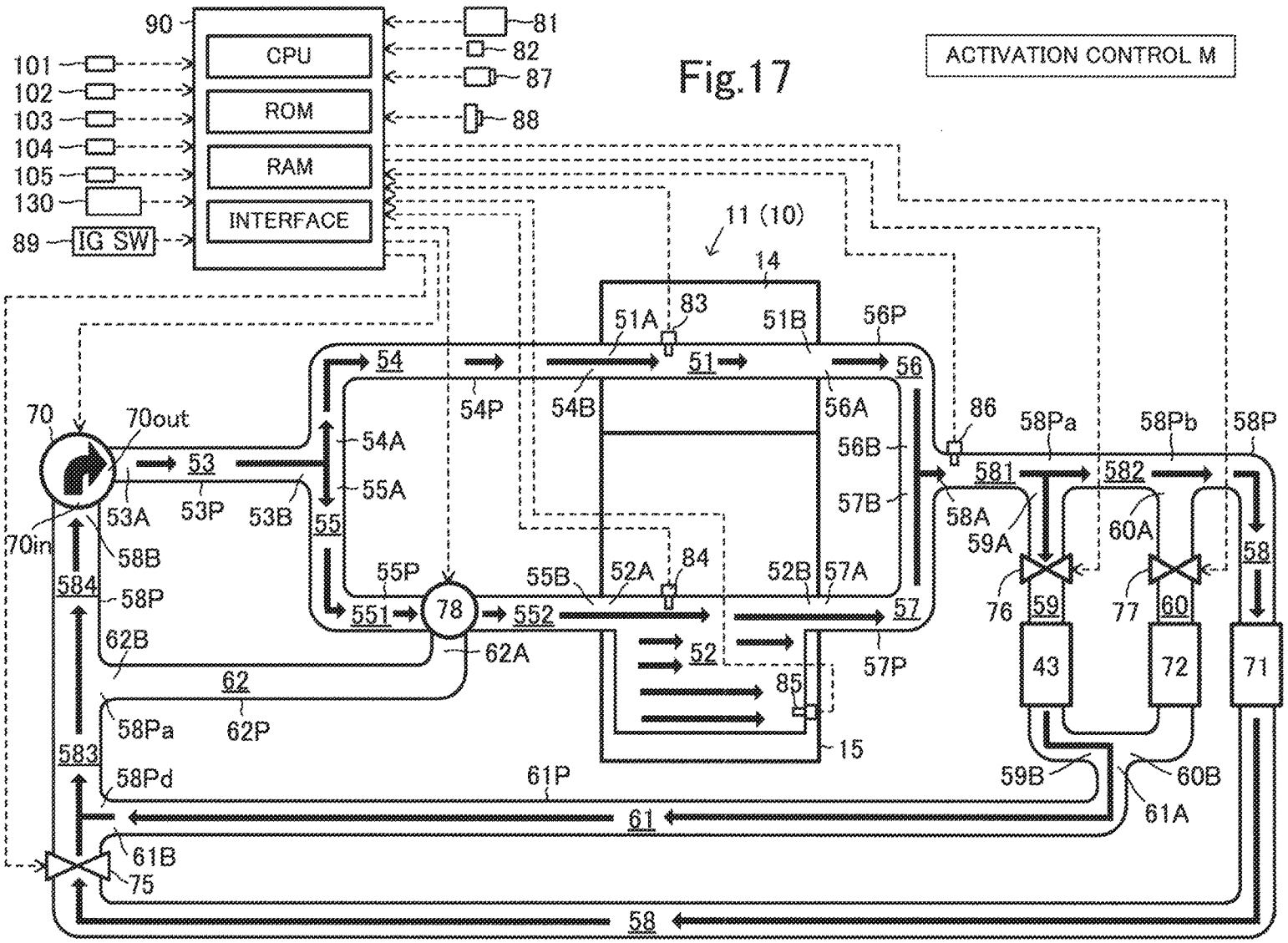
FIG. 17 is a view similar to FIG. 3 and which shows the flow of the cooling water when the cooling apparatus according to the embodiment executes an activation control M.

When the value of the heater core water supply request flag Xht is "0" at a time of the CPU executing the process of the step 2410 of FIG. 24, the CPU determines "No" at the step 2410 and then, proceeds with the process to a step 2420 to execute the activation control M to control the activation of the pump 70 and the like (see FIG. 17). Then, the CPU executes the process of the step 2440 described above and then, proceeds with the process to the step 2095 of FIG. 20 via the step 2495 to terminate the routine shown in FIG. 20 once.

When the value of the EGR cooler water supply request flag Xegr is "0" at a time of the CPU executing the process of the step 2405 of FIG. 24, the CPU determines "No" at the step 2405 and then, proceeds with the process to a step 2425 to determine whether the value of the heater core water supply request flag Xht is "1".

Figure 18:
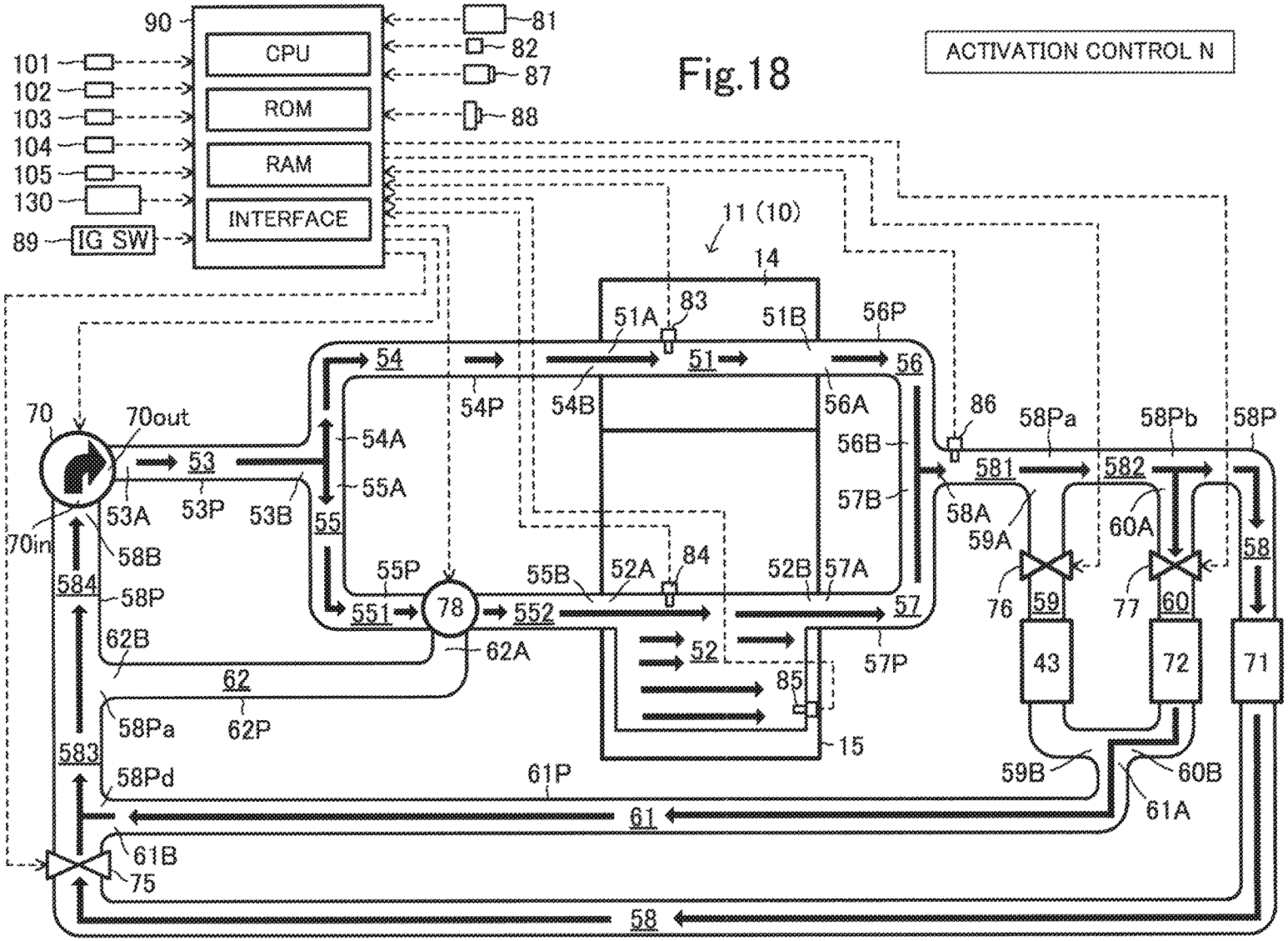
FIG. 18 is a view similar to FIG. 3 and which shows the flow of the cooling water when the cooling apparatus according to the embodiment executes an activation control N.

When the value of the heater core water supply request flag Xht is "1", the CPU determines "Yes" at the step 2425 and then, proceeds with the process to a step 2430 to execute the activation control N to control the activation of the pump 70 and the like (see FIG. 18). Then, the CPU executes the process of the step 2440 described above and then, proceeds with the process to the step 2095 of FIG. 20 via the step 2495 to terminate the routine shown in FIG. 20 once.

Figure 16:
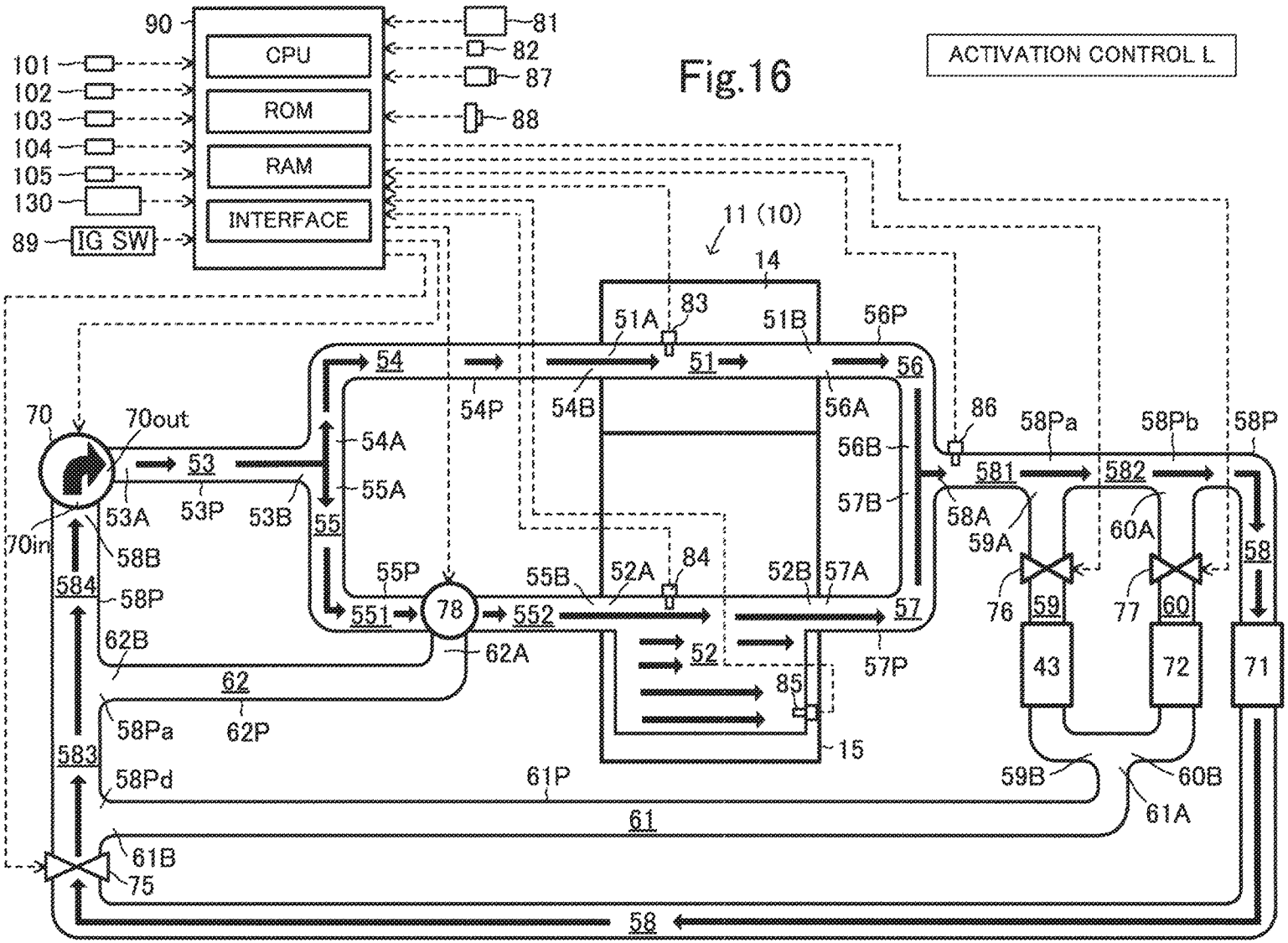
FIG. 16 is a view similar to FIG. 3 and which shows the flow of the cooling water when the cooling apparatus according to the embodiment executes an activation control L.

On the other hand, when the value of the heater core water supply request flag Xht is "0" at a time of the CPU executing the process of the step 2425, the CPU determines "No" at the step 2425 and then, proceeds with the process to a step 2435 to execute the activation control L to control the activation of the pump 70 and the like (see FIG. 16). Then, the CPU executes the process of the step 2440 described above and then, proceeds with the process to the step 2095 of FIG. 20 via the step 2495 to terminate the routine shown in FIG. 20 once.

Figure 25:
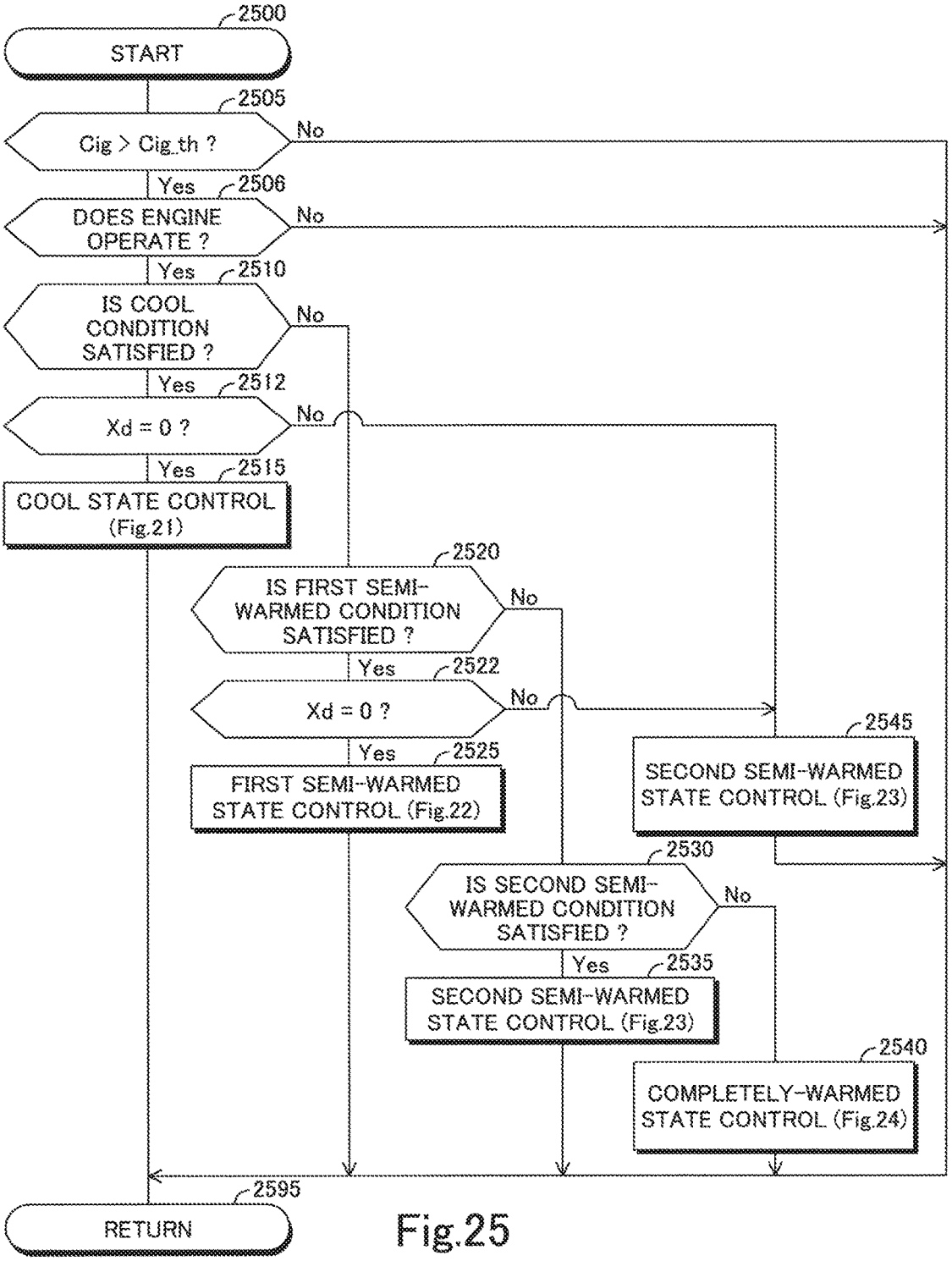
FIG. 25 is a flowchart for showing a routine executed by the CPU.

Further, the CPU is configured or programmed to execute a routine shown by a flowchart in FIG. 25 each time a predetermined time elapses. Therefore, at a predetermined timing, the CPU starts a process from a step 2500 of FIG. 25 and then, proceeds with the process to a step 2505 to determine whether the after-engine-start cycle number Cig is larger than the predetermined after-engine-start cycle number Cig_th.

When the after-engine-start cycle number Cig is equal to or smaller than the predetermined after-engine-start cycle number Cig_th, the CPU determines "No" at the step 2505 and then, proceeds with the process to a step 2595 to terminate this routine once.

On the other hand, when the after-engine-start cycle number Cig is larger than the predetermined after-engine-start cycle number Cig_th, the CPU determines "Yes" at the step 2505 and then, proceeds with the process to a step 2506 to determine whether the engine 10 operates. When the engine 10 does not operates, the CPU determines "No" at the step 2506 and then, proceeds with the process to the step 2595 to terminate this routine once.

On the other hand, when the engine 10 operates, the CPU determines "Yes" at the step 2506 and then, proceeds with the process to a step 2510 to determine whether the cool condition Cbc is satisfied. When the cool condition Cbc is satisfied, the CPU determines "Yes" at the step 2510 and then, proceeds with the process to a step 2512 to determine whether the value of the warmed state flag Xd is "0". When the value of the warmed state flag Xd is "0", the CPU determines "Yes" at the step 2512 and then, proceeds with the process to a step 2515 to execute the aforementioned cool state control routine shown in FIG. 21. Then, the CPU proceeds with the process to the step 2595 to terminate this routine once.

When the value of the warmed state flag Xd is "1" at a time of the CPU executing a process of the step 2512, that is, the second semi-warmed condition or the completely-warmed condition is satisfied once after the ignition switch 89 is set to the ON position, the CPU determines "No" at the step 2512 and then, proceeds with the process to a step 2545 to execute the aforementioned second semi-warmed state control routine shown in FIG. 23. Then, the CPU proceeds with the process to the step 2595 to terminate this routine once.

When the cool condition Cbc is not satisfied at a time of the CPU executing the process of the step 2510 of FIG. 25, the CPU determines "No" at the step 2510 and then, proceeds with the process to a step 2520 to determine whether the first semi-warmed condition Cb1 is satisfied.

When the first semi-warmed condition Cb1 is satisfied, the CPU determines "Yes" at the step 2520 and then, proceeds with the process to a step 2522 to determine whether the value of the warmed state flag Xd is "0". When the value of the warmed state flag Xd is "0", the CPU determines "Yes" at the step 2522 and then, proceeds with the process to a step 2525 to execute the aforementioned first semi-warmed state control routine shown in FIG. 22. Then, the CPU proceeds with the process to the step 2595 to terminate this routine once.

When the value of the warmed state flag Xd is "1" at a time of the CPU executing a process of the step 2522, that is, the second semi-warmed condition or the completely-warmed condition is satisfied once after the ignition switch 89 is set to the ON position, the CPU determines "No" at the step 2522 and then, proceeds with the process to the step 2545 to execute the aforementioned second semi-warmed state control routine shown in FIG. 23. Then, the CPU proceeds with the process to the step 2595 to terminate this routine once.

When the first semi-warmed condition Cb1 is not satisfied at a time of the CPU executing the process of the step 2520 of FIG. 25, the CPU determines "No" at the step 2520 and then, proceeds with the process to a step 2530 to determine whether the second semi-warmed condition Cb2 is satisfied. When the second semi-warmed condition Cb2 is satisfied, the CPU determines "Yes" at the step 2530 and then, proceeds with the process to a step 2535 to execute the aforementioned second semi-warmed state control routine shown in FIG. 23. Then, the CPU proceeds with the process to the step 2595 to terminate this routine once.

When the second semi-warmed condition Cb2 is not satisfied at a time of the CPU executing the process of the step 2530, the CPU determines "No" at the step 2530 and then, proceeds with the process to a step 2540 to execute the aforementioned completely-warmed state control routine shown in FIG. 24. Then, the CPU proceeds with the process to the step 2595 to terminate this routine once.

Figure 26:
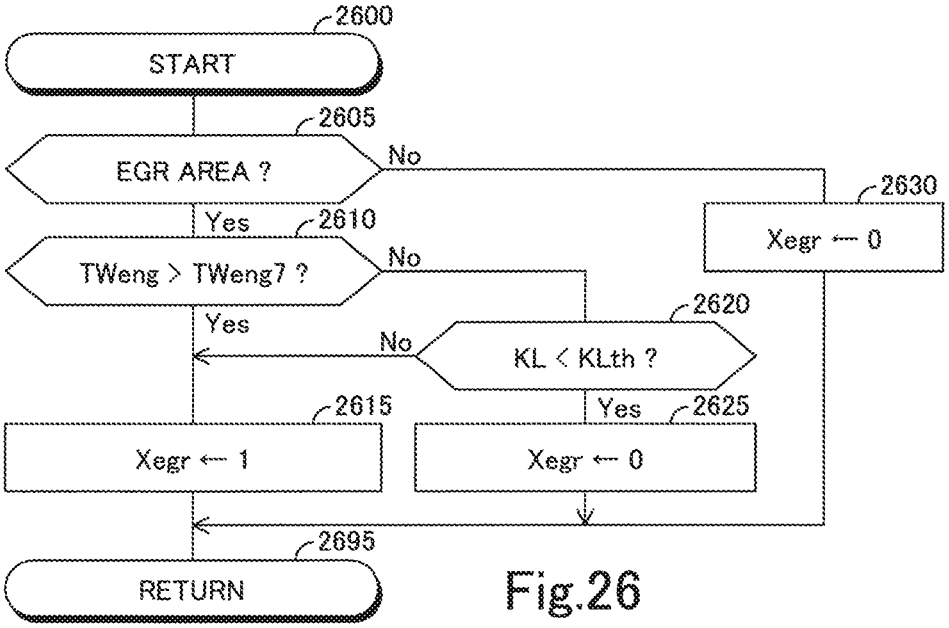
FIG. 26 is a flowchart for showing a routine executed by the CPU.

Further, the CPU is configured or programmed to execute a routine shown by a flowchart in FIG. 26 each time a predetermined time elapses. Therefore, at a predetermined timing, the CPU starts a process from a step 2600 of FIG. 26 and then, proceeds with the process to a step 2605 to determine whether the engine operation state is in the EGR area Rb.

When the engine operation state is in the EGR area Rb, the CPU determines "Yes" at the step 2605 and then, proceeds with the process to a step 2610 to determine whether the engine water temperature TWeng is higher than the seventh engine water temperature TWeng7.

When the engine water temperature TWeng is higher than the seventh engine water temperature TWeng7, the CPU determines "Yes" at the step 2610 and then, proceeds with the process to a step 2615 to set the value of the EGR cooler water supply request flag Xegr to "1". Then, the CPU proceeds with the process to a step 2695 to terminate this routine once.

On the other hand, when the engine water temperature TWeng is equal to or lower than the seventh engine water temperature TWeng7, the CPU determines "No" at the step 2610 and then, proceeds with the process to a step 2620 to determine whether the engine load KL is smaller than the threshold engine load KLth.

When the engine load KL is smaller than the threshold engine load KLth, the CPU determines "Yes" at the step 2620 and then, proceeds with the process to a step 2625 to set the value of the EGR cooler water supply request flag Xegr to "0". Then, the CPU proceeds with the process to the step 2695 to terminate this routine once.

On the other hand, when the engine load KL is equal to or larger than the threshold engine load KLth, the CPU determines "No" at the step 2620 and then, proceeds with the process to the step 2615 to set the value of the EGR cooler water supply request flag Xegr to "1". Then, the CPU proceeds with the process to the step 2695 to terminate this routine once.

When the engine operation state is not in the EGR area Rb at a time of the CPU executing a process of the step 2605, the CPU determines "No" at the step 2605 and then, proceeds with the process to a step 2630 to set the value of the EGR cooler water supply request flag Xegr to "0". Then, the CPU proceeds with the process to the step 2695 to terminate this routine once.

Figure 27:
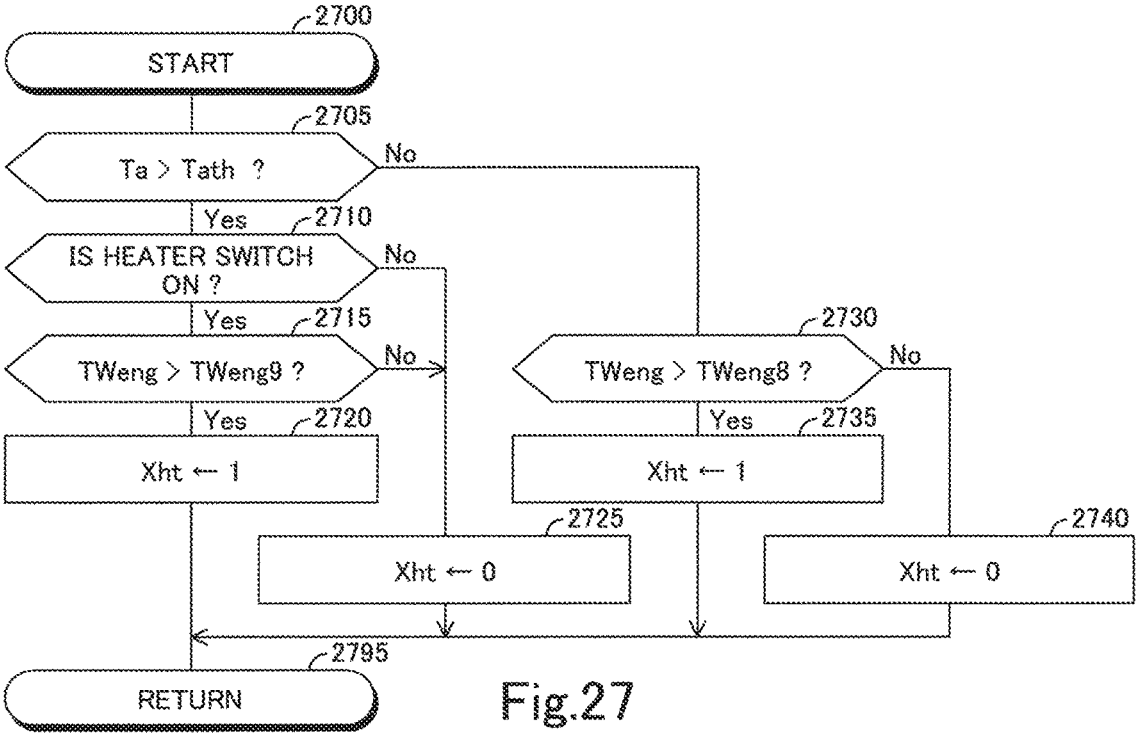
FIG. 27 is a flowchart for showing a routine executed by the CPU.

Further, the CPU is configured or programmed to execute a routine shown by a flowchart in FIG. 27 each time a predetermined time elapses. Therefore, at a predetermined timing, the CPU starts a process from a step 2700 of FIG. 27 and then, proceeds with the process to a step 2705 to determine whether the outside air temperature Ta is higher than the threshold temperature Tath.

When the outside air temperature Ta is higher than the threshold temperature Tath, the CPU determines "Yes" at the step 2705 and then, proceeds with the process to a step 2710 to determine whether the heater switch 88 is set to the ON position.

When the heater switch 88 is set to the ON position, the CPU determines "Yes" at the step 2710 and then, proceeds with the process to a step 2715 to determine whether the engine water temperature TWeng is higher than the ninth engine water temperature TWeng9.

When the engine water temperature TWeng is higher than the ninth engine water temperature TWeng9, the CPU determines "Yes" at the step 2715 and then, proceeds with the process to a step 2720 to set the value of the heater core water supply request flag Xht to "1". Then, the CPU proceeds with the process to a step 2795 to terminate this routine once.

On the other hand, when the engine water temperature TWeng is equal to or lower than the ninth engine water temperature TWeng9, the CPU determines "No" at the step 2715 and then, proceeds with the process to a step 2725 to set the value of the heater core water supply request flag Xht to "0". Then, the CPU proceeds with the process to the step 2795 to terminate this routine once.

When the heater switch 88 is set to the OFF position at a time of the CPU executing a process of the step 2710, the CPU determines "No" at the step 2710 and then, proceeds with the process to the step 2725 to set the value of the heater core water supply request flag Xht to "0". Then, the CPU proceeds with the process to the step 2795 to terminate this routine once.

When the outside air temperature Ta is equal to or lower than the threshold temperature Tath at a time of the CPU executing a process of the step 2705, the CPU determines "No" at the step 2705 and then, proceeds with the process to a step 2730 to determine whether the engine water temperature TWeng is higher than the eighth engine water temperature TWeng8.

When the engine water temperature TWeng is higher than the eighth engine water temperature TWeng8, the CPU determines "Yes" at the step 2730 and then, proceeds with the process to a step 2735 to set the value of the heater core water supply request flag Xht to "1". Then, the CPU proceeds with the process to the step 2795 to terminate this routine once.

On the other hand, when the engine water temperature TWeng is equal to or lower than the eighth engine water temperature TWeng8, the CPU determines "No" at the step 2730 and then, proceeds with the process to a step 2740 to set the value of the heater core water supply request flag Xht to "0". Then, the CPU proceeds with the process to the step 2795 to terminate this routine once.

Figure 28:
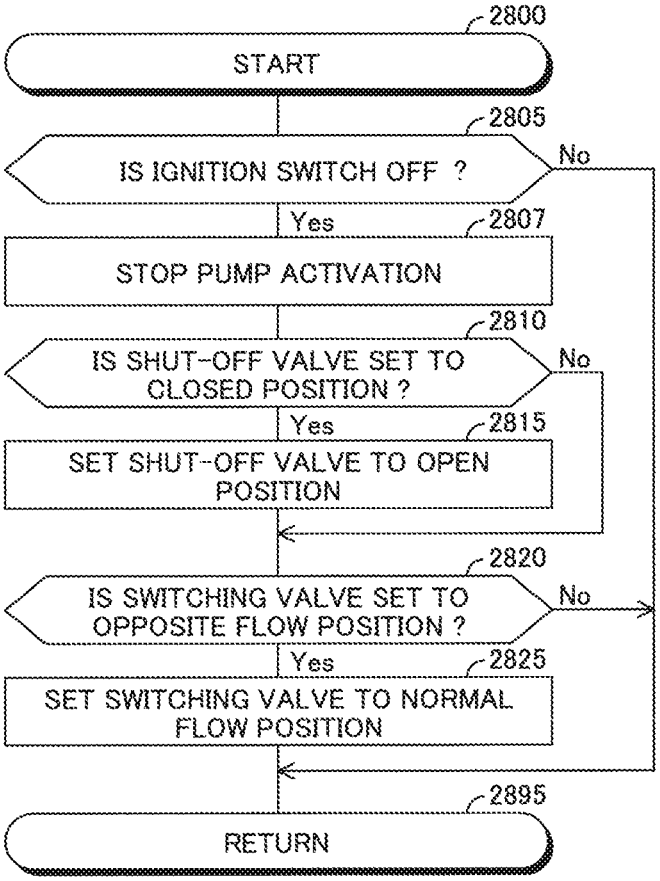
FIG. 28 is a flowchart for showing a routine executed by the CPU.

Further, the CPU is configured or programmed to execute a routine shown by a flowchart in FIG. 28 each time a predetermined time elapses. Therefore, at a predetermined timing, the CPU starts a process from a step 2800 of FIG. 28 and then, proceeds with the process to a step 2805 to determine whether the ignition OFF operation is performed.

When the ignition OFF operation is performed, the CPU determines "Yes" at the step 2805 and then, proceeds with the process to a step 2807 to stop the activation of the pump 70. Then, the CPU proceeds with the process to a step 2810 to determine whether the shut-off valve 75 is set to the closed position.

When the shut-off valve 75 is set to the closed position, the CPU determines "Yes" at the step 2810 and then, proceeds with the process to a step 2815 to set the shut-off valve 75 to the closed position. Then, the CPU proceeds with the process to a step 2820.

On the other hand, when the shut-off valve 75 is set to the open position, the CPU determines "No" at the step 2810 and then, proceeds with the process directly to the step 2820.

When the CPU proceeds with the process to the step 2820, the CPU determines whether the switching valve 78 is set to the opposite flow position. When the switching valve 78 is set to the opposite flow position, the CPU determines "Yes" at the step 2820 and then, proceeds with the process to a step 2825 to set the switching valve 78 to the normal flow position. Then, the CPU proceeds with the process to a step 2895 to terminate this routine once.

On the other hand, when the switching valve 78 is set to the normal flow position at a time of the CPU executing a process of the step 2820, the CPU determines "No" at the step 2820 and then, proceeds with the process directly to the step 2895 to terminate this routine once.

When the ignition OFF operation is not performed at a time of the CPU executing a process of the step 2805, the CPU determines "No" at the step 2805 and then, proceeds with the process directly to the step 2895 to terminate this routine once.

The concrete operation of the embodiment apparatus has been described. Thereby, the engine temperature Teng increases at the large rate, and the EGR cooler water supply and the heater core water supply are accomplished in response to the EGR cooler water supply request and the heater core water supply request until the warming of the engine 10 is completed.

It should be noted that the present invention is not limited to the aforementioned embodiment, and various modifications can be employed within the scope of the present invention.

First Modified Example

Figure 29:
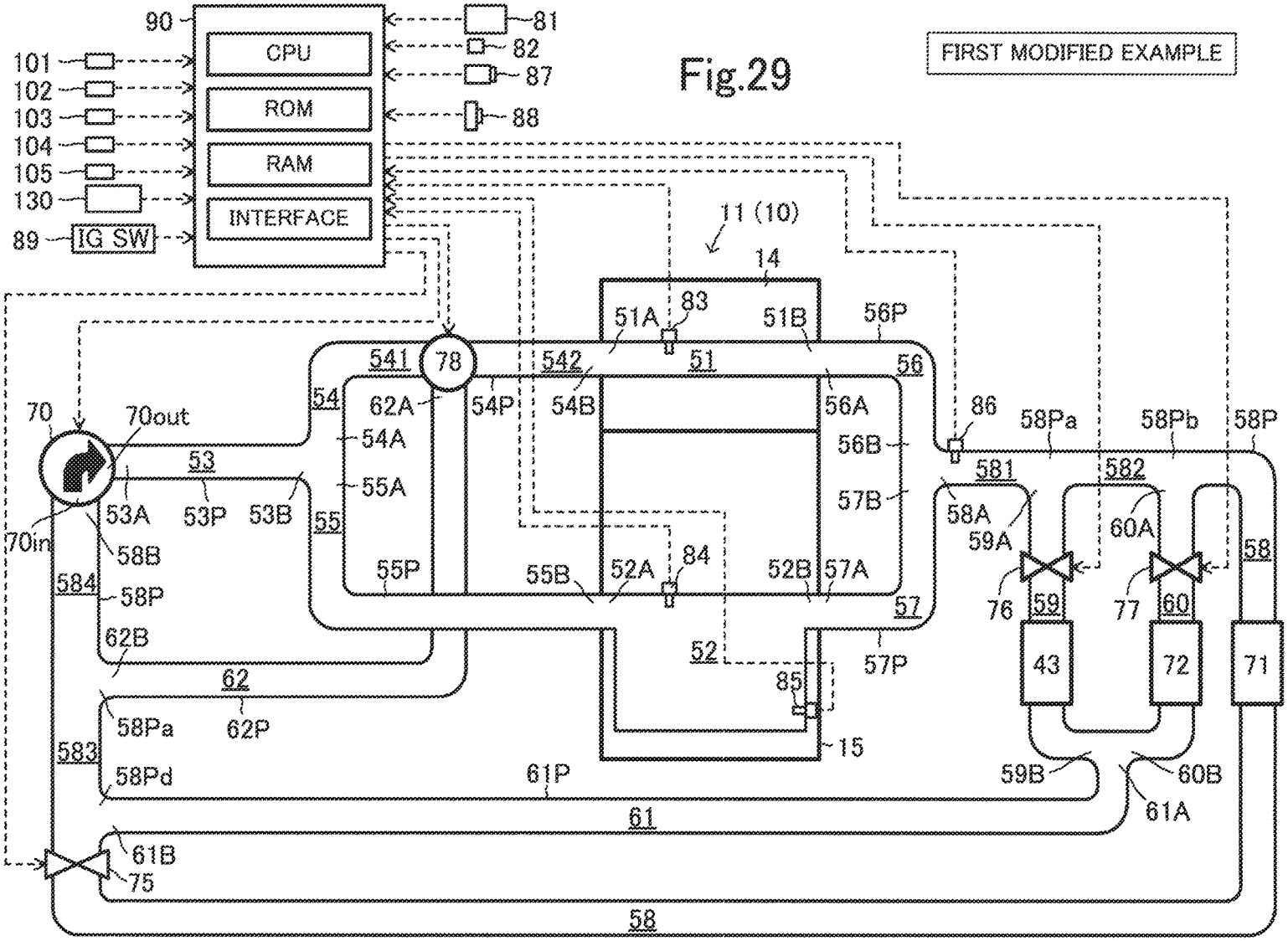
FIG. 29 is a view for showing a cooling apparatus according to a first modified example of the embodiment of the invention.

For example, the embodiment apparatus may be modified to be a cooling apparatus shown in FIG. 29. In the cooling apparatus shown in FIG. 29 according to a first modified example of the embodiment (hereinafter, will be referred to as "the first modified apparatus"), the switching valve 78 is provided in the cooling water pipe 54P, not in the cooling water pipe 55P. The first end 61A of the cooling water pipe 62P is connected to the switching valve 78.

When the switching valve 78 is set to the normal flow position, the switching valve 78 permits the flow of the cooling water between a first portion 541 of the water passage 54 and a second portion 542 of the water passage 54 and shuts off the flow of the cooling water between the first portion 541 of the water passage 54 and the water passage 62, and the flow of the cooling water between the second portion 542 of the water passage 54 and the water passage 62. The first portion 541 is a portion of the water passage 54 between the switching valve 78 and the first end 54A of the cooling water pipe 54P. The second portion 542 is a portion of the water passage 54 between the switching valve 78 and the second end 54B of the cooling water pipe 54P.

When the switching valve 78 is set to the opposite flow position, the switching valve 78 permits the flow of the cooling water between the second portion 542 of the water passage 54 and the water passage 62 and shuts off the flow of the cooling water between the first portion 541 of the water passage 54 and the second portion 542 of the water passage 54.

When the switching valve 78 is set to the shut-off position, the switching valve 78 shuts off the flow of the cooling water between the first portion 541 of the water passage 54 and the second portion 542 of the water passage 54, the flow of the cooling water between the first portion 541 of the water passage 54 and the water passage 62, and the flow of the cooling water between the second portion 542 of the water passage 54 and the water passage 62.

<Operation of First Modified Apparatus>

The first modified apparatus executes the activation controls A to O, similar to the embodiment apparatus. Conditions for executing the activation controls A to O in the first modified apparatus are the same as the conditions of executing the activation controls A to O, respectively. Below, the activation controls E and L among the activation controls A to O executed by the first modified apparatus will be described.

<Activation Control E>

According to the activation control E, the first modified apparatus activates the pump 70, sets the shut-off valve 75 to 77 to the closed positions, respectively, and sets the switching valve 78 to the opposite flow position. When the first modified apparatus executes the activation control E, the cooling water circulates as shown by arrows in FIG. 30.

According to the activation control E, the cooling water is discharged to the water passage 53 via the pump discharging opening 70out and then, flows into the block water passage 52 through the water passage 55. The cooling water flowing into the block water passage 52, flows through the block water passage 52 and then, flows into the head water passage 51 through the water passages 57 and 56. The cooling water flowing into the head water passage 51, flows through the head water passage 51 and then, flows through the second portion 542 of the water passage 54, the water passage 62, and the fourth portion 584 of the radiator water passage 58. Then, the cooling water is suctioned into the pump 70 via the pump suctioning opening 70in.

Thereby, the cooling water having a temperature increased by flowing through the head water passage 51, flows through the second portion 542 of the water passage 54, the switching valve 78, the water passage 62, the fourth portion 584 of the radiator water passage 58, the pump 70, the water passage 53, and the water passage 55. Then, the cooling water flows into the block water passage 52. In this case, the cooling water discharged from the head water passage 51 flows into the block water passage 52 without flowing through the radiator 71 and the like. The temperature of the cooling water is increased while the cooling water flows through the head water passage 51. Therefore, the cooling water having a high temperature is supplied to the block water passage 52. Thus, the block temperature Tbr increases at the large rate, compared with when the cooling water is supplied to the block water passage 52 through the radiator 71 and the like.

In addition, the cooling water is supplied to the head water passage 51 without flowing through the radiator 71 and the like. Thus, the head temperature Thd increases at the large rate, compared with when the cooling water is supplied to the head water passage 51 through the radiator 71 and the like.

In addition, the cooling water flows through the head and block water passages 51 and 52. Thus, the temperature of a part of the cooling water is prevented from increasing excessively in the head and block water passages 51 and 52. As a result, the cooling water is prevented from boiling in the head and block water passages 51 and 52.

<Activation Control L>

Figure 31:
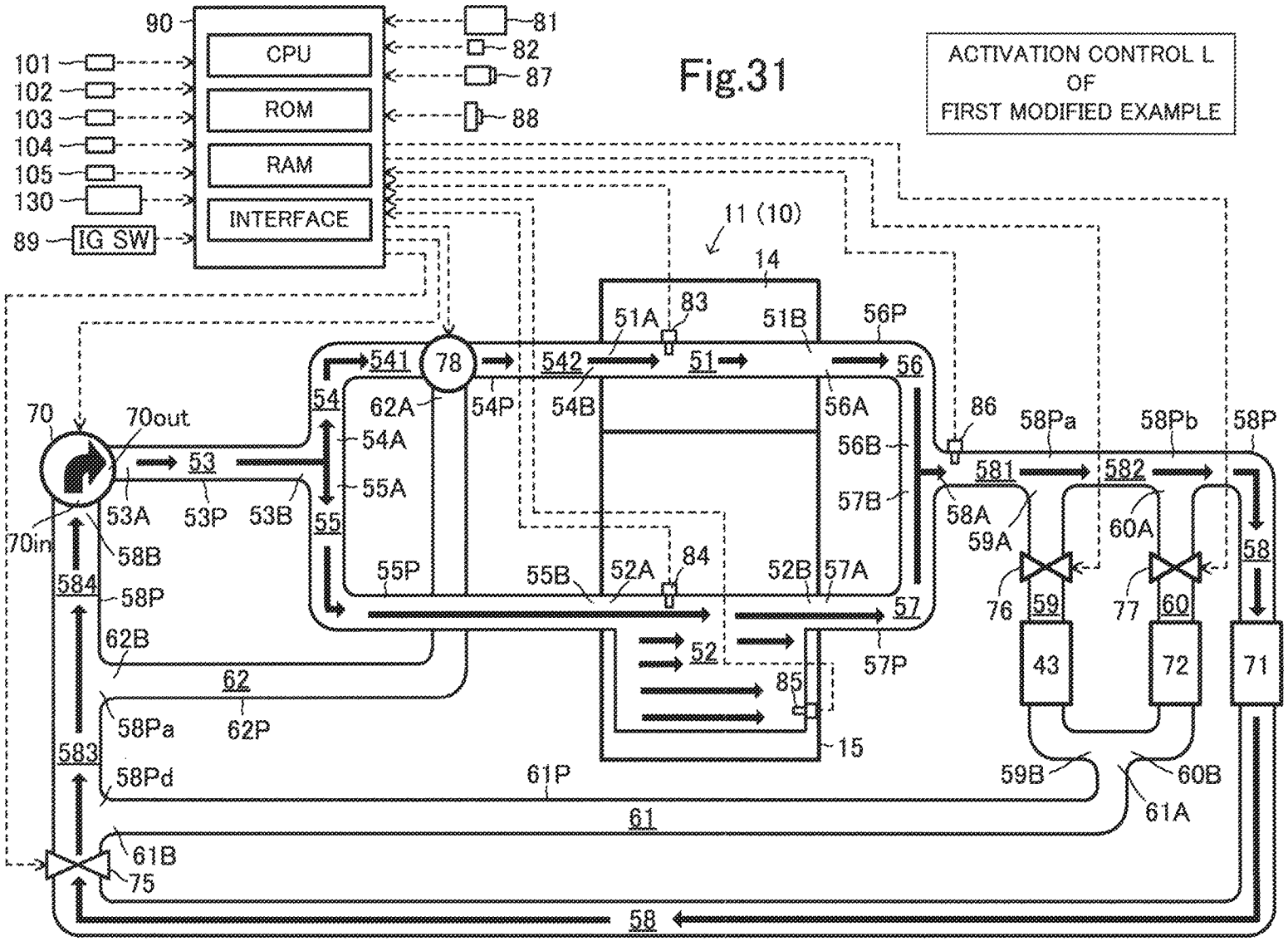
FIG. 31 is a view similar to FIG. 29 and which shows the flow of the cooling water when the cooling apparatus according to the first modified example executes the activation control L.
Figure 32:
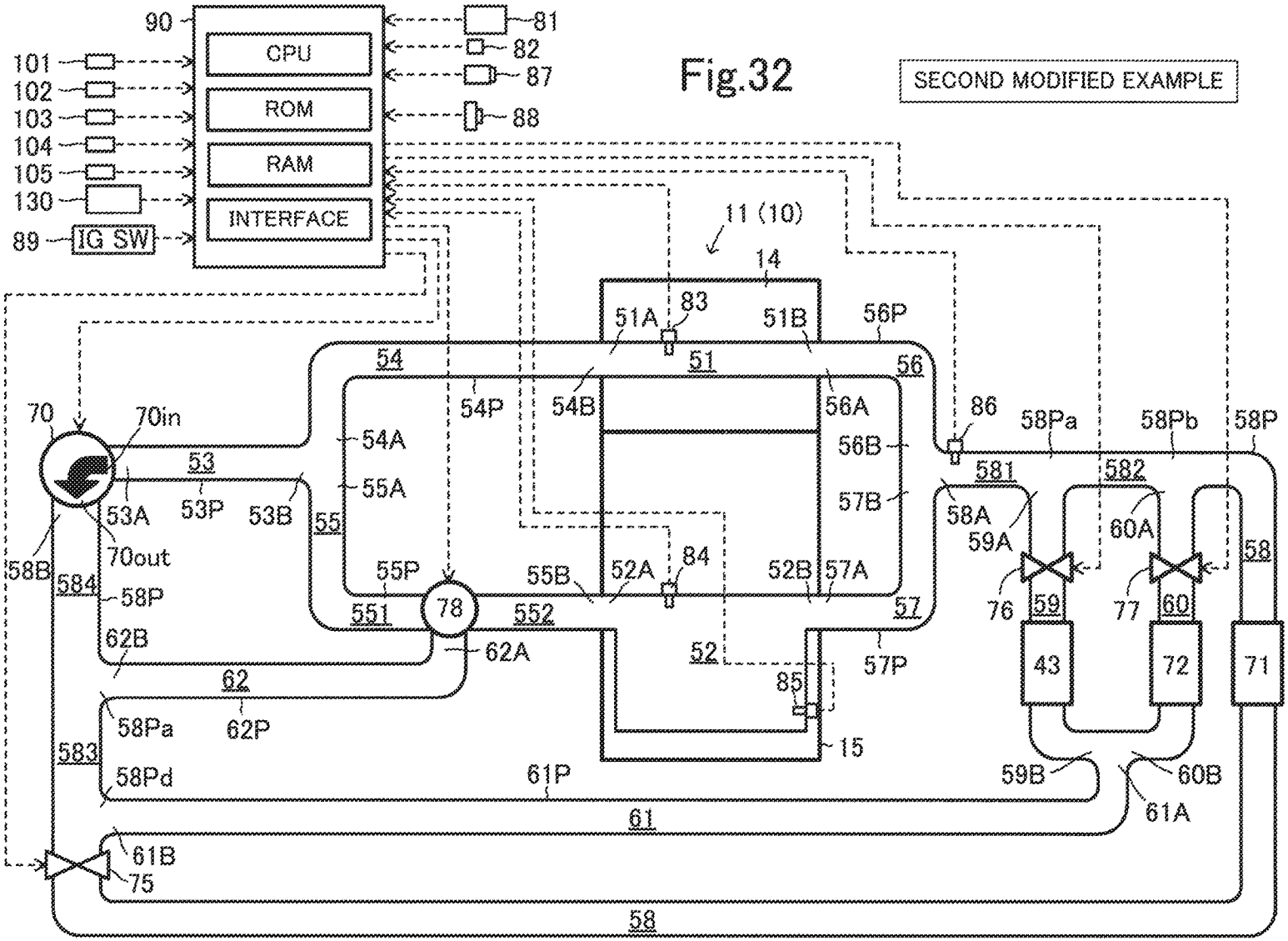
FIG. 32 is a view for showing a cooling apparatus according to a second modified example of the embodiment of the invention.

According to the activation control L, the first modified apparatus activates the pump 70, sets the shut-off valves 76 and 77 to the closed positions, respectively, sets the shut-off valve 75 to the open position, and sets the switching valve 78 to the normal flow position. When the first modified apparatus executes the activation control L, the cooling water circulates as shown by arrows in FIG. 31.

According to the activation control L, a part of the cooling water discharged to the water passage 53 via the pump discharging opening 70out, flows into the head water passage 51 through the water passage 54. The remaining of the cooling water discharged to the water passage 53 via the pump discharging opening 70out, flows into the block water passage 52 through the water passage 55.

The cooling water flowing into the head water passage 51, flows through the head water passage 51 and then, flows into the radiator water passage 58 through the water passage 56. The cooling water flowing into the block water passage 52, flows through the block water passage 52 and then, flows into the radiator water passage 58 through the water passage 57. The cooling water flowing into the radiator water passage 58, flows through the radiator 71 and then, is suctioned into the pump 70 via the pump suctioning opening 70in.

Thereby, the cooling water is supplied to the head and block water passages 51 and 52 through the radiator 71. Thus, the cylinder head 14 and the cylinder block 15 are cooled by the cooling water having the low temperature.

Second Modified Example

Figure 30:
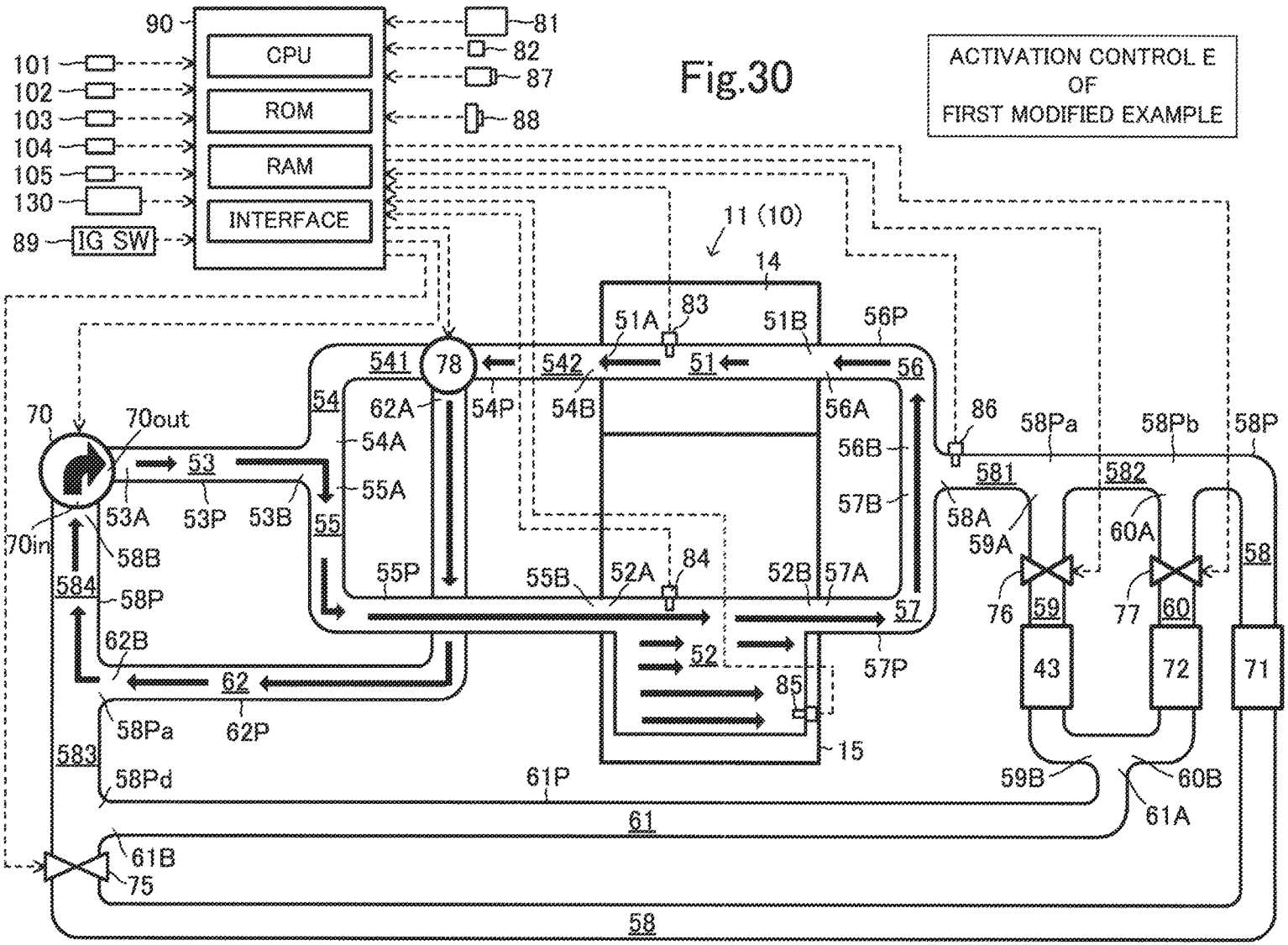
FIG. 30 is a view similar to FIG. 29 and which shows the flow of the cooling water when the cooling apparatus according to the first modified example executes the activation control E.

The embodiment apparatus may be modified to be a cooling apparatus shown in FIG. 30. In the cooling apparatus shown in FIG. 30 according to a second modified example of the embodiment (hereinafter, will be referred to as "the second modified apparatus"), the pump 70 is connected to the radiator water passage 58 at the pump suctioning opening 70in and to the water passage 53 at the pump discharging opening 70out.

<Operation of Second Modified Apparatus>

The second modified apparatus executes the activation controls A to O, similar to the embodiment apparatus. Conditions of executing the activation controls A to O in the second modified apparatus are the same as the conditions of executing the activation controls A to O in the embodiment apparatus. Below, the activation controls E and L among the activation controls A to O executed by the second modified apparatus will be described.

<Activation Control E>

Figure 33:
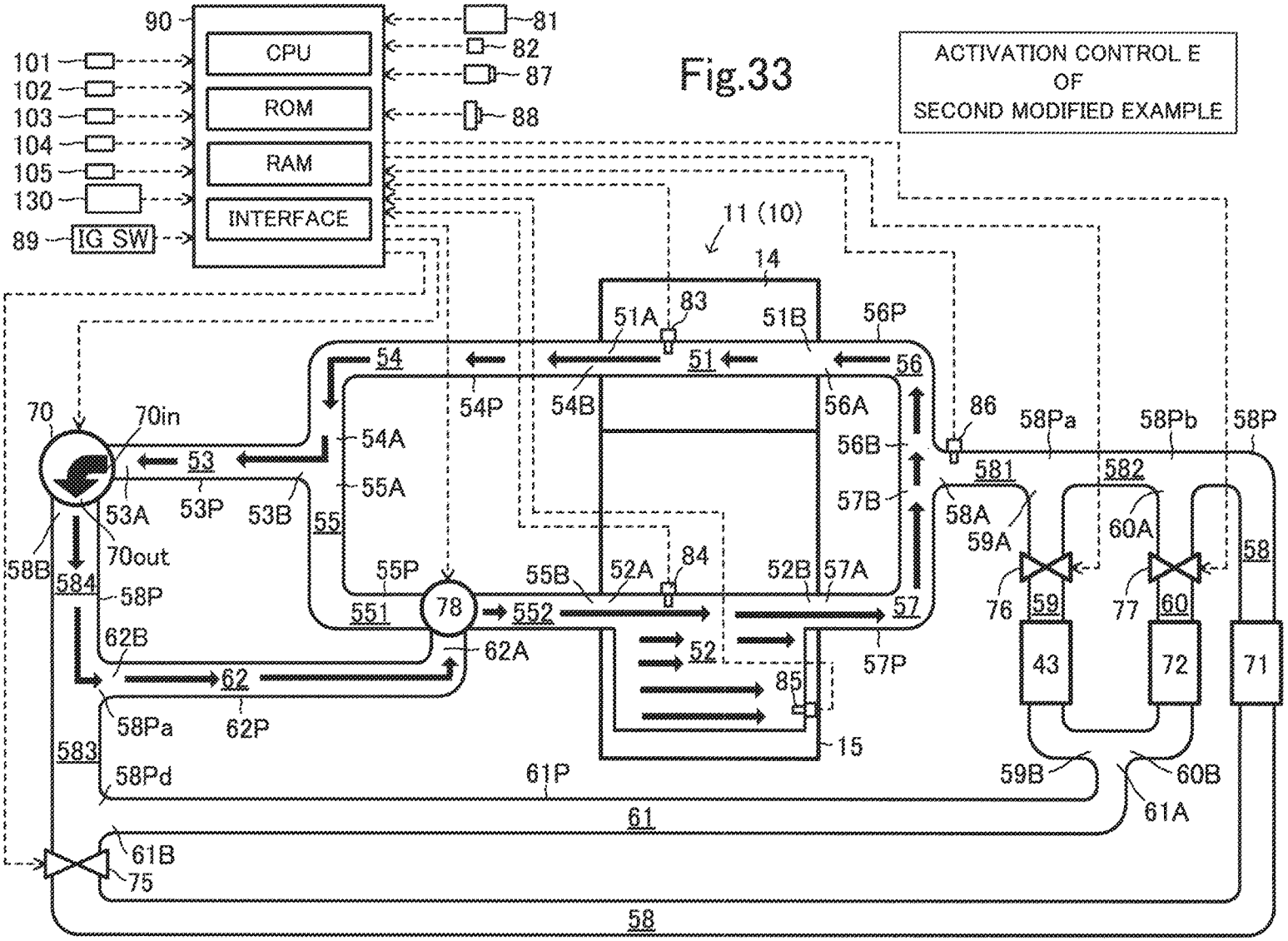
FIG. 33 is a view similar to FIG. 32 and which shows the flow of the cooling water when the cooling apparatus according to the second modified example executes the activation control E.

According to the activation control E, the second modified apparatus activates the pump 70, sets the shut-off valve 75 to 77 to the closed positions, respectively, and sets the switching valve 78 to the opposite flow position. When the second modified apparatus executes the activation control E, the cooling water circulates as shown by arrows in FIG. 33.

According to the activation control E, the cooling water is discharged to the radiator water passage 58 via the pump discharging opening 70out and then, flows into the block water passage 52 through the water passage 62 and the second portion 552 of the water passage 55. The cooling water flowing into the block water passage 52, flows through the block water passage 52 and then, flows into the head water passage 51 through the water passages 57 and 56. The cooling water flowing into the head water passage 51, flows through the head water passage 51 and then, flows through the water passages 54 and 53. Then, the cooling water is suctioned into the pump 70 via the pump suctioning opening 70in.

Thereby, the cooling water discharged from the head water passage 51 flows through the water passage 54, the water passage 53, the pump 70, the fourth portion 584 of the radiator water passage 58, the water passage 62, the switching valve 78, and the second portion 552 of the water passage 55. Then, the cooling water flows into the block water passage 52. In this case, the cooling water discharged from the head water passage 51 flows into the block water passage 52 without flowing through the radiator 71 and the like. The temperature of the cooling water is increased while the cooling water flows through the head water passage 51. Therefore, the cooling water having a high temperature is supplied to the block water passage 52. Thus, the block temperature Tbr increases at the large rate, compared with when the cooling water is supplied to the block water passage 52 through the radiator 71 and the like.

In addition, the cooling water is supplied to the head water passage 51 without flowing through the radiator 71 and the like. Thus, the head temperature Thd increases at the large rate, compared with when the cooling water is supplied to the head water passage 51 through the radiator 71 and the like.

In addition, the cooling water flows through the head and block water passages 51 and 52. Thus, the temperature of a part of the cooling water is prevented from increasing excessively in the head and block water passages 51 and 52. As a result, the cooling water is prevented from boiling in the head and block water passages 51 and 52.

<Activation Control L>

Figure 34:
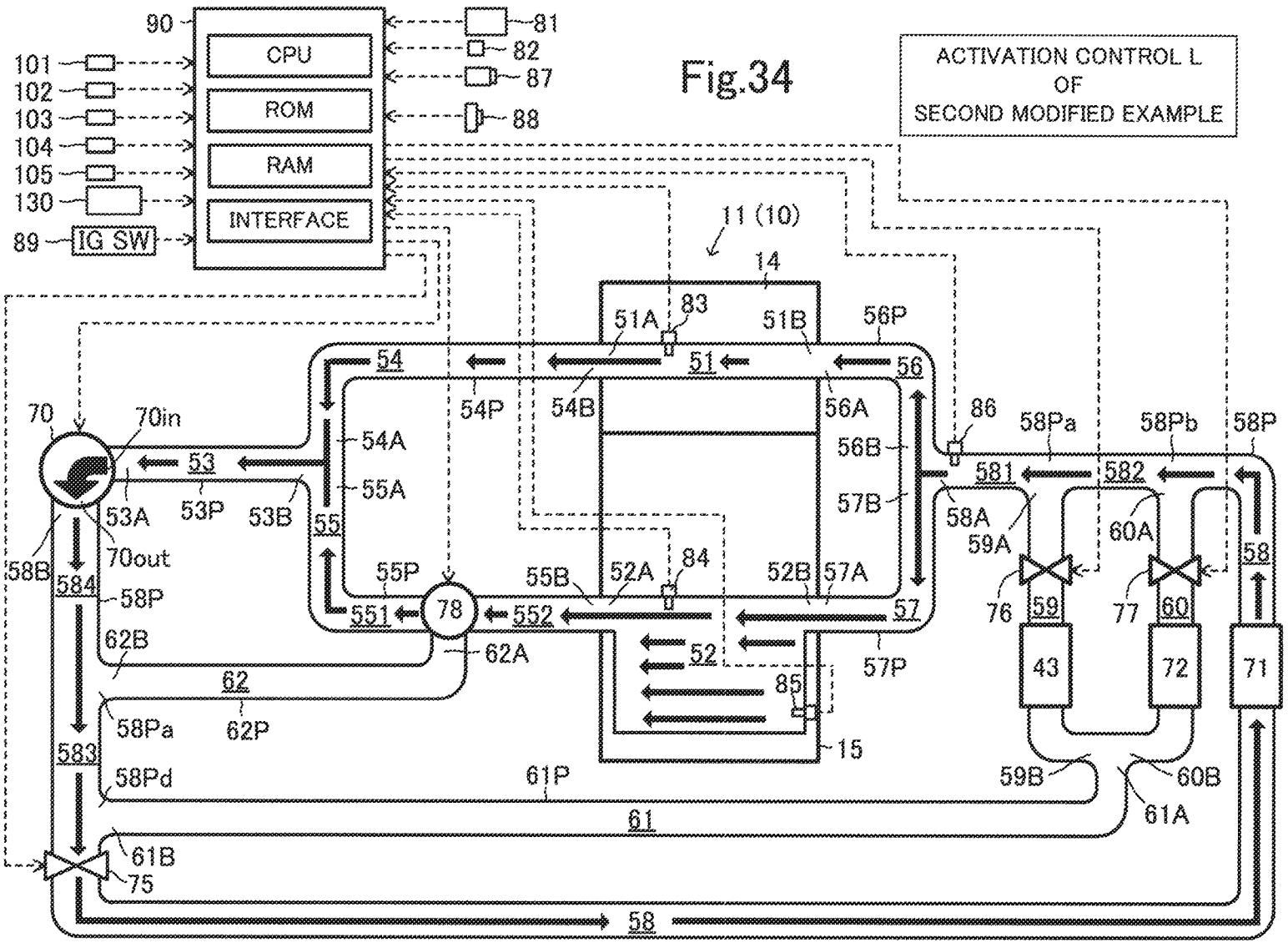
FIG. 34 is a view similar to FIG. 32 and which shows the flow of the cooling water when the cooling apparatus according to the second modified example executes the activation control L.

According to the activation control L, the second modified apparatus activates the pump 70, sets the shut-off valves 76 and 77 to the closed positions, respectively, sets the shut-off valve 75 to the open position, and sets the switching valve 78 to the normal flow position. When the second modified apparatus executes the activation control L, the cooling water circulates as shown by arrows in FIG. 34.

According to the activation control L, a part of the cooling water discharged to the radiator water passage 58 via the pump discharging opening 70out, flows into the head water passage 51 through the water passage 56. The remaining of the cooling water discharged to the radiator water passage 58 via the pump discharging opening 70out, flows into the block water passage 52 through the water passage 57.

The cooling water flowing into the head water passage 51, flows through the head water passage 51 and then, flows through the water passages 54 and 53. Then, the cooling water is suctioned into the pump 70 via the pump suctioning opening 70in. The cooling water flowing into the block water passage 52, flows through the block water passage 52 and then, flows through the water passages 55 and 53. Then, the cooling water is suctioned into the pump 70 via the pump suctioning opening 70in.

Thereby, the cooling water is supplied to the head and block water passages 51 and 52 through the radiator 71. Thus, the cylinder head 14 and the cylinder block 15 are cooled by the cooling water having the low temperature.

Third Modified Example

Figure 35:
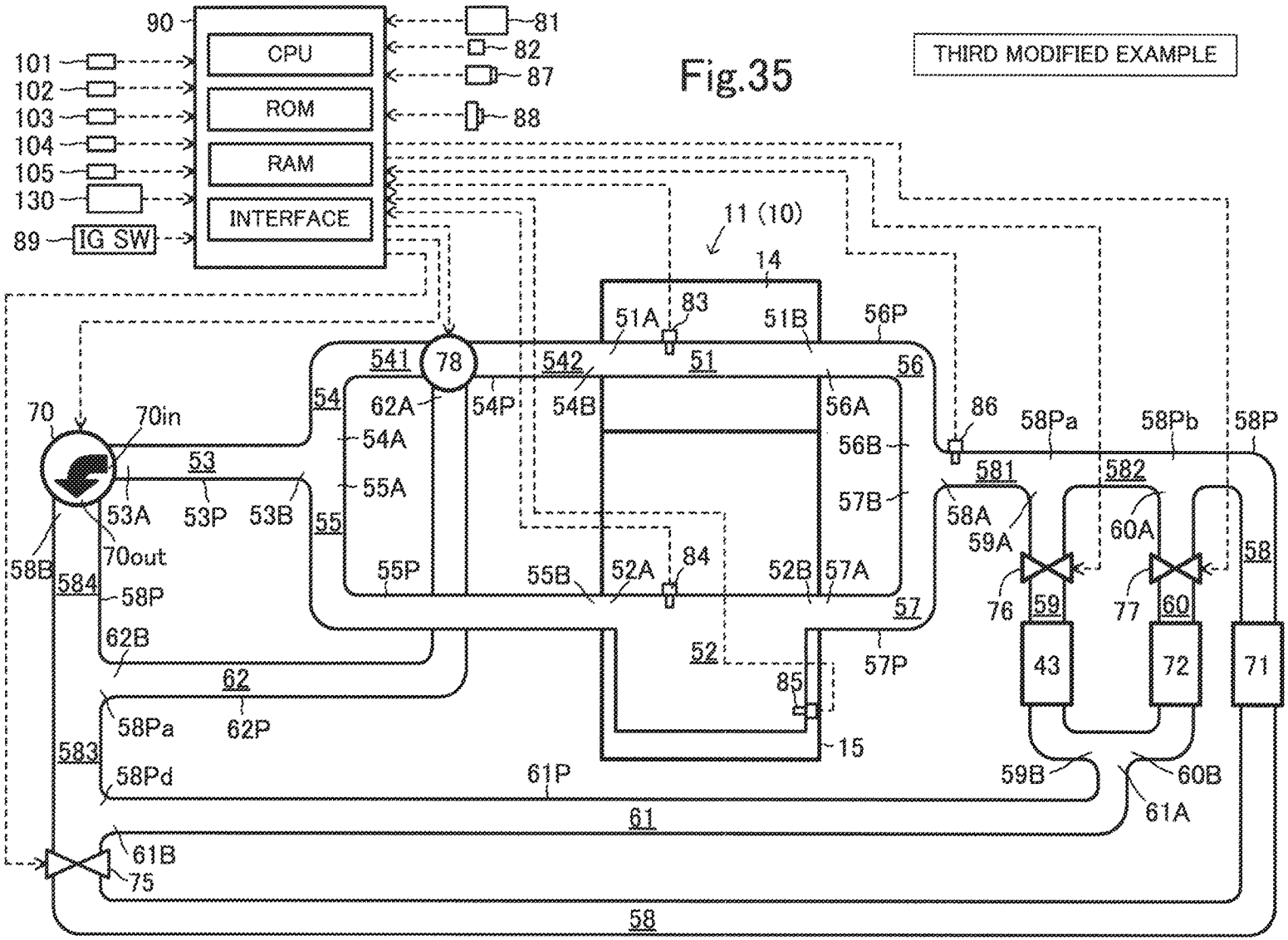
FIG. 35 is a view for showing a cooling apparatus according to a third modified example of the embodiment of the invention.

The embodiment apparatus may be modified to be a cooling apparatus shown in FIG. 35. Similar to the first modified apparatus, in the cooling apparatus shown in FIG. 35 according to a third modified example of the embodiment (hereinafter, will be referred to as "the third modified apparatus"), the switching valve 78 is provided in the cooling water pipe 54P, not in the cooling water pipe 55P. The first end 61A of the cooling water pipe 62P is connected to the switching valve 78.

Similar to the second modified apparatus, in the third modified apparatus, the pump 70 is connected to the radiator water passage 58 at the pump suctioning opening 70in and to the water passage 53 at the pump discharging opening 70out.

A function of the switching valve 78 of the third modified apparatus set to the normal flow position is the same as the function of the switching valve 78 of the first modified apparatus set to the normal flow position. The function of the switching valve 78 of the third modified apparatus set to the opposite flow position is the same as the function of the switching valve 78 of the first modified apparatus set to the opposite flow position.

<Operation of Third Modified Apparatus>

The third modified apparatus executes the activation controls A to O, similar to the embodiment apparatus. Conditions of executing the activation controls A to O are the same as the conditions of executing the activation controls A to O in the embodiment apparatus. Below, the activation controls E and L among the activation controls A to O executed by the third modified apparatus will be described.

<Activation Control E>

Figure 36:
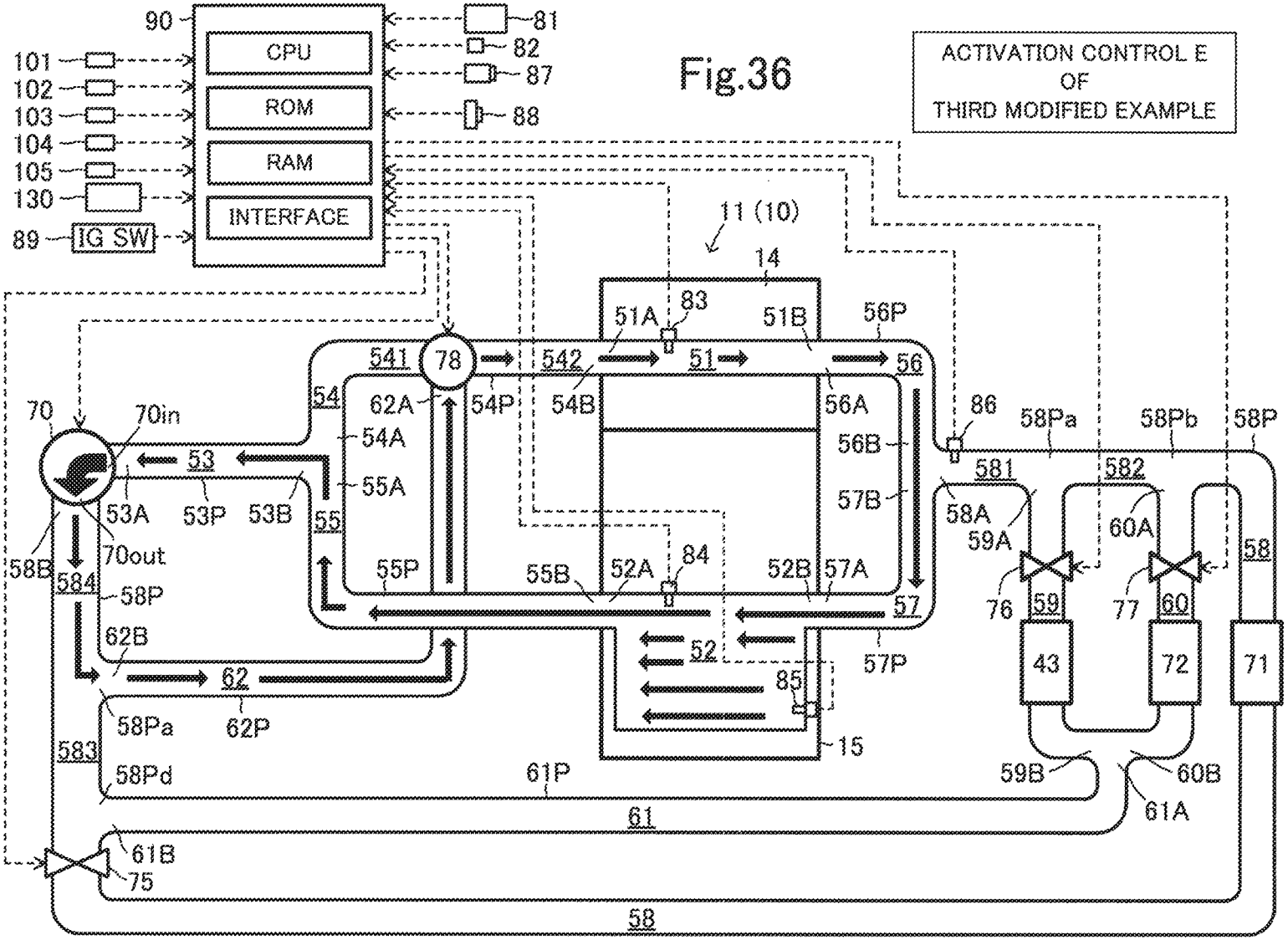
FIG. 36 is a view similar to FIG. 35 and which shows the flow of the cooling water when the cooling apparatus according to the third modified example executes the activation control E.

According to the activation control E, the third modified apparatus activates the pump 70, sets the shut-off valve 75 to 77 to the closed positions, respectively, and sets the switching valve 78 to the opposite flow position. When the third modified apparatus executes the activation control E, the cooling water circulates as shown by arrows in FIG. 36.

According to the activation control E, the cooling water is discharged to the radiator water passage 58 via the pump discharging opening 70out and then, flows into the head water passage 51 through the water passage 62 and the second portion 542 of the water passage 54. The cooling water flowing into the head water passage 51, flows through the head water passage 51 and then, flows into the block water passage 52 through the water passages 56 and 57. The cooling water flowing into the block water passage 52, flows through the block water passage 52 and then, flows through the water passages 55 and 53. Then, the cooling water is suctioned into the pump 70 via the pump suctioning opening 70in.

Thereby, the cooling water having the temperature increased by flowing through the head water passage 51, flows directly into the block water passage 52 without flowing through the radiator 71 and the like. Thus, the block temperature Tbr increases at the large rate, compared with when the cooling water is supplied to the block water passage 52 through the radiator 71 and the like.

In addition, the cooling water is supplied to the head water passage 51 without flowing through the radiator 71 and the like. Thus, the head temperature Thd increases at the large rate, compared with when the cooling water is supplied to the head water passage 51 through the radiator 71 and the like.

In addition, the cooling water flows through the head and block water passages 51 and 52. Thus, the temperature of a part of the cooling water is prevented from increasing excessively in the head and block water passages 51 and 52. As a result, the cooling water is prevented from boiling in the head and block water passages 51 and 52.

<Activation Control L>

Figure 37:
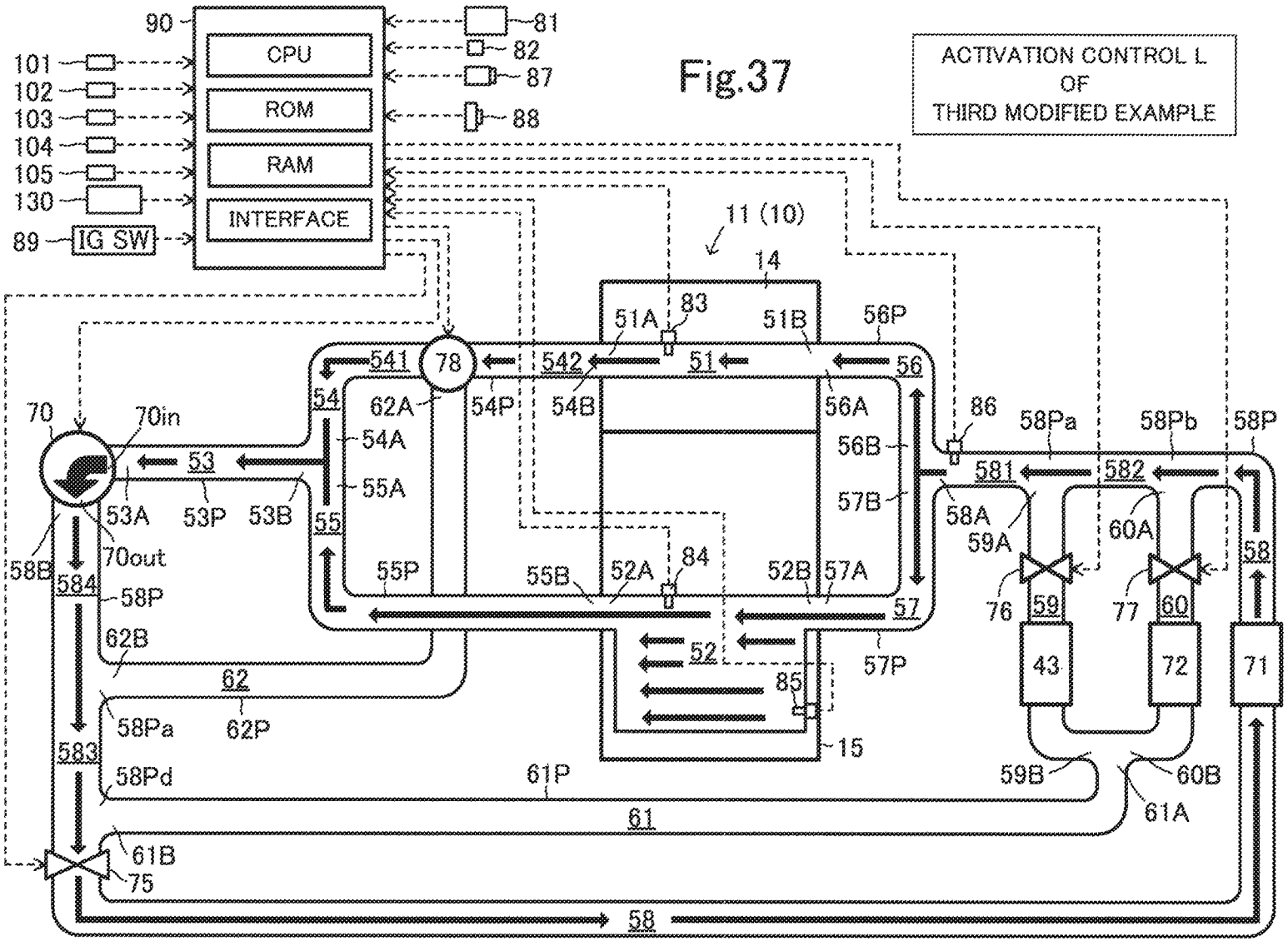
FIG. 37 is a view similar to FIG. 35 and which shows the flow of the cooling water when the cooling apparatus according to the third modified example executes the activation control L.

According to the activation control L, the third modified apparatus activates the pump 70, sets the shut-off valves 76 and 77 to the closed positions, respectively, sets the shut-off valve 75 to the open position, and sets the switching valve 78 to the normal flow position. When the third modified apparatus executes the activation control L, the cooling water circulates as shown by arrows in FIG. 37.

According to the activation control L, a part of the cooling water discharged to the radiator water passage 58 via the pump discharging opening 70out, flows into the head water passage 51 through the water passage 56. The remaining of the cooling water discharged to the radiator water passage 58 via the pump discharging opening 70out, flows into the block water passage 52 through the water passage 57.

The cooling water flowing into the head water passage 51, flows through the head water passage 51 and then, flows through the water passages 54 and 53. Then, the cooling water is suctioned into the pump 70 via the pump suctioning opening 70in. The cooling water flowing into the block water passage 52, flows through the block water passage 52 and then, flows through the water passages 55 and 53. Then, the cooling water is suctioned into the pump 70 via the pump suctioning opening 70in.

Thereby, the cooling water is supplied to the head and block water passages 51 and 52 through the radiator 71. Thus, the cylinder head 14 and the cylinder block 15 are cooled by the cooling water having the low temperature.

Fourth Modified Example

Figure 38:
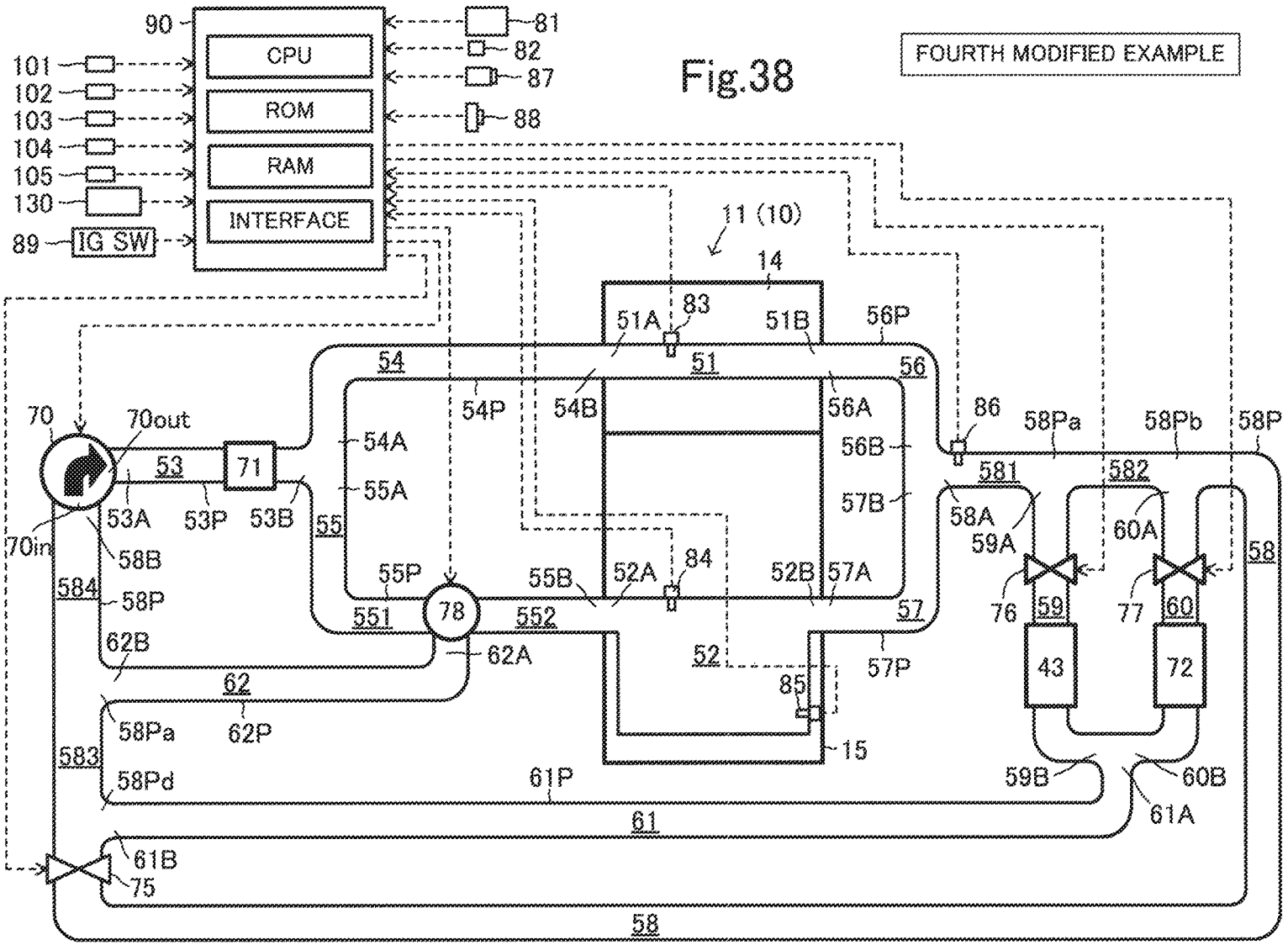
FIG. 38 is a view for showing a cooling apparatus according to a fourth modified example of the embodiment of the invention.

The embodiment apparatus may be modified to be a cooling apparatus shown in FIG. 38. In the cooling apparatus shown in FIG. 38 according to a fourth modified example of the embodiment (hereinafter, will be referred to as "the fourth modified apparatus"), the radiator 71 is not provided in the radiator water passage 58 which connects the second end 56B of the water passage 56 and the second end 57B of the water passage 57 to the pump 70. The radiator 71 of the fourth modified apparatus is provided in the water passage 53.

<Operation of Fourth Modified Apparatus>

In contrast to the embodiment apparatus, the fourth modified apparatus executes the activation controls F to H in place of the activation controls I to K, respectively. Conditions of executing the activation controls F to H in the fourth modified apparatus, are the same as the conditions of executing the activation controls I to K in the embodiment apparatus, respectively. On the other hand, similar to the embodiment apparatus, the fourth modified apparatus executes the activation controls A to H, and L to O, respectively. Conditions of executing the activation controls A to H, and L to O are the same as the conditions of executing the activation controls A to H, and L to O, respectively.

When the fourth modified apparatus executes any of the activation controls A to D, and L to O, the same effects as the effects achieved by the activation controls A, and L to O executed by the embodiment apparatus, are achieved.

When the fourth modified apparatus executes any of the activation controls E to K, the cooling water cooled by the radiator 71 flows into the head water passage 51. Therefore, the cooling water having a decreased temperature is supplied to the head water passage 51. On the other hand, the cooling water discharged from the head water passage 51 flows directly into the block water passage 52. Therefore, the cooling water having an increased temperature is supplied to the block water passage 52. Thus, the block temperature Tbr increases at the large rate, compared with when the cooling water cooled by the radiator 71 is supplied directly to the block water passage 52.

Fifth Modified Example

The embodiment apparatus may be modified to execute any of the activation controls A to O as shown in FIG. 39, depending on the warmed state, the presence or absence of the EGR cooler water supply request, and the presence or absence of the heater core water supply request. Hereinafter, the cooling apparatus configured to execute any of the activation controls A to O as shown in FIG. 39, will be referred to as the fifth modified apparatus.

The activation controls shown in FIG. 39 and executed by the fifth modified apparatus are the same as those shown in FIG. 5 and executed by the embodiment apparatus except that the activation control I is executed when the warmed state is the second semi-warmed state, and the EGR cooler water supply and the heater core water supply are not requested.

When the EGR cooler water supply and the heater core water supply are not requested and any of the second semi-warmed condition Ca2 and the like is satisfied after the ignition switch 89 is set to the ON position, i.e., the engine operation is permitted, the fifth modified apparatus executes the activation control I. Thereafter, when the EGR cooler water supply and the heater core water supply are not requested, and any of the first semi-warmed condition Ca1 and the like is satisfied, the fifth modified apparatus executes the activation control I, not the activation control E.

Therefore, the increasing rate of the block temperature Tbr is small, compared with when the activation control E is executed. Thus, the block temperature Tbr is prevented from increasing excessively. As a result, the cooling water is prevented from boiling in the block water passage 52.

Further, the invention can be applied to an internal combustion engine which is configured to execute an idling stop control for stopping the engine operation when the vehicle is stopped by a braking operation of the driver and restarting the engine operation when the driver operates the acceleration pedal.

When the vehicle moves, for example, in an extreme cold area and thus, the temperature of the outside air is extremely low, the engine operation may be in an idling state for a long time and thus, the engine load may be extremely small for a long time after any of the second semi-warmed condition Ca2 and the like is satisfied. In this case, the temperature of the cooling water discharged from the head and block water passages, may decrease and thus, any of the first semi-warmed condition Ca1 and the like may be satisfied. Therefore, the invention can be applied to an internal combustion engine which does not stop while the ignition switch 89 is set to the ON position.

Further, the EGR system 40 of any of the embodiment apparatus and the modified apparatuses may be configured to include a bypass pipe which connects a portion of the exhaust gas recirculation pipe 41 upstream of the EGR cooler 43 and a portion of the exhaust gas recirculation pipe 41 downstream of the EGR cooler 43 such that the EGR gas bypasses the EGR cooler 43.

The embodiment apparatus and the modified apparatuses configured as such may be configured to supply the EGR gas to the cylinders 12 through the bypass pipe even when the engine operation state is in the EGR stop area Ra shown in FIG. 4. In this case, the EGR gas bypasses the EGR cooler 43. Thus, the EGR gas having a relatively high temperature is supplied to the cylinders 12.

Otherwise, the embodiment apparatus and the modified apparatuses may be configured to selectively perform any of a stop of a supply of the EGR gas to the cylinders 12 and a supply of the EGR gas to the cylinders 12 through the bypass pipe, depending on a condition relating to parameters including the engine operation state when the engine operation state is in the EGR stop area Ra.

Further, the embodiment apparatus and the modified apparatuses may be configured to use the temperature of the cylinder block 15 in place of the upper block water temperature TWbr_up when a temperature sensor for detecting the temperature of the cylinder block 15, in particular, the temperature of a portion of the cylinder block 15 near cylinder bores defining the combustion chambers, is provided in the cylinder block 15. Further, the embodiment apparatus and the modified apparatuses may be configured to use the temperature of the cylinder head 14 in place of the head water temperature TWhd when a temperature sensor for detecting the temperature of the cylinder head 14, in particular, the temperature of a portion of the cylinder head 14 near a surface of the cylinder head 14 defining the combustion chambers, is provided in the cylinder head 14.

Further, the embodiment apparatus and the modified apparatuses may be configured to use an after-engine-start integration fuel amount ΣQ in place of or in addition to the after-engine-start integration air amount ΣGa. The after-engine-start integration fuel amount ΣQ is a total amount of the fuel supplied from the fuel injectors 13 to the cylinders 12*a* to 12*d* since the engine operation starts after the ignition switch 89 is set to the ON position.

The embodiment apparatus and the modified apparatuses configured as such, determine that the warmed state is the cool state when the after-engine-start integration fuel amount ΣQ is equal to or smaller than a first threshold fuel amount ΣQ1. When the after-engine-start integration fuel amount ΣQ is larger than the first threshold fuel amount ΣQ1 and equal to or smaller than a second threshold fuel amount ΣQ2, the embodiment apparatus and the modified apparatuses determine that the warmed state is the first semi-warmed state. Further, the embodiment apparatus and the modified apparatuses determine that the warmed state is the second semi-warmed state when the after-engine-start integration fuel amount ΣQ is larger than the second threshold fuel amount ΣQ2 and equal to or smaller than a third threshold fuel amount ΣQ3. The embodiment apparatus and the modified apparatuses determine that the warmed state is the completely-warmed state when the after-engine-start integration fuel amount ΣQ is larger than the third threshold fuel amount ΣQ3.

Further, the embodiment apparatus and the modified apparatuses may be configured to determine that the EGR cooler water supply is requested when the engine water temperature TWeng is equal to or higher than the seventh engine water temperature TWeng7, and the engine operation state is in the EGR stop area Ra or Rc shown in FIG. 4. In this case, the processes of the steps 2605 and 2630 of FIG. 26 are omitted. Thereby, the cooling water is already supplied to the EGR cooler water passage 59 when the engine operation state changes from the EGR stop area Ra or Rc to the EGR area Rb. Thus, the EGR gas is cooled at the same time as the start of the supply of the EGR gas to the cylinders 12.

Further, the embodiment apparatus and the modified apparatuses may be configured to determine that the heater core water supply is requested, independently of the set state of the heater switch 88 when the outside air temperature Ta is higher than the threshold temperature Tath, and the engine water temperature TWeng is higher than the ninth engine water temperature TWeng9. In this case, the process of the step 2710 of FIG. 27 is omitted.

Further, the invention can be applied to a cooling apparatus which does not include the EGR cooler water passage 59 and the shut-off valve 76, and a cooling apparatus which does not include the heater core water passage 60 and the shut-off valve 77.

What is claimed is:

1. A cooling apparatus of an internal combustion engine for cooling a cylinder head and a cylinder block of the internal combustion engine by cooling water, wherein that the cooling apparatus comprises:

a pump for circulating the cooling water;

a radiator for cooling the cooling water;

at least one heat exchanger for exchanging heat between the at least one heat exchanger and the cooling water;

a head water passage formed in the cylinder head;

a block water passage formed in the cylinder block;

a first circulation water passage for supplying the cooling water discharged from the head water passage, to the block water passage without flowing the cooling water through the radiator and the at least one heat exchanger and supplying the cooling water discharged from the block water passage, to the head water passage;

a second circulation passage for supplying the cooling water discharged from the head water passage, to the head water passage through the at least one heat exchanger;

a third circulation water passage for supplying the cooling water discharged from the head and block water passages, to the head and block water passages through the heat exchanger;

a fourth circulation water passage for supplying the cooling water discharged from the head and block water passages, to the head and block water passages through the radiator;

at least one sensor for acquiring a temperature of the cooling water as a cooling water temperature; and an electronic control unit for controlling an activation of the pump and select from among the first to fourth circulation water passages as a circulation water passage for circulating the cooling water, the electronic control unit is configured to:

perform a first circulation operation for activating the pump and circulating the cooling water through the first and second circulation water passages when a low temperature condition and a first condition including a water supply condition are satisfied, the low temperature condition being a condition that the cooling water temperature is lower than a predetermined water temperature lower than an engine completely-warmed temperature at which warming of the internal combustion engine is completed, the water supply condition being a condition that a supply of the cooling water to the heat exchanger is requested;

perform a second circulation operation for activating the pump and circulating the cooling water through the third circulation water passage when a second condition is satisfied, the second condition including a high temperature condition and the water supply condition, the high temperature condition being a condition that the cooling water temperature is lower than the engine completely-warmed water temperature;

perform a cooling circulation operation for activating the pump and circulating the cooling water through the fourth circulation water passage when an engine completely-warmed condition is satisfied, the engine completely-warmed condition being a condition that the cooling water temperature is equal to or higher than the engine completely-warmed water temperature; and perform the second circulation operation when the second condition is satisfied and then, the first condition is satisfied after an operation of the internal combustion engine is permitted.

2. The cooling apparatus of the internal combustion engine according to claim 1, wherein the electronic control unit is further configured to:

perform a third circulation operation for activating the pump and flowing the cooling water through the first circulation water passage while controlling a flow rate of the cooling water such that the flow rate of the cooling water supplied to the head and block water passages, is smaller than a predetermined flow rate when a third condition is satisfied, the third condition being a condition that the low temperature condition is satisfied, and the water supply condition is not satisfied;

perform a fourth circulation operation for activating the pump and flowing the cooling water through the first circulation water passage while controlling the flow rate of the cooling water such that the flow rate of the cooling water supplied to the head and block water passages, is equal to or larger than the predetermined flow rate when a fourth condition is satisfied, the fourth condition being a condition that the high temperature condition is satisfied, and the water supply condition is not satisfied; and perform the fourth circulation operation when the fourth condition is satisfied and then, third condition is satisfied after the operation of the internal combustion engine is permitted.

3. The cooling apparatus of the internal combustion engine according to claim 1, wherein the electronic control unit is further configured to:

perform a fifth circulation operation for activating the pump and circulating the cooling water through the first circulation water passage when a third condition is satisfied, the third condition being a condition that the low temperature condition is satisfied, and the water supply condition is not satisfied;

perform a sixth circulation operation for activating the pump and circulating the cooling water through the third circulation water passage when a fourth condition is satisfied, the fourth condition being a condition that the high temperature condition is satisfied, and the water supply condition is not satisfied; and perform the sixth circulation operation when the fourth condition is satisfied and then, the third condition is satisfied after the operation of the internal combustion engine is permitted.

4. The cooling apparatus of the internal combustion engine according to claim 1, wherein the electronic control unit is further configured to perform the second circulation operation when the engine completely-warmed condition is satisfied and then, the first condition is satisfied after the operation of the internal combustion engine is permitted.

5. The cooling apparatus of the internal combustion engine according to claim 1, wherein the electronic control unit is further configured to activate the pump and circulate the cooling water through the second circulation passage without circulating the cooling water through the first circulation water passage when a cool condition and the water supply condition are satisfied, the cool condition being a condition that the cooling water temperature is lower than a cool state water temperature lower than the predetermined water temperature.

6. The cooling apparatus of the internal combustion engine according to claim 5, wherein the electronic control unit is further configured to stop an activation of the pump when the cool condition is satisfied, and the water supply condition is not satisfied.

* * * * *